US007726648B2

(12) United States Patent
Tamura et al.

(10) Patent No.: US 7,726,648 B2
(45) Date of Patent: Jun. 1, 2010

(54) METHOD AND APPARATUS FOR IMAGE FORMING CAPABLE OF EFFECTIVELY CONVEYING PAPER SHEETS

(75) Inventors: Masahiro Tamura, Tokyo (JP); Shohichi Satoh, Kanagawa (JP); Shuuya Nagasako, Kanagawa (JP); Makoto Hidaka, Tokyo (JP); Ichiro Ichihashi, Aichi (JP); Hitoshi Hattori, Tokyo (JP); Nobuyoshi Suzuki, Tokyo (JP); Kazuhiro Kobayashi, Saitama (JP); Akira Kunieda, Tokyo (JP); Hiroshi Maeda, Aichi (JP); Tomoichi Nomura, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 455 days.

(21) Appl. No.: 11/436,559

(22) Filed: May 19, 2006

(65) Prior Publication Data

US 2006/0261544 A1 Nov. 23, 2006

(30) Foreign Application Priority Data

May 20, 2005 (JP) ..... 2005-148308
Feb. 24, 2006 (JP) ..... 2006-048779

(51) Int. Cl.
*B65H 43/00* (2006.01)

(52) U.S. Cl. ..... 271/176; 271/273; 271/902

(58) Field of Classification Search ..... 271/273, 271/176, 314, 902
See application file for complete search history.

(56) References Cited

U.S. PATENT DOCUMENTS 5,449,164 A * 9/1995 Quesnel et al. ..... 271/186
5,692,411 A 12/1997 Tamura
5,971,388 A 10/1999 Hattori et al.
6,091,927 A 7/2000 Hattori et al.
6,145,825 A 11/2000 Kunihiro et al.

(Continued)

FOREIGN PATENT DOCUMENTS

JP 07-002417 1/1995

(Continued)

OTHER PUBLICATIONS

European Search Report dated Sep. 12, 2006 (for corresponding European Patent Application No. 06009325.9-2314).

*Primary Examiner*—Patrick H Mackey
*Assistant Examiner*—Michael C McCullough
(74) *Attorney, Agent, or Firm*—Harness, Dickey & Pierce, P.L.C.

(57) ABSTRACT

A sheet conveying device includes a first conveying path configured to pass a sheet of a recording medium (e.g., paper) therethrough to a sheet processing device, a second conveying path branched from the first conveying path and configured to temporarily store the paper sheet conveyed therein, a sheet conveying mechanism configured to selectably convey the paper sheet in one of forward and backward directions to the sheet processing device, a guide member mounted at a branch point of the first and second conveying paths and configured to guide the paper sheet when the paper sheet is conveyed in the backward direction by the sheet conveying mechanism to the second conveying path, and a control unit configured to control the sheet conveying mechanism to change a distance between the branch point and the sheet conveying mechanism according to a length of the paper sheet in a forward sheet conveying direction.

19 Claims, 43 Drawing Sheets

U.S. PATENT DOCUMENTS

| | | | | |
|---|---|---|---|---|
| 6,168,153 | B1 * | 1/2001 | Richards et al. | 271/227 |
| 6,199,853 | B1 | 3/2001 | Andoh et al. | |
| 6,264,191 | B1 | 7/2001 | Suzuki et al. | |
| 6,296,247 | B1 | 10/2001 | Tamura et al. | |
| 6,394,448 | B2 | 5/2002 | Suzuki et al. | |
| 6,494,449 | B2 | 12/2002 | Tamura et al. | |
| 6,494,453 | B1 | 12/2002 | Yamada et al. | |
| 6,527,269 | B2 | 3/2003 | Yamada et al. | |
| 6,549,734 | B2 | 4/2003 | Yamada et al. | |
| 6,698,744 | B2 | 3/2004 | Yamada et al. | |
| 6,783,124 | B2 | 8/2004 | Tamura et al. | |
| 6,832,759 | B2 | 12/2004 | Nagasako et al. | |
| 6,871,851 | B2 | 3/2005 | Tamura et al. | |
| 6,889,974 | B2 | 5/2005 | Tamura et al. | |
| 6,905,118 | B2 | 6/2005 | Yamada et al. | |
| 6,921,069 | B2 | 7/2005 | Suzuki et al. | |
| 6,957,810 | B2 | 10/2005 | Yamada et al. | |
| 6,988,729 | B2 | 1/2006 | Tamura et al. | |
| 2002/0135119 | A1 | 9/2002 | Suzuki et al. | |
| 2003/0006543 | A1 | 1/2003 | Tamura et al. | |
| 2003/0160376 | A1 | 8/2003 | Yamada et al. | |
| 2003/0215275 | A1 | 11/2003 | Tamura et al. | |
| 2003/0219295 | A1 | 11/2003 | Saitoh et al. | |
| 2004/0094887 | A1 | 5/2004 | Hidaka et al. | |
| 2004/0104525 | A1 | 6/2004 | Suzuki et al. | |
| 2004/0126163 | A1 | 7/2004 | Asami et al. | |
| 2004/0254054 | A1 | 12/2004 | Suzuki et al. | |
| 2004/0256783 | A1 | 12/2004 | Ilda et al. | |
| 2005/0057777 | A1 | 3/2005 | Doron | |
| 2005/0061131 | A1 | 3/2005 | Tamura et al. | |
| 2005/0067764 | A1 | 3/2005 | Tamura et al. | |
| 2005/0067777 | A1 * | 3/2005 | Ilda et al. | 271/303 |
| 2005/0082747 | A1 | 4/2005 | Tamura et al. | |
| 2005/0189706 | A1 | 9/2005 | Tamura et al. | |
| 2005/0206071 | A1 | 9/2005 | Suzuki et al. | |
| 2005/0211035 | A1 | 9/2005 | Tamura et al. | |
| 2005/0218579 | A1 | 10/2005 | Yamada et al. | |
| 2005/0225021 | A1 | 10/2005 | Yamada et al. | |
| 2006/0022394 | A1 | 2/2006 | Tamura et al. | |
| 2006/0055100 | A1 | 3/2006 | Suzuki et al. | |

FOREIGN PATENT DOCUMENTS

| | | |
|---|---|---|
| JP | 11-199128 | 7/1999 |
| JP | 2000-327208 | 11/2000 |
| JP | 2001-097631 | 4/2001 |
| JP | 2004-001998 | 1/2004 |

* cited by examiner

| FIG. 2A |
| --- |
| FIG. 2B |

| |
|---|
| FIG. 15AA |
| FIG. 15AB |

METHOD AND APPARATUS FOR IMAGE FORMING CAPABLE OF EFFECTIVELY CONVEYING PAPER SHEETS

PRIORITY STATEMENT

The present patent application claims priority under 35 U.S.C. §119 upon Japanese patent applications no. 2005-148308, filed in the Japan Patent Office on May 20, 2005, and no. 2006-048779, filed in the Japan Patent Office on Feb. 24, 2006, the disclosures of each of which are incorporated by reference herein in their entirety.

BACKGROUND

A background sheet conveying device apparatus of a first example includes a path selector disposed in a conveying path. When the trailing edge of a proceeding paper sheet passed the path selector, conveying rollers are switched to rotate in the opposite direction, and the trailing edge of the proceeding paper sheet is guided to a sheet stacking portion to store the paper sheet. Thereby, the proceeding paper sheet can be stacked with a following paper sheet to be conveyed together. In the background sheet conveying device, the above-described operation is repeated so that two or more paper sheets can stack to be conveyed as stacked paper sheets or a sheet stack.

A background sheet conveying device of a second example includes a recording sheet feeding section, a processing tray, a sheet detecting sensor, and a recording paper feeding control section. The recording sheet feeding section conveys paper sheets along a path to an outlet. The processing tray temporarily accumulates the paper sheets in the recording sheet feeding section. The sheet detecting sensor determines whether the paper sheets conveyed from the recording sheet feeding section has different types or different sizes. The recording paper feeding control section controls the number of paper sheets to be accumulated in the processing tray when the paper sheet conveyed from the recording sheet feeding section has different types or different sizes.

A background sheet conveying device of a third example includes a shift tray, a staple tray, a first carrying path, and a second carrying path. The shift tray directly stacks paper sheets discharged from an image forming apparatus or stacks sheet stacks after a sheet conveying process. The first carrying path runs from an inlet part to the shift tray. The second carrying path is branched from the first carrying path and runs toward the staple tray. A switching claw is provided at the first carrying path. An accumulation carrying path is branched from the first carrying path at the switching claw to merge the second carrying path.

In the background sheet conveying device of the first example, when the trailing edge of a paper sheet is guided to the sheet stacking portion for stacking, the leading edge of the paper sheet is held at the nip of conveying rollers extending therefrom by a specific amount of length. That is, the paper sheet is backwardly conveyed to the sheet stacking portion for stacking, is stopped at an appropriate position, and is forwardly conveyed immediately before the leading edge of a next paper sheet reaches the conveying rollers so that the amount of shift between the two paper sheets can be reduced when the two paper sheets are overlaid and conveyed. However, if the above-described operation is performed for paper sheets having different sizes, a paper sheet having a longer length in a sheet conveyance direction needs a longer distance to store the trailing edge, which takes a longer time to perform. Therefore, a longer interval between paper sheets is required.

Recent image forming apparatuses have a higher speed and longer life as well as shorter intervals of sheets. The background sheet conveying device cannot smoothly perform with such image forming apparatuses. For example, while a background image forming apparatus is performing a backward rotation of a long paper sheet, a recent image forming apparatus feeds a next paper sheet before the trailing edge of the long paper sheet reaches a reference position. This operation cannot successfully overlay the paper sheets to smoothly convey the paper sheets. Therefore, the intervals of paper sheets have to be increased, which can result in poor productivity of the image forming apparatus.

Further, the background sheet conveying devices of the second and third examples have not reduced the interval of sheets.

SUMMARY

One of more embodiments of the present invention has been made in view of the above-mentioned circumstances.

At least one embodiment of the present invention provides a sheet conveying device that can reduce (if not completely prevent) intervals of sheets when handling a paper sheet having a long length in a sheet conveying direction, and can perform with an enhancement in operation speed of an image forming apparatus.

At least one embodiment of the present invention provides a method of conveying paper sheets in the sheet conveying device.

An embodiment of the present invention provides a first conveying path configured to pass a sheet of a recording medium (RM) therethrough to a sheet processing device, a second conveying path branched from the first conveying path and configured to temporarily store the RM sheet conveyed therein, a sheet conveying mechanism configured to selectably convey the RM sheet in one of forward and backward directions to the sheet processing device, a guide member mounted at a branch point of the first and second conveying paths and configured to guide the RM sheet when the RM sheet is conveyed in the backward direction by the sheet conveying mechanism to the second conveying path, and a control unit configured to control the sheet conveying mechanism to change a distance between the branch point and the sheet conveying mechanism according to a length of the RM sheet in a forward sheet conveying direction.

There can be plural instances of the RM sheet including a first RM sheet temporarily stored in the second conveying path and a second RM sheet piggybackable and conveyable with the first RM sheet.

An embodiment of the present invention provides method of conveying sheets of a recording medium (RM) in a sheet conveying device that includes the steps of receiving a first RM sheet from an image forming apparatus, determining a distance between a branch point of first and second conveying paths and a sheet conveying mechanism according to a length of the first RM sheet in a sheet conveying direction, conveying the first RM sheet in a forward direction and then in a backward direction, storing the first RM sheet in a prestack path, conveying a second RM sheet in the forward direction, and merging the first and second RM sheets.

Additional features and advantages of the present invention will be more fully apparent from the following detailed description of example embodiments, the accompanying drawings and the associated claims.

BRIEF DESCRIPTION OF THE DRAWINGS

The accompanying drawings are intended to depict example embodiments of the present invention and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
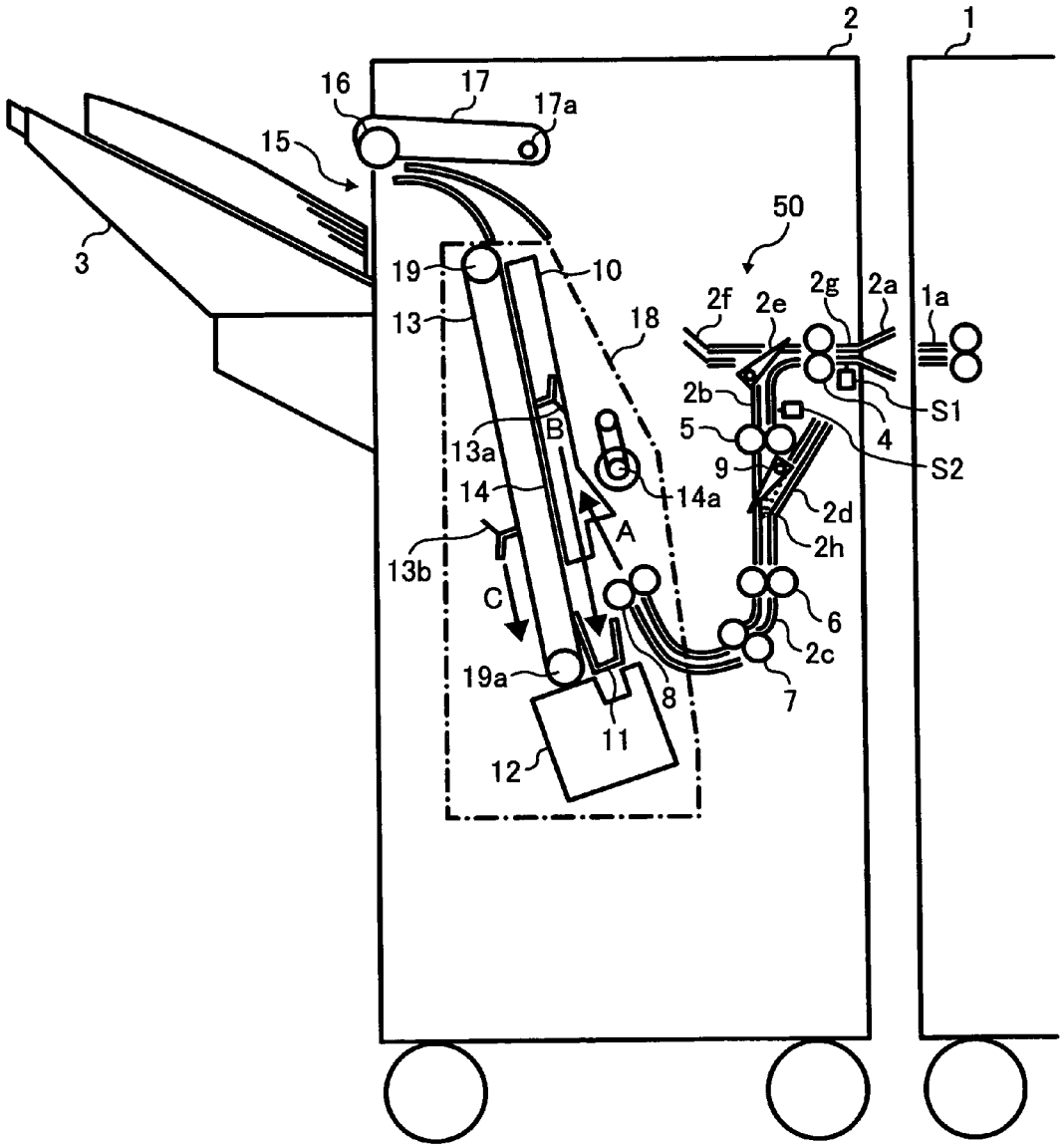
FIG. 1 is a schematic structure of an image forming apparatus and a sheet finishing apparatus including a sheet conveying device according to an example embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular example embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

It is important to note that, in the example embodiments hereinafter described, a first conveying path corresponds to first and second lower sheet conveying paths 2*b* and 2*c*. A second conveying path corresponds to a prestack path 2*d*. A sheet conveying mechanism corresponds to second and third pairs of conveying rollers 6 and 7. A guide member corresponds to a path selector 9. A branch point corresponds to a branch point 2*h*. A control unit that controls a distance between the branch point and the sheet conveying mechanism and/or a position to stop a leading edge of a sheet of a recording medium (e.g., paper) corresponds to second and third pairs of conveying rollers 6 and 7, and a CPU 32. A contact and separation mechanism that switches first and second states corresponds to a motor 27, a belt 28, a pulley 26, a pin 26*a*, movable portion (long hole) 25*a*, and a lever 25.

It is also important to note that respective rotations of a pair of inlet rollers 4, and first, second, and third pairs of conveying rollers 5, 6, and 7 in a direction forward or to a sheet processing mechanism 18 are hereinafter referred to as a "forward rotation", and respective rotations of the above-described rollers in a direction backward or opposite to the sheet processing mechanism 18 are hereinafter referred to as a "backward rotation." Further, the direction forward the sheet processing mechanism 18 is hereinafter referred to as a "forward direction", and the direction backward or opposite to the sheet processing mechanism 18 is hereinafter referred to as a "backward direction."

Referring now to the drawings, wherein like reference numerals designate identical or corresponding parts throughout the several views, example embodiments of the present patent application are described.

Referring to FIG. 1 of the drawings, an image forming system according to at least one example embodiment of the present patent application.

As shown in FIG. 1, the image forming system is generally made up of an image forming apparatus 1 and a sheet finishing apparatus (a sheet processing apparatus) 2 operably connected to one side of the image forming apparatus 1.

The image forming apparatus 1 forms an image on a sheet serving as a sheet-like recording medium, e.g., paper (hereafter, paper sheet). The paper sheet driven out of the image forming apparatus 1 is introduced in the sheet finishing apparatus 2. The sheet finishing apparatus 2 performs sheet finishing processes, for example, jogging, binding, stacking, and the like with respect to the paper sheet discharged from the image forming apparatus 1.

The image forming apparatus 1 includes a copier, a printer, a facsimile machine, or a multi-functional machine having at least two functions of a copier, a printer, and a facsimile machine, etc. Such image forming apparatuses having these functions are widely known, and therefore, the details of the functions are omitted here.

Further, the functions performing jogging, binding, punching, folding, and so forth incorporated in the sheet finishing apparatus 2 are also well known. These functions are utilized according to the specification of the sheet finishing apparatus 2.

The sheet finishing apparatus 2 includes a sheet conveying device 50, a sheet processing mechanism 18, an outlet roller 16, an outlet 15, and an outlet tray 3.

The sheet conveying device 50 includes an inlet 2*a*, first and second lower sheet conveying paths 2*b* and 2*c*, a prestack path 2*d*, and an upper sheet conveying path 2*f*.

The inlet 2*a* is an opening to receive a paper sheet driven out through an outlet 1*a* of the image forming apparatus 1. The inlet 2*a* is followed by a sheet conveying path 2*g* that includes an inlet sensor S1 and a pair of inlet rollers 4.

The sheet conveying path 2*g* is located at a downstream side of the pair of inlet rollers 4, and is separated at a branch point 2*h* to the first and second lower sheet conveying paths 2*b* and 2*c* and the upper sheet conveying path 2*f*.

The first and second lower sheet conveying paths 2*b* and 2*c* pass a paper sheet therethrough to the sheet processing mechanism 18. The first lower sheet conveying path 2*b* is located at an upstream side of the branch point 2*h*. The second lower sheet conveying path 2*c* is located at a downstream side of the branch point 2*h*. The branch point 2*h* includes a path selector 9.

The upper sheet conveying path 2*f*, details of which are not shown, passes a paper sheet therethrough to the outlet 15. A branch point (not shown) of the upper sheet conveying path 2*f* and the first lower sheet conveying path 2*b* includes a path selector 2*e*. The path selector 2*e* is driven by a stepping motor (not shown) to switch a conveying path of a paper sheet.

The first lower sheet conveying path 2*b* includes a sheet detection sensor S2 and a first pair of conveying rollers 5.

The sheet detection sensor S2 is disposed at an upstream side of a sheet conveying direction of the first lower sheet conveying path 2*b* to detect a paper sheet in the lower sheet conveying path 2*b*.

The prestack path 2*d* is located at a lower end of the first lower sheet conveying path 2*b*. The prestack path 2*d* is arranged to be branched off or separated from the first lower sheet conveying path 2*b* with an appropriate angle to receive and temporarily store a paper sheet conveyed therein in a backward direction of a sheet conveying direction. The path selector 9 serving as a guide member is mounted at the branch point 2*h* to guide a paper sheet when the paper sheet is backwardly conveyed into the prestack path 2*d*.

The second lower sheet conveying path 2*c* runs from the branch point 2*h* to the sheet processing mechanism 18. The second lower sheet conveying path 2*c* includes second and third pairs of conveying rollers 6 and 7, and a pair of tray outlet rollers 8. The second and third pairs of conveying rollers 6 and 7 can be rotated in forward and backward directions of the sheet processing mechanism 18 so as to convey a paper sheet in one of forward and backward directions to the sheet processing mechanism 18. The pair of tray outlet rollers 8 is located at the most downstream side of the second lower sheet conveying path 2*c*.

The sheet processing mechanism 18 is made up of a discharging mechanism including jogger fences 10, a rear end fence 11, a stapler 12, a discharge belt 13, a pair of hooks 13*a* and 13*b*, a staple tray 14, and a knock roller 14*a*.

The staple tray 14 receives discharged paper sheets.

The jogger fences 10 align or position the paper sheets by jogging the paper sheets in a horizontal direction perpendicular to a sheet conveying direction (sometimes referred to as a direction of sheet width) of the paper sheet loaded to the staple tray 14.

The rear end fence 11 aligns or positions the paper sheets in a same direction as the sheet conveying direction.

The knock roller 14*a* knocks the paper sheets for positioning the paper sheets toward the rear end fence 11 in the vertical direction to the sheet conveying direction.

The stapler 12 staples a stack of sheets jogged on the staple tray 14.

The discharge belt 3 and the pair of hooks 13*a* and 13*b* are used to discharge the stack of sheets stapled by the stapler 12. The discharge belt 3 is spanned around or surrounded by a discharge roller 19 and a driven roller 19*a* to discharge the stack of sheets with one of the pair of hooks 13*a* and 13*b* via the outlet 15 to the outlet tray 3. More specifically, in the vicinity of the outlet roller 16, an outlet lever 17, and a spindle 17*a* are disposed. The output roller 16 is disposed at a free side of the output lever 17 pivotably supported by the spindle 17*a*.

The stack of sheets is driven out to the output tray 3 while pressing up the outlet roller 16. This movement causes the output roller 16 to exert a pressing force onto the stack of sheets so that the stack of sheets can be steadily conveyed to the output tray 3.

Figures 2, 2A:
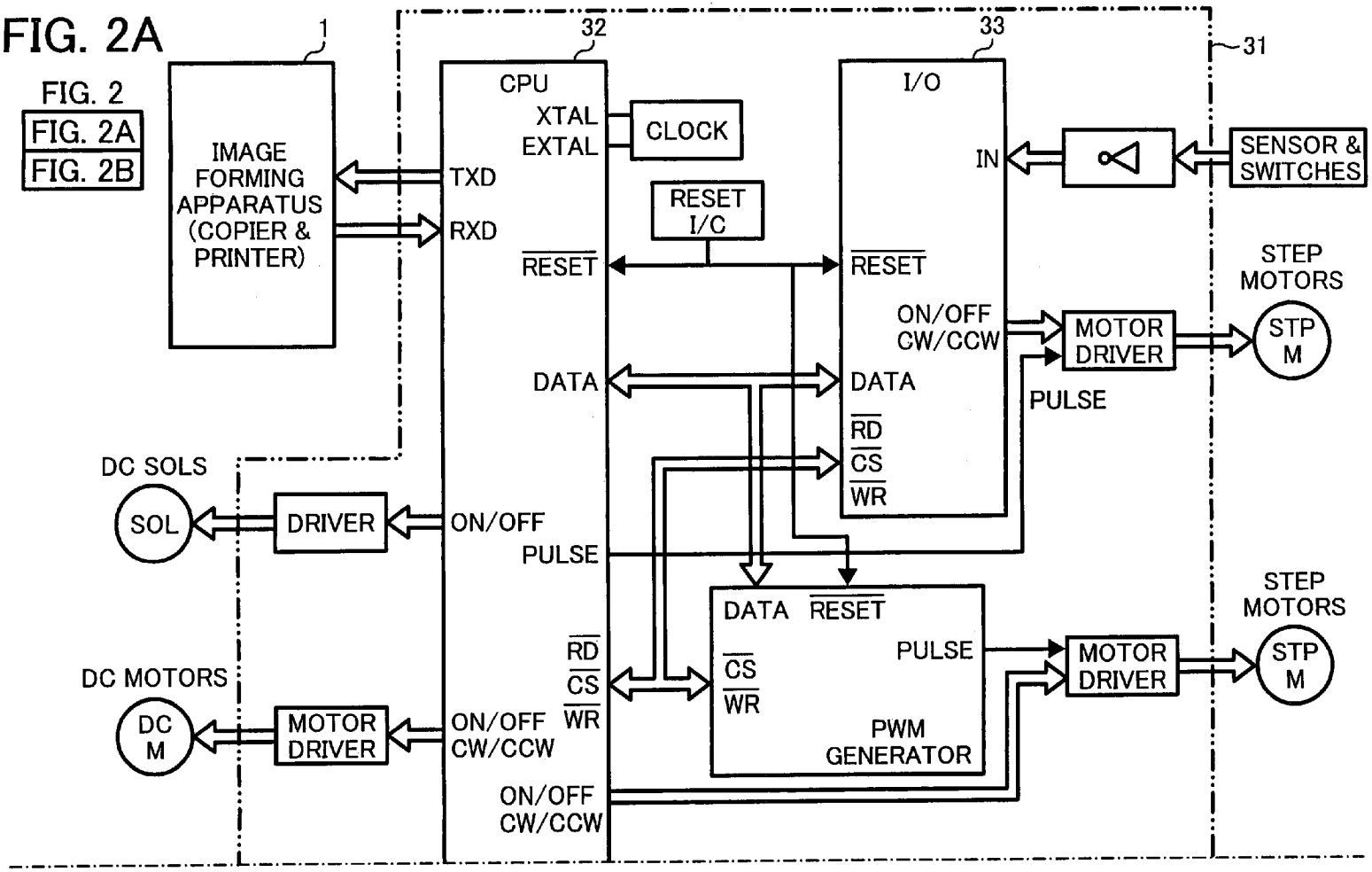
FIGS. 2A and 2B are block diagrams of a control system structure of an image forming system of the sheet conveying device according to an example embodiment of the present invention.
Figure 2B:
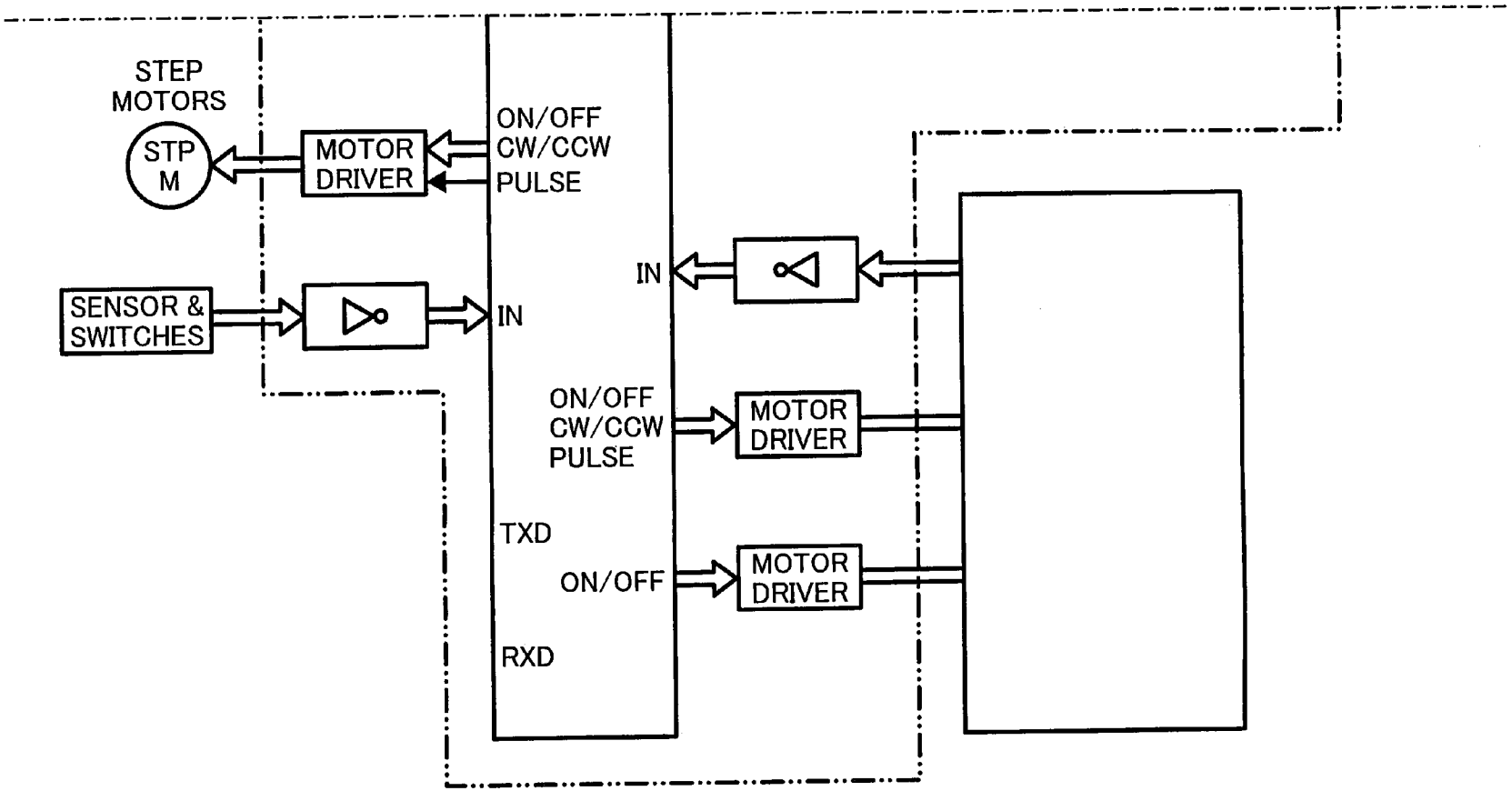

FIGS. 2A and 2B are block diagrams of a control system structure of an image forming system according to the at least one example embodiments of the present invention.

As shown in FIGS. 2A and 2B, the control system includes a control unit 31 implemented as a microcomputer including a CPU (Central Processing Unit) 32, and I/O (Input/Output) interface 33. The outputs of various switches arranged on a control panel, not shown, mounted on the image forming apparatus 1 are input to the control unit 32 via the I/O interface 33. Also, the inputs to the control unit 31 via the I/O interface 33 are the output of the inlet sensor S1 (shown in FIG. 1) and the sheet detection sensor S2 (shown in FIG. 1), and so forth.

The CPU 32 serving as a controller controls the drive of motors and solenoids based on the above-described various signals. For example, the motors of the sheet conveying device 50 of the present example embodiment include a stapler drive motor (not shown) and a stapler moving motor (not shown). The CPU 32 controls the stapler drive motor and the stapler moving motor to cause the stapler 12 to staple a stack of sheets at an appropriate position or appropriate positions thereof.

Further, the CPU 32 controls the sheet conveying device 50 in accordance with a program stored in a ROM (Read Only Memory), not shown, by using a RAM (Random Access Memory), not shown, as a work area. Data used for the controls and processing is stored in the RAM and an EPROM (Electrically Programmable Read Only Memory), not shown.

Specific operations to be executed by the CPU 32 in various modes available with the illustrative example embodiment will be described hereinafter.

When one paper sheet of a job is conveyed, the control unit 31 performs the following operations.

A paper sheet is output through the image forming apparatus 1 through the outlet 1*a*, and is conveyed to the sheet conveying device 50 of the sheet finishing apparatus 2 through the inlet 2*a*. When the paper sheet is conveyed to the sheet conveying device 50, the inlet sensor S1 detects the paper sheet. The paper sheet then passes through the sheet conveying path 2*g* by a rotation of the pair of inlet rollers 4.

The CPU 32 of the controller 31 controls the path selector 2*e* based on instructions issued from a CPU (not shown) of the image forming apparatus 1 such that the path selector 2*e* selects one of two directions to which the paper sheet can be conveyed.

When the paper sheet is conveyed to the sheet processing mechanism 18, the path selector 2*e* is angularly moved in a counterclockwise direction, as shown in FIG. 1, so that the paper sheet can be conveyed to the first lower sheet conveying path 2*b*. When both of the pair of inlet rollers 4 and the first pair of conveying rollers 5 rotate in the forward direction to convey the paper sheet toward the sheet processing mechanism 18, a force of conveying the paper sheet is exerted to the paper sheet. The force can cause the paper sheet conveyed in the first lower sheet conveying path 2*b* to push the path selector 9 to pivotably move or rotate in a counterclockwise direction in the example depicted in FIG. 1, so that the paper sheet can obtain a sufficient room to pass through to the second lower sheet conveying path 2*c*. The path selector 9 is supported or biased by an elastic member. The paper sheet is continuously conveyed via the second and third pairs of conveying rollers 6 and 7, and is driven out via the pair of outlet rollers 8 to the staple tray 14 of the sheet processing mechanism 18, in a direction indicated by arrow A in FIG. 1.

After the paper sheet passes through a nip formed between the pair of outlet rollers 8 to the staple tray 14, the paper sheet falls due to its own weight toward the rear end fence 11, in a direction indicated by arrow B in FIG. 1. Every time a paper sheet is conveyed and laid on the staple tray 14, the knock roller 14*a* knocks the paper sheet to thereby position a trailing edge of the paper sheet in the vertical direction or sheet conveying direction at the rear end fence. The sheet detection sensor S2 previously detects the trailing edge of the paper sheet. Subsequently after the paper sheet in the sheet conveying direction is positioned, the jogger fences 10 position the paper sheet in the horizontal direction or a direction perpendicular to the sheet conveying direction. The above-described operation is repeatedly performed so that a plurality of paper sheets can be positioned one by one.

When two of more paper sheets are conveyed in the sheet conveying device 50, the control unit 31 performs the following operations.

It is important to be noted that two paper sheets are conveyed in this example. One of the paper sheets to be firstly conveyed is hereinafter referred to as a "first paper sheet P1", and the other of the paper sheets to be secondary conveyed is hereinafter referred to as a "second paper sheet P2."

The first and second paper sheets P1 and P2 are output one by one from the image forming apparatus 1 at constant intervals of sheets in timing. The intervals of jobs including a job with the first and second paper sheets P1 and P2 are also constant. When the first paper sheet P1 is output from the image forming apparatus 1, the image forming apparatus 1 sends signals informing the size, number of sheets, sheet conveying speed or linear velocity, processing mode, and so forth of the first paper sheet P1 to the sheet finishing apparatus 2. By receiving the signals from the image forming apparatus 1, the CPU 32 of the sheet finishing apparatus 2 determines the number of sheets to be stacked, rotation speed increasing point, amount of increasing linear velocity, direction reversing point, sheet stopping point for stacking, and so forth.

EXAMPLE 1

Conveying paper sheets having the length in the sheet conveying direction equal to or greater than the length of a B5 landscape paper size (182 mm) and less than the length of a B5 portrait paper size (257 mm):

When the paper sheets have a length in the sheet conveying direction equal to or greater than the length of a B5 landscape paper size (182 mm) and less than the length of a B5 portrait paper size (257 mm), the operations of conveying the paper sheets will be performed as follows, in reference to FIGS. 3A, 3B, 3C, and 3D.

Figure 3A:
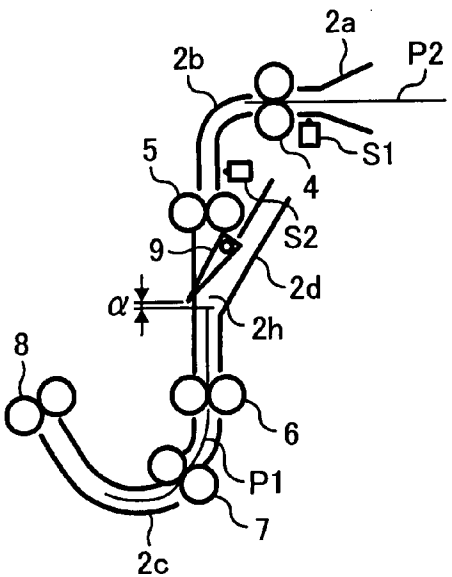
FIGS. 3A through 3D are simplified cross sectional views of the sheet conveying device of FIG. 1, showing sheet conveying operations, according to an example embodiment of the present invention.

As shown in FIG. 3A, when a leading edge of the first paper sheet P1 of a job is driven out of the image forming apparatus 1, the pair of inlet rollers 4 and the first pair of conveying rollers 5 of the sheet conveying device 50 of the sheet finishing apparatus 2 rotate in the forward direction to convey the first paper sheet P1 to the first and second lower sheet conveying paths 2*b* and 2*c*. A trailing edge of the first paper sheet P1 passes the path selector 9, and reaches a position that is located away from the branch point 2*h* by a distance "α", as shown in FIG. 3A. The distance "α" substantially corresponds a distance from a leading edge of the path selector 9 to a starting end portion of the second lower sheet conveying path 2*c*. At this time, in a case in which the image forming apparatus 1 sends the sheet finishing apparatus 2 a signal to move the first paper sheet P1 to the backward direction, the second and third pairs of conveying rollers 6 and 7 stop, and thereafter start the backward rotation. As the first paper sheet P1 is conveyed in the backward direction, the path selector 9 leads the first paper sheet P1 to the prestack path 2*d* so that the first paper sheet P1 can be temporarily stored therein.

As previously described, the path selector 9 is biased by an elastic member. More specifically, the path selector 9 is constantly biased so that a paper sheet can be conveyed in the prestack path 2*d* when the paper sheet is conveyed in the backward direction. At the same time, since the path selector 9 is biased constantly at a relatively low pressure force, the path selector 9 can rotatably be moved or pushed by the paper sheet to pass through to the second lower sheet conveying path 2*c*.

Figure 3B:
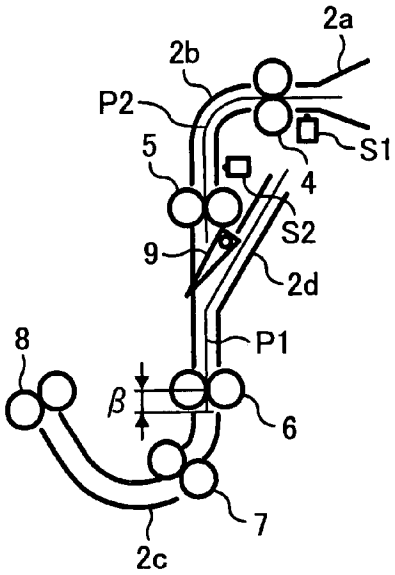

The first paper sheet P1 is conveyed to the prestack path 2*d* by a specific distance. The sheet detection sensor S2 is disposed at an immediately upstream side of the first pair of conveying rollers 5 in the sheet conveying direction. The specific distance of the rear end portion of the paper sheet P1 to be conveyed and stored in the prestack path 2*d* is measured by pulse counters and/or timers from the sheet detection sensor S2. A control timing is obtained based on the number of pulse counts and a duration of times so that the first paper sheet P1 can be constantly stopped at a same position as other paper sheets where the trailing edge, or the leading edge in the backward direction, of the first paper sheet P1 comes. As shown in FIG. 3B, the first paper sheet P1 is stopped while being held at a nip formed between the second pair of conveying rollers 6 with the leading edge in the forward direction thereof extending to the downstream side of the second pair of conveying rollers 6 from the nip thereof by approximately 5 mm. The distance extending from the nip is referred to as a "distance β."

To reduce the amount of the distance β as much as possible, the sheet detection sensor S2 is disposed at a position as close as possible to a point at which a paper sheet is conveyed in the reverse or backward direction. Thereby, errors caused while conveying paper sheets may be reduced and, a paper sheet may be stopped with high accuracy. If the paper sheet can be stopped at an accurate position, the amount of the distance β can be reduced to the utmost limit. Thus, a misregistration of paper sheets can be reduced when the paper sheets are overlaid one after another in the sheet conveying device 50, and accuracy in positioning on the staple tray 14 can be increased.

Figure 3C:
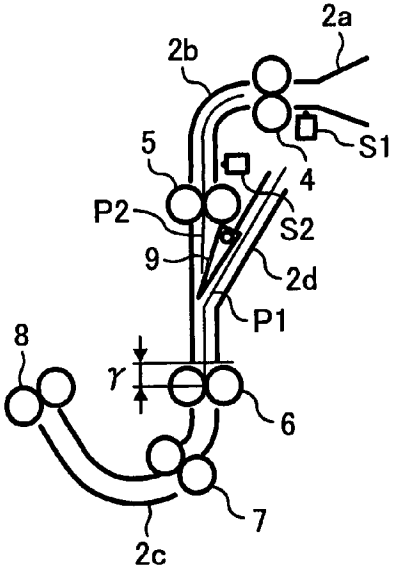

Next, as shown in FIG. 3C, the second paper sheet P2 is sequentially conveyed by rotating the first pair of conveying rollers 5 in the forward direction. After receiving information detected by the sheet detection sensor S2, the sheet conveying device 50 accepts the second paper sheet P2. When a leading edge of the second paper sheet P2 is conveyed by a given distance "γ", approximately 20 mm in this example embodiment, at an upstream side of the second pair of conveying rollers 6, the second and third pairs of conveying rollers 6 and 7 start to perform the forward rotation so that the first paper sheet P1 temporarily stored in the prestack path 2*d* and the paper sheet P2 in the second lower sheet conveying path 2*c* can be piggybacked and conveyed together toward the staple tray 14. By being described as piggybacked, it is to be understood that two or more paper sheets are disposed in close proximity and moved together substantially as one unit.

Figure 3D:
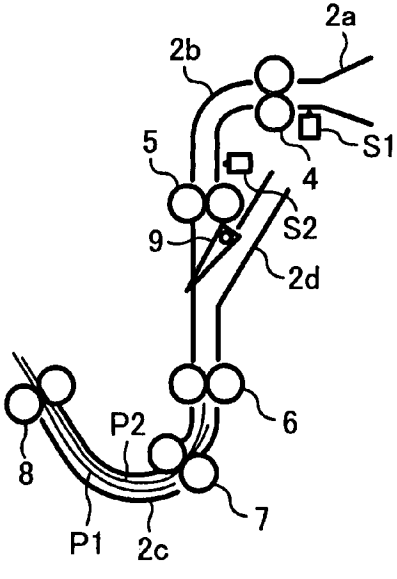

As shown in FIG. 3D, the preceding paper sheet of the job, which is the first paper sheet P1 in FIGS. 3A through 3D, is conveyed in the forward direction while being held in contact with a nip formed between the third pair of conveying rollers 7. Thereby, the stack of sheets including the first and second paper sheets P1 and P2 is discharged at one time while the leading edge of the preceding paper sheet of the job or the leading edge of the first paper sheet P1 comes in advance of the leading edge of the following paper sheet of the job or the second paper sheet P2. That is, the leading edge of the first paper sheet P1 comes before the leading edge of the second paper sheet P2 by a specific amount. The discharged stack of sheets is then conveyed to the staple tray 14.

When the stack of sheets is discharged to the staple tray 14, the discharge belt 13 positions the stack of sheets. The discharge belt 13 is mounted on a center portion along a longitudinal direction of the staple tray 14, parallel with the sheet conveying direction. As previously described, the discharge belt 13 is spanned around the discharge roller 19 and the driven roller 19*a* in a form of an endless belt. The discharge belt 13 has a pair of hooks 13*a* and 13*b*, which are mounted on an outer surface of the discharge belt 13 and arranged to face each other in a circumference of the endless belt 13. When the discharge belt 13 is rotated, the pair of hooks 13*a* and 13*b* move in a direction indicated by arrow C in the example depicted in FIG. 1 so that one of the pair of hooks 13*a* and 13*b* pushes or knocks the protruding leading edge of the first and second paper sheets P1 and P2 all together to the rear end fence 11. Thus, the stack of sheets is positioned in the sheet conveying direction, which results in an appropriate sheet finishing processing without degrading its productivity and stapling or binding quality.

These are the operations of the sheet conveying device 50 of the sheet finishing apparatus 2 to convey two sheets of paper. When three or more paper sheets are temporarily stored in the sheet conveying device 50 so that a sufficient processing of paper sheets of a previous job in the staple tray 14 can be promoted by keeping paper sheets of a following job in the sheet conveying device 50, the above-described operations are repeated so that an appropriate sheet finishing processing operation can be performed without degrading a CPM (copy per minute) of the image forming apparatus 1.

In the sheet conveying operations shown in FIGS. 3A through 3D, the first paper sheet P1 temporarily stored in the prestack path 2*d* is output by being conveyed in the forward direction again at a timing in which the leading edge of the second paper sheet P2 reaches, for example, approximately 20 mm upstream of the nip of the second pair of conveying rollers 6. However, the timing to output the first paper sheet P1 from the prestack path 2*d* is not limited to the above-described timing. As an alternative, the present invention can be applied to any timing that can meet the condition in which the leading edge of a N+1 th paper sheet Pn+1 does not reach the nip of the second pair of conveying rollers 6 while the second pair of conveying rollers 6 are speeding up. The position in which the leading edge of the N+1 th paper sheet Pn+1 stops can be as close as the nip of the second pair of conveying rollers 6, for example, 5 mm upstream of the second pair of conveying rollers 6.

The leading edge of the N+1 th paper sheet Pn+1 may hit the second pair of conveying rollers 6 when conveyed if the position in which the leading edge of the N+1 th paper sheet Pn+1 stops is too close to the nip of the second pair of conveying rollers 6. However, when no damage is caused to the leading edge and/or no bend is not found on the N+1 th paper sheet Pn+1, the position can be set to be at the exact point of the nip of the second pair of conveying rollers 6 or a position by 0 mm away from the second pair of conveying rollers 6.

Figure 4:
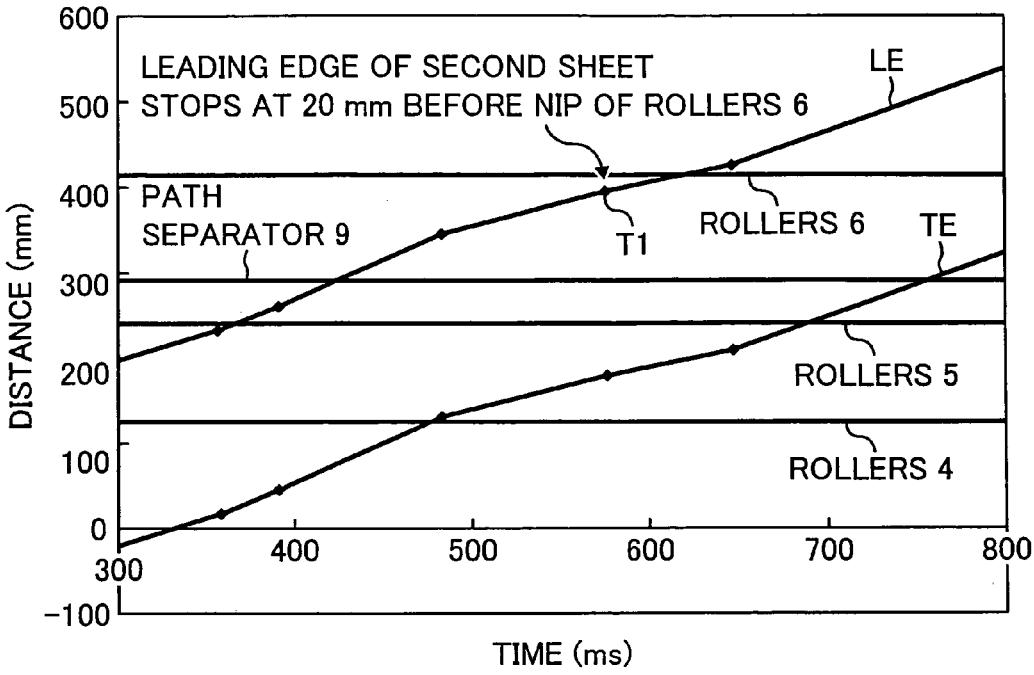
FIG. 4 is a timing chart showing operation timings corresponding to the sheet conveying operations of FIGS. 3A through 3D of the sheet conveying device according to an example embodiment of the present invention.
Figure 5:
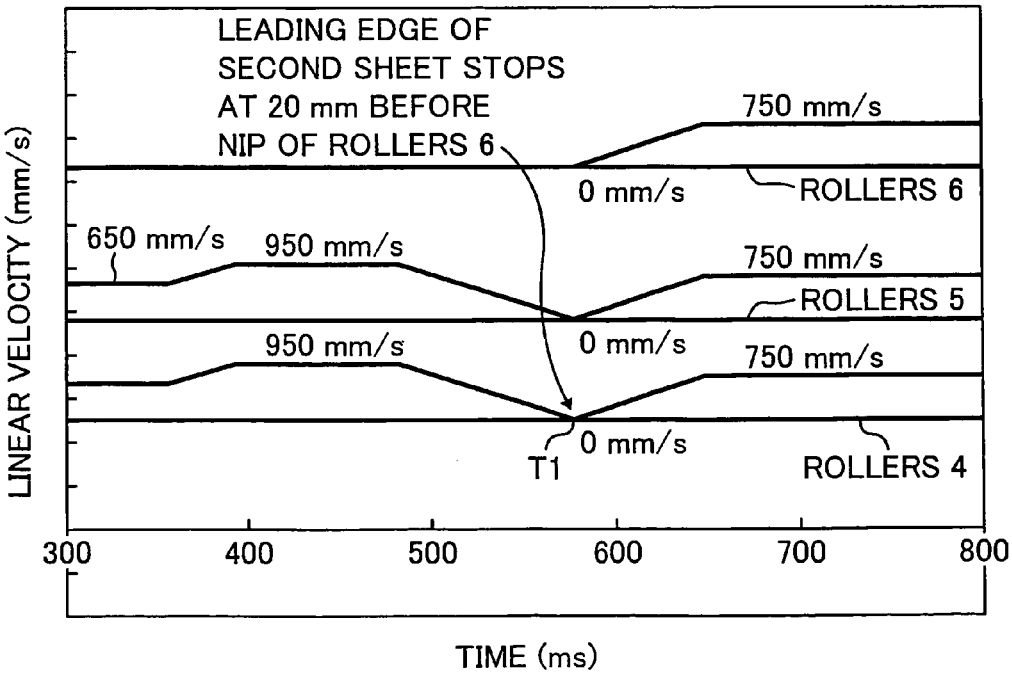
FIG. 5 is a timing chart showing operation timings corresponding to the sheet conveying operations of FIGS. 3A through 3D and the timing chart of FIG. 4 according to an example embodiment of the present invention.

Referring to FIGS. 4 and 5, timing charts of respective operation timings for performing the above-described sheet conveying operations are described.

FIG. 4 is a timing chart showing operation timings of the leading and trailing edges of the second paper sheet P2 in FIGS. 3A through 3D. FIG. 5 is a timing chart showing operation timings of the pair of inlet rollers 4 and the first and second pairs of conveying rollers 5 and 6, corresponding to the timing chart of FIG. 4.

In FIG. 4, "LE" represents the leading edge of the second paper sheet P2, and "TE" represents the trailing edge of the second paper sheet P2. The vertical axis in FIG. 4 indicates a position in a unit of "mm", which is a distance from the inlet 2*a* of the sheet conveying apparatus 50, and the horizontal axis in FIG. 4 indicates a time in a unit of "ms", which is a length of time that has elapsed since the leading edge of the second paper sheet P2 passed the inlet sensor S1.

In the sheet conveying operations shown in FIGS. 3A through 3D, the second paper sheet P2 stops once at a timing position T1 that is located approximately 20 mm upstream of the nip of the second pair of conveying rollers 6 in the sheet conveying direction, which is a position approximately 600 mm to approximately 20 mm away from the inlet 2*a*. The timing position T1 is equal to the position of the second paper sheet P2 in FIG. 3C. As shown in FIG. 4, the pair of inlet rollers 4 and the first pair of conveying rollers 5 accelerate the respective speeds of rotations, from approximately 650 mm/s to approximately 950 mm/s, immediately before the stop timing position T1 so as to reduce a time loss when the pair of inlet rollers 4 and the first pair of conveying rollers 5 are stopped. When the first paper sheet P1 is conveyed together with the second paper sheet P2 in the forward direction, the pair of inlet rollers 4 and the first pair of conveying rollers 5 are driven again by a driver (not shown), the second pair of conveying rollers 6 is driven by a driver (not shown) to rotate, so that the second paper sheet P2 overlaid on the first paper sheet P1 can be conveyed to the staple tray 14.

Respective speeds of the driver for the pair of inlet rollers 4 and the first pair of conveying rollers 5 and the driver for the second pair of conveying rollers 6 for conveying the first and second paper sheets P1 and P2 are approximately 750 mm/s. Since the pair of inlet rollers 4 and the first pair of conveying rollers 5 are driven by the identical drive source, these rollers 4 and 5 can be driven at a constant timing and constant speed of conveyance. Further, since the first and second paper sheets P1 and P2 are conveyed without being bent, a relative positional relationship of the leading edge LE and the trailing edge TE of the second paper sheet P2 can be kept in a constant state.

Figure 6:
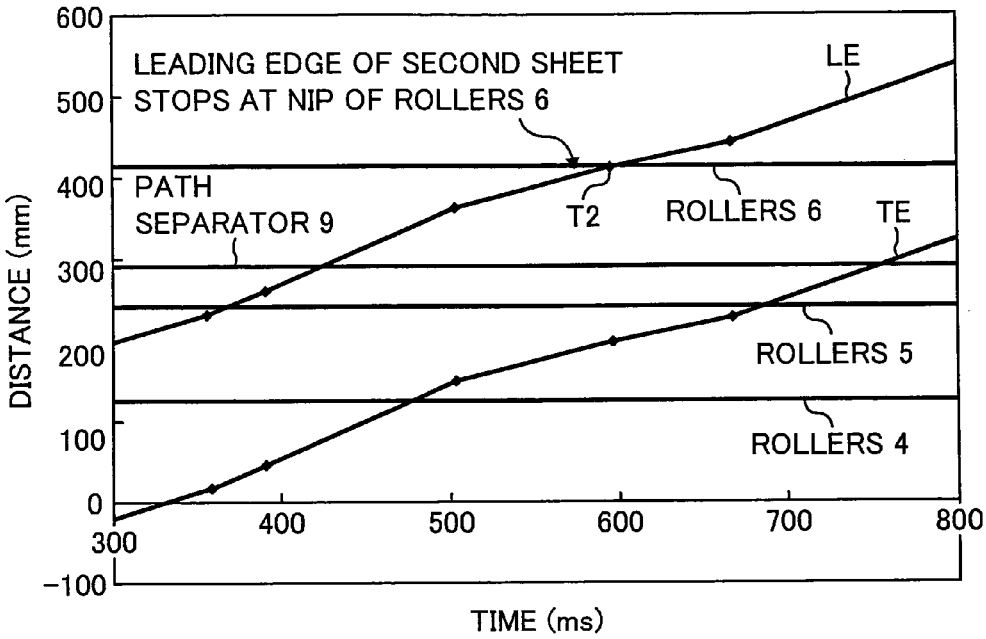
FIG. 6 is a timing chart showing different operation timings corresponding to the sheet conveying operations of FIGS. 3A through 3D of the sheet conveying device according to an example embodiment of the present invention.
Figure 7:
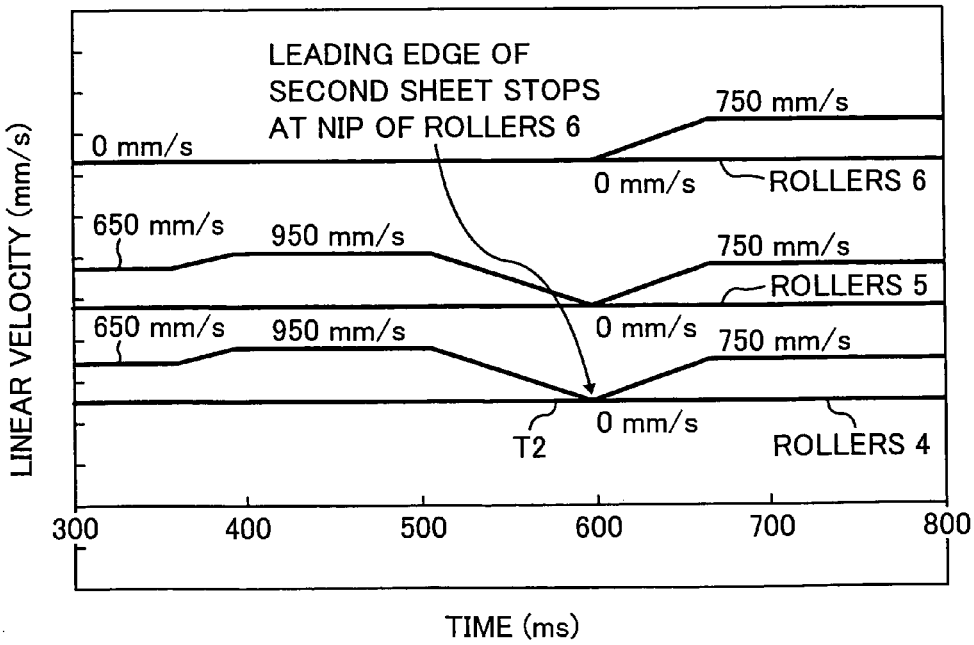
FIG. 7 is a timing chart showing different operation timings corresponding to the sheet conveying operations of FIGS. 3A through 3D and the timing chart of FIG. 6 according to an example embodiment of the present invention.

Referring to FIGS. 6 and 7, timing charts for respective operation timings are described.

FIG. 6 is a timing chart showing operation timings of the leading and trailing edges of the second paper sheet P2 when the leading edge of the second paper sheet P2 is stopped at the nip of the second pair of conveying rollers 6, and is conveyed to the staple tray 14 together with the first paper sheet P1. FIG. 7 is a timing chart showing operation timings of the pair of inlet rollers 4 and the first and second pairs of conveying rollers 5 and 6, corresponding to the timing chart of FIG. 6.

Parameters in FIGS. 6 and 7 are identical to the parameters in FIGS. 4 and 5. As shown in FIG. 6, when the leading edge LE of the second paper sheet P2 reaches the nip of the second pair of conveying rollers 6, the second paper sheet P2 is stopped at a position T2. The second pair of conveying rollers 6 is started to convey the second paper sheet P2 when the second paper sheet P2 is stopped. At the same moment, the pair of inlet rollers 4 and the first pair of conveying rollers 5 that accelerated the respective speeds of rotations and stopped the rotations as described above with reference to FIGS. 4 and 5 are resumed to convey the second paper sheet P2 in the forward direction. Thereby, the second paper sheet P2 can be conveyed to the staple tray 14, with the first paper sheet P1 on which the second paper sheet P2 is overlaid.

Respective speeds of the rollers 4, 5, and 6 for conveying the first and second paper sheets P1 and P2 are similar to those shown in FIGS. 4 and 5, except that the stop position of the second paper sheet P2 is located at a downstream of the nip of the second pair of conveying rollers 6.

Further, the stop position of the second paper sheet P2 in Example 1 of this example embodiment of the sheet conveying device 50 is located at the nip of the second pair of conveying rollers 6. More specifically, the stop position of the second paper sheet P2 is 0 mm away from the nip of the second pair of conveying rollers 6.

EXAMPLE 2

Conveying paper sheets having the length in the sheet conveying direction equal to or greater than the length of a B5 portrait paper size (257 mm):

Referring now to FIGS. 8A through 8D, operations of processing the paper sheets having a length in the sheet conveying direction equal to or greater than the length of a B5 portrait paper size (257 mm) are described.

Figure 8A:
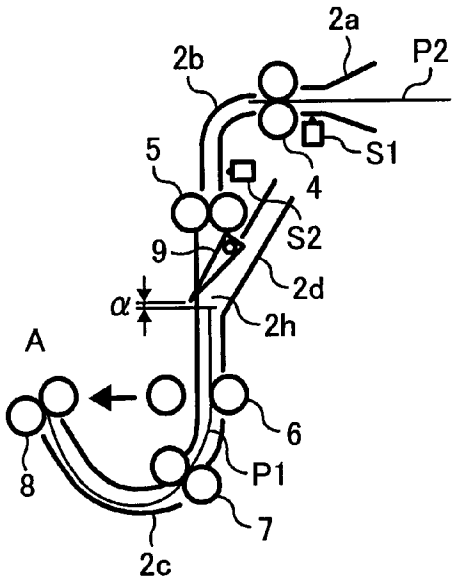
FIGS. 8A through 8D are cross sectional views of the sheet conveying device of FIG. 1, showing different sheet conveying operations, according to an example embodiment of the present invention.

When the paper sheet having a length in the sheet conveying direction equal to or greater than a B5 portrait paper size (257 mm), one of the second pair of conveying rollers 6 is moved in a direction indicated by an arrow in the example depicted in FIG. 8A so that a pressure exerted to the paper sheet to be held in contact with the second pair of conveying rollers 6 may be released before the paper sheet is conveyed toward the second pair of conveying rollers 6. The distance between the first pair of conveying rollers 5 and the third pair of conveying rollers 7 is arranged to be shorter by a specific distance up to approximately 10 mm than the length in the sheet conveying direction of the B5 portrait paper size. Therefore, the release of pressure exerted to the paper sheet in the second pair of conveying rollers 6 does not affect the conveyance of the paper sheet. As an alternative to the second pair of conveying rollers 6, the third pair of conveying rollers 7 is used to convey and temporarily convey paper sheets.

When a paper sheet having a length in the sheet conveying direction equal to or greater than a B5 portrait paper size is conveyed to the sheet conveying device 50 of the sheet finishing apparatus 2, the image forming apparatus 1 sends a signal including information of the above-described paper sheet.

When the sheet conveying device 50 receives the signal, the CPU 32 causes the second pair of conveying rollers 6 to release the pressure exerted to the nip of the second pair of the conveying rollers 6 so that the second pair of conveying rollers 6 will not involve in the following sheet conveying operations. Under the above-described example conditions, the image forming apparatus 1 outputs the first paper sheet P1 of a job to the sheet conveying device 50 of the sheet finishing apparatus 2. A leading edge of the first paper sheet P1 is conveyed by the pair of inlet rollers 4 and the first pair of conveying rollers 5 of the sheet conveying device 50. A trailing edge of the first paper sheet P1 passes the path selector 9, and reaches at a position that is located away from the branch point 2*h* by a distance "a", as shown in FIG. 8A.

The third pair of conveying rollers 7 is rotated and stopped, and thereafter is resumed to rotate in the backward direction. As the first paper sheet P1 is conveyed in the backward direction, the path selector 9 leads the first paper sheet P1 to the prestack path 2*d* so that the first paper sheet P1 can be temporarily stored therein.

Figure 8B:
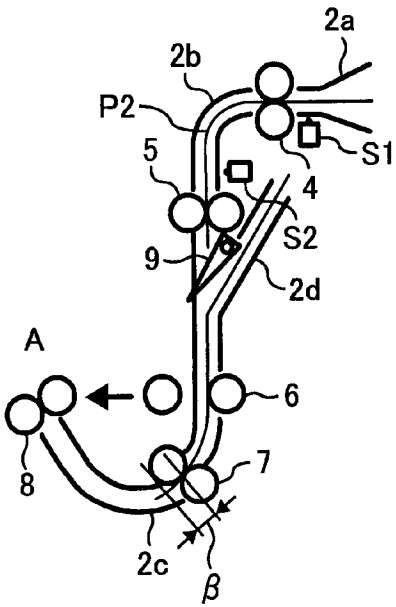

As previously described in Example 1, the specific distance of the rear end portion of the paper sheet P1 to be conveyed and temporarily stored in the prestack path 2*d* is measured by the pulse counters and/or timers from the sheet detection sensor S2 that is disposed at an immediately upstream side of the first pair of conveying rollers 5 in the sheet conveying direction. The control timing is obtained based on the number of pulse counts and a duration of times so that the first paper sheet P1 can be constantly stopped at a same position as other paper sheets where the trailing edge, or the leading edge in the backward direction, of the first paper sheet P1 comes. As shown in FIG. 8B, the first paper sheet P1 is stopped while being held at a nip formed between the third pair of conveying rollers 7 with the leading edge in the forward direction thereof extending to the downstream side of the third pair of conveying rollers 7 from the nip thereof by a distance "β".

Figure 8C:
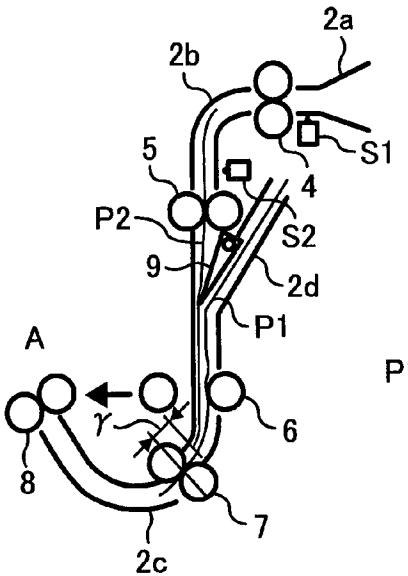

Next, as shown in FIG. 8C, a second paper sheet P2 is sequentially conveyed by rotating the first pair of conveying rollers 5 in the forward direction. After receiving information detected by the sheet detection sensor S2, the sheet conveying device 50 accepts the second paper sheet P2, which is the same operation as in Example 1. When a leading edge of the second paper sheet P2 is conveyed by a given distance "γ", approximately 20 mm in this example, at an upstream side of the third pair of conveying rollers 7, the third pair of conveying rollers 7 starts to perform the forward rotation so that the first paper sheet P1 temporarily stored in the prestack path 2*d* and the second paper sheet P2 in the second lower sheet conveying path 2*c* can be piggybacked and conveyed together toward the staple tray 14.

Figure 8D:
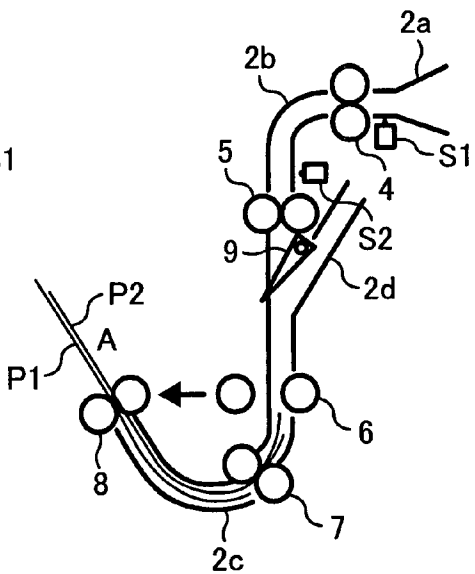

As shown in FIG. 8D, the preceding paper sheet of the job, which is the first paper sheet P1 in FIGS. 8A through 8D, is conveyed in the forward direction while being held in contact with the nip formed between the third pair of conveying rollers 7. Thereby, the stack of sheets including the first and second paper sheets P1 and P2 is discharged at one time while the leading edge of the preceding paper sheet of the job or the leading edge of the first paper sheet P1 comes in advance of the leading edge of the following paper sheet of the job or the second paper sheet P2.

As previously described in Example 1, when the stack of sheets is discharged to the staple tray 14, one of the hooks 13*a* and 13*b* mounted on the discharge belt 13 pushes or knocks the protruding leading edge of the first and second paper sheets P1 and P2 all together to the rear end fence 11. Thus, the stack of sheets is positioned in the sheet conveying direction, which results in an appropriate sheet finishing processing without degrading its productivity and stapling or binding quality.

These are the operations of the sheet conveying device 50 of the sheet finishing apparatus 2 to convey two sheets of paper. When three or more paper sheets are temporarily stored in the sheet conveying device 50 so that a sufficient processing of paper sheets of a previous job in the staple tray 14 can be promoted by keeping paper sheets of a following job in the sheet conveying device 50, the above-described operations are repeated so that an appropriate sheet finishing processing operation can be performed without degrading the CPM of the image forming apparatus 1.

EXAMPLE 3

Drive mechanism of the second and third pairs of sheet conveying rollers and pressure release mechanism of the second pair of conveying rollers:

If a pressure exerted to a paper sheet by the second pair of conveying rollers 6 is not released when the paper sheet having a length equal to or greater than a B5 portrait paper size in the sheet conveying direction is temporarily stored in the prestack path 2*d*, the paper sheet needs to be conveyed in the backward direction and be stopped at a position that is approximately 5 mm upstream of the second pair of conveying rollers 6, as being performed for a paper sheet having a length less than a B5 portrait paper size. More specifically, the longer the length of a paper sheet in the sheet conveying direction becomes, the longer the distance of conveying the paper sheet in the backward direction becomes. For the above-described reason, a next paper sheet cannot be conveyed to the nip formed between the second pair of conveying rollers 6, which cannot contribute to high productivity of the sheet conveying device 50 of the sheet finishing apparatus 2.

Figure 9:
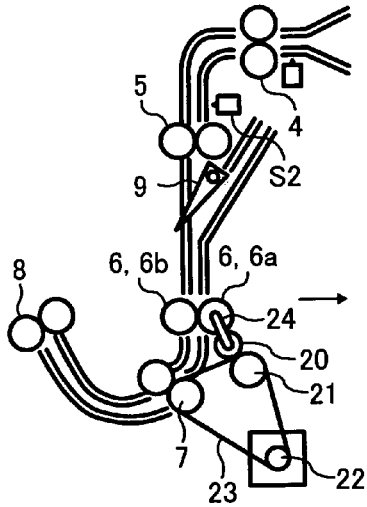
FIG. 9 is a front view of a drive mechanism according to an example embodiment of the present invention and a pressure release mechanism according to an example embodiment of the present invention.
Figure 10:
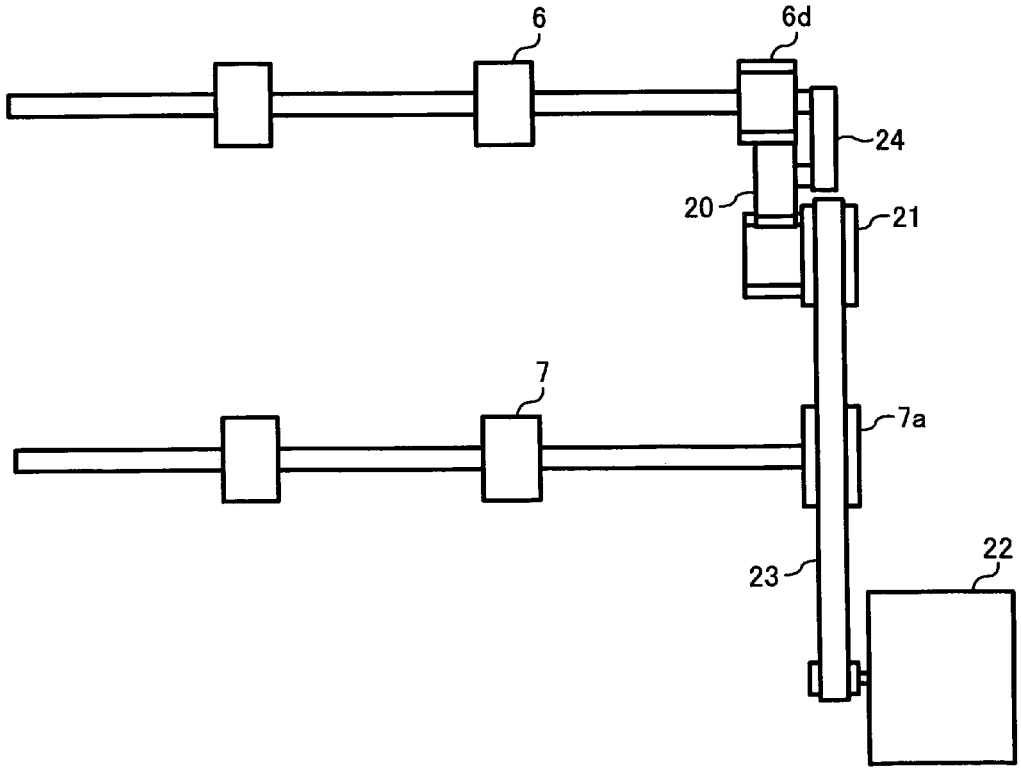
FIG. 10 is a side elevation view of the drive mechanism of FIG. 9 according to an example embodiment of the present invention and the pressure release mechanism of FIG. 9 according to an example embodiment of the present invention.
Figure 11B:
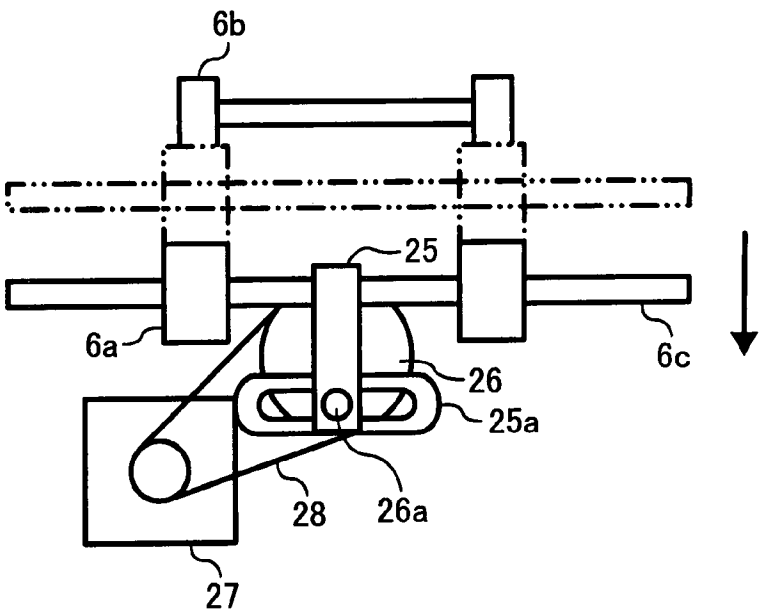
FIGS. 11A and 11B are cross sectional views of the drive mechanism of FIGS. 9 and 10 according to an example embodiment of the present invention and the pressure release mechanism of FIGS. 9 and 10 according to an example embodiment of the present invention.
Figure 11A:
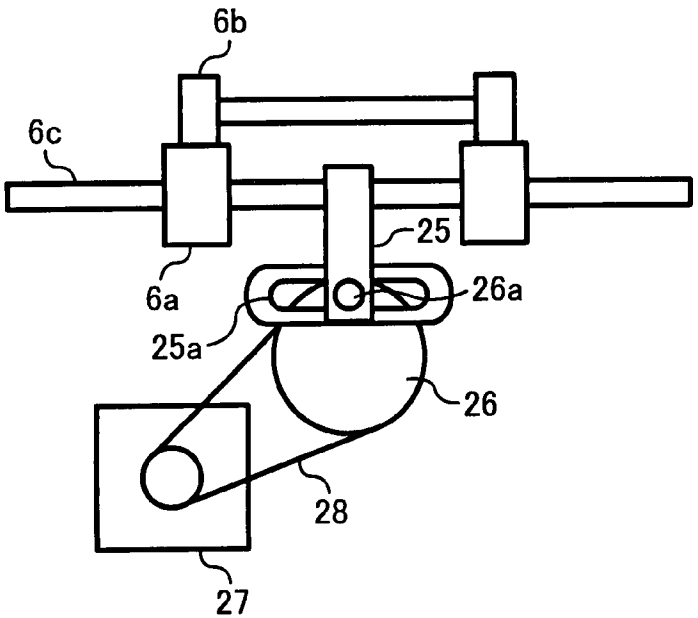

Referring now to FIGS. 9, 10, 11A, and 11B, a drive mechanism of the second and third pairs of conveying rollers 6 and 7 and a pressure release mechanism of the second pair of conveying rollers 6 are described. The drive mechanism and pressure release mechanism are shown in a front view of FIG. 9 and a side elevation view of FIG. 10. FIG. 10 is viewed from the right side of FIG. 9. FIGS. 11A and 11B show operations of the mechanisms.

In Example 2, the pressure of the second pair of conveying rollers 6 is released by detaching one of the rollers. One of the second pair of conveying rollers 6 is a drive roller and the other is a driven roller. Either one of the second pair of conveying rollers 6 can be separated from the other roller. In FIGS. 8A through 8D, a drive roller is a fixed roller located on the right side of the second pair of conveying rollers 6 and a driven roller is a movable roller located on the left side of the second pair of conveying rollers 6. On the other hand, drive and driven rollers of the second pair of conveying rollers 6 in FIG. 9 have opposite functions. In FIG. 9, a drive roller 6*a* can be separated, in a direction indicated by an arrow of FIG. 9, from a driven roller 6*b* as an alternative to the rollers in FIGS. 8A through 8D.

As shown in FIGS. 9 and 10, a motor 22 exerts a drive force to rotate the second pair of conveying rollers 6. The drive force of the motor 22 is transmitted via a belt 23 and a pulley 21 to an idler 20. Also, the motor 22 also drives the third pair of conveying rollers 7 via a pulley 7*a*. The idler 20 and a gear 6*d* are connected by a link 24. When the driven roller 6*b* of the second pair of conveying rollers 6 is moved in the left side direction of FIG. 9, the gear 6*d* is rotated, centering around the idler 20. Since the link 24 is mounted between the idler 20 and the gear 6*d* to connect them, the idler 20 and the gear 6*d* have a constant distance therebetween.

The pressure release mechanism to move the second pair of conveying rollers 6 in the direction as shown in FIG. 9 employs a cam system.

As shown in FIGS. 11A and 11B, the cam system includes a pulley 26, a pin 26*a*, and a lever 25 with a long hole 25*a*. The pin 26*a* is mounted on a side surface of the pulley 26, and is moved along the long hole 25*a* of the lever 25. A motor 27 drives the pulley 26 via a belt 28. The drive roller 6*a* of the second pair of conveying rollers 6 includes a shaft 6*c*. The lever 25 is engaged with the shaft 6*c* of the drive roller 6*a*. In the sheet conveying device 50 of Example 3, when the motor 27 transmits a drive force to the pulley 26, the pulley 26 receives the drive force to rotate the second and third pairs of conveying rollers 6 and 7 in one of the clockwise or counterclockwise directions of FIGS. 11A and 11B. Then, the pin 26*a* slidably is moved along the long hole 25*a* so that the lever 25 can be moved in a vertical direction with respect to the shaft 6*c*.

FIG. 11A shows the second pair of conveying rollers 6 with pressure, and FIG. 11B shows the second pair of conveying rollers 6 when the pressure is released and the drive and driven rollers 6*a* and 6*b* of the second pair of conveying rollers 6 are separated. That is, when the pulley 26 is rotated, the pin 26*a* is rotated around a center of rotation of the pulley 26. The lever 25 is moved in a straight line by a distance corresponding to a diameter of a rotation trajectory of the pin 26*a*, with respect to the driven roller 6*b*. Thus, the drive roller 6*a* is held in contact with or is separated from the driven roller 6*b*. The stroke of the drive roller 6*a*, which corresponds to a distance of the linear motion of the pin 26*a*, is specified according to the width of a conveying path that is equal to a distance in a vertical direction with respect to a surface of a paper sheet.

Thus, when a paper sheet having a length equal to or greater than a B5 portrait paper size in the sheet conveying direction is temporarily stored in the prestack path 2*d*, the second pair of conveying rollers 6 can be ignored and not be used in the operations.

Figure 12:
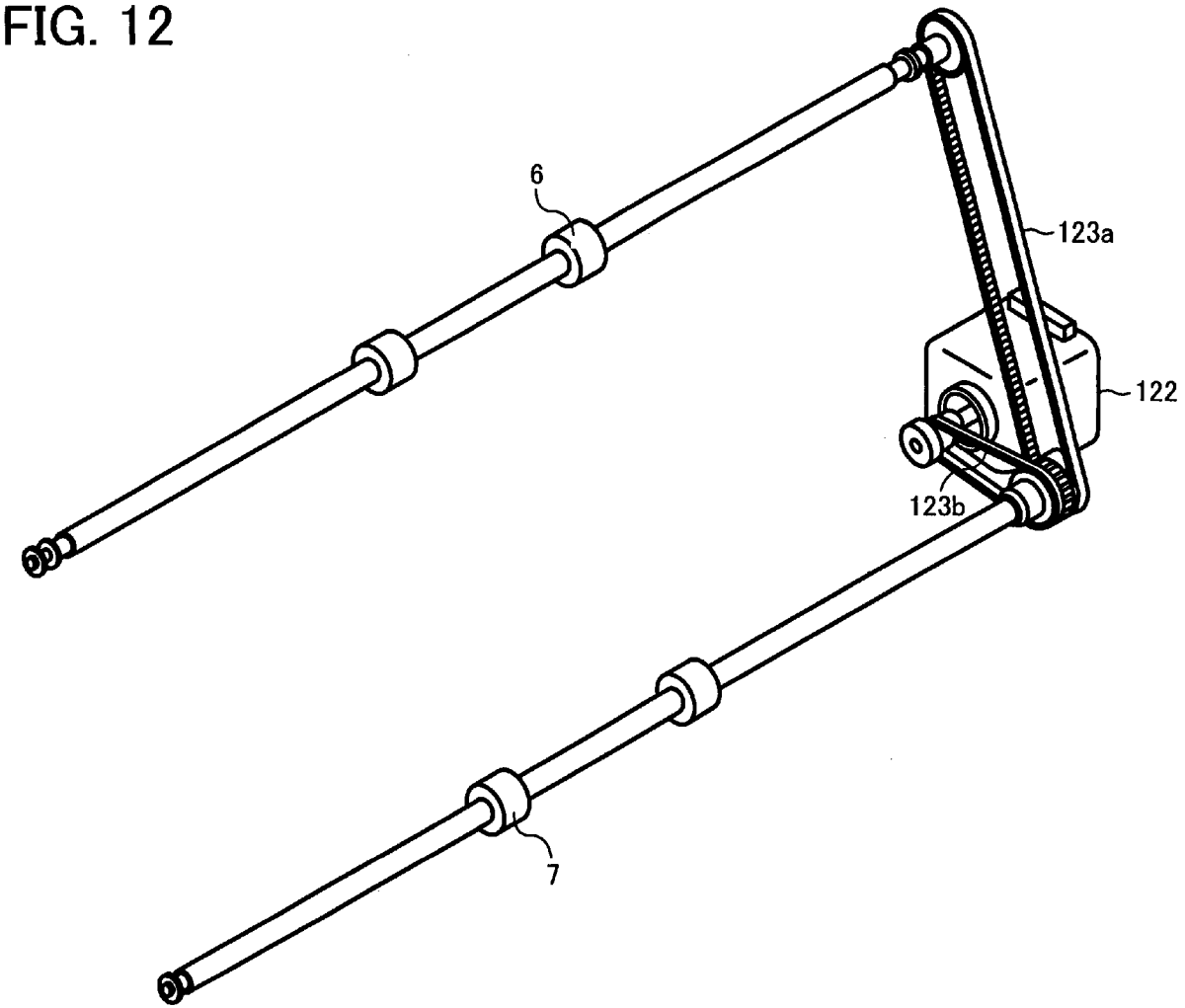
FIG. 12 is a perspective view of another drive mechanism according to an example embodiment of the present invention and the pressure release mechanism according to an example embodiment of the present invention.
Figure 13:
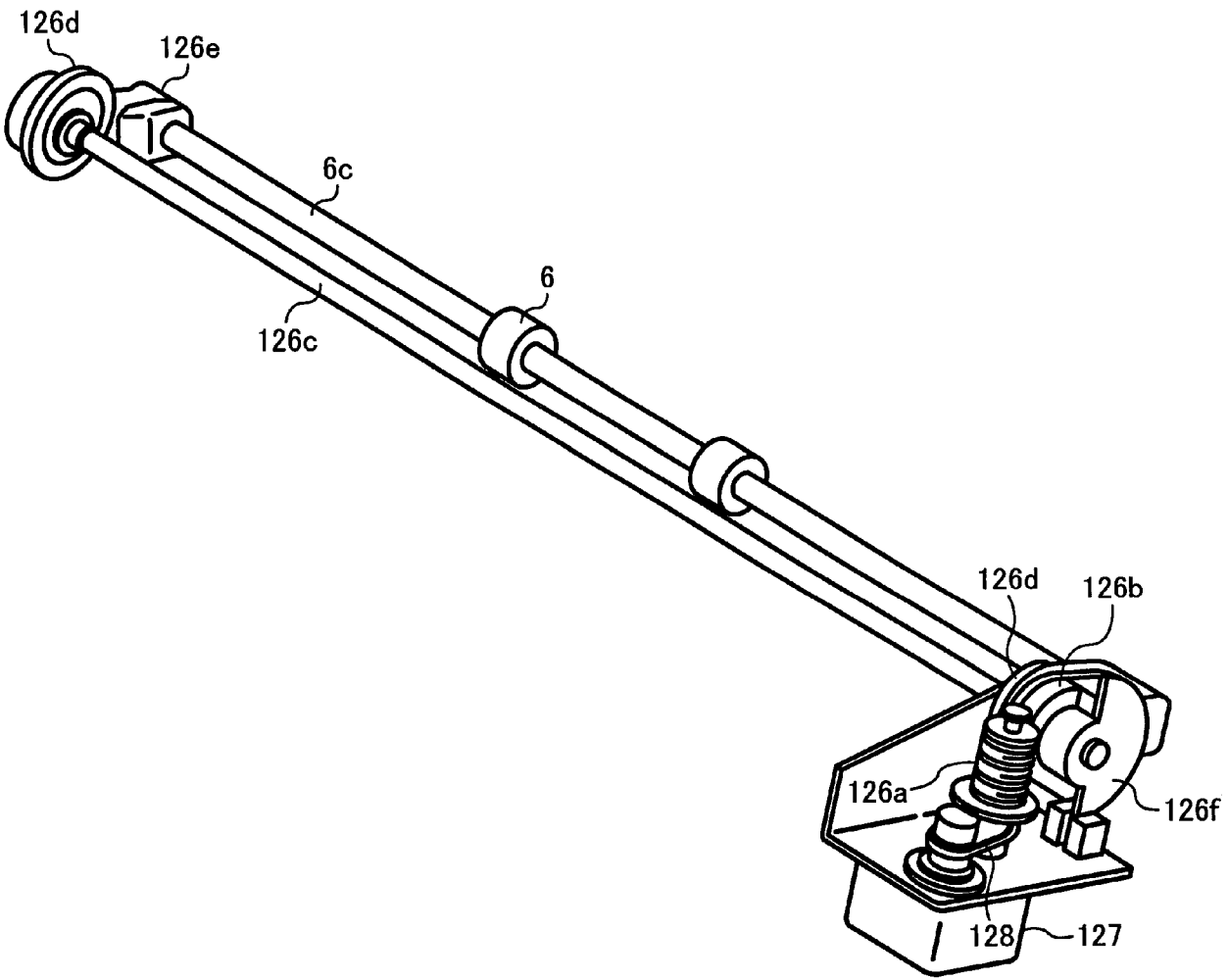
FIG. 13 is a different perspective view of the drive mechanism of FIG. 12 according to an example embodiment of the present invention and the pressure release mechanism according to an example embodiment of the present invention.
Figure 14:
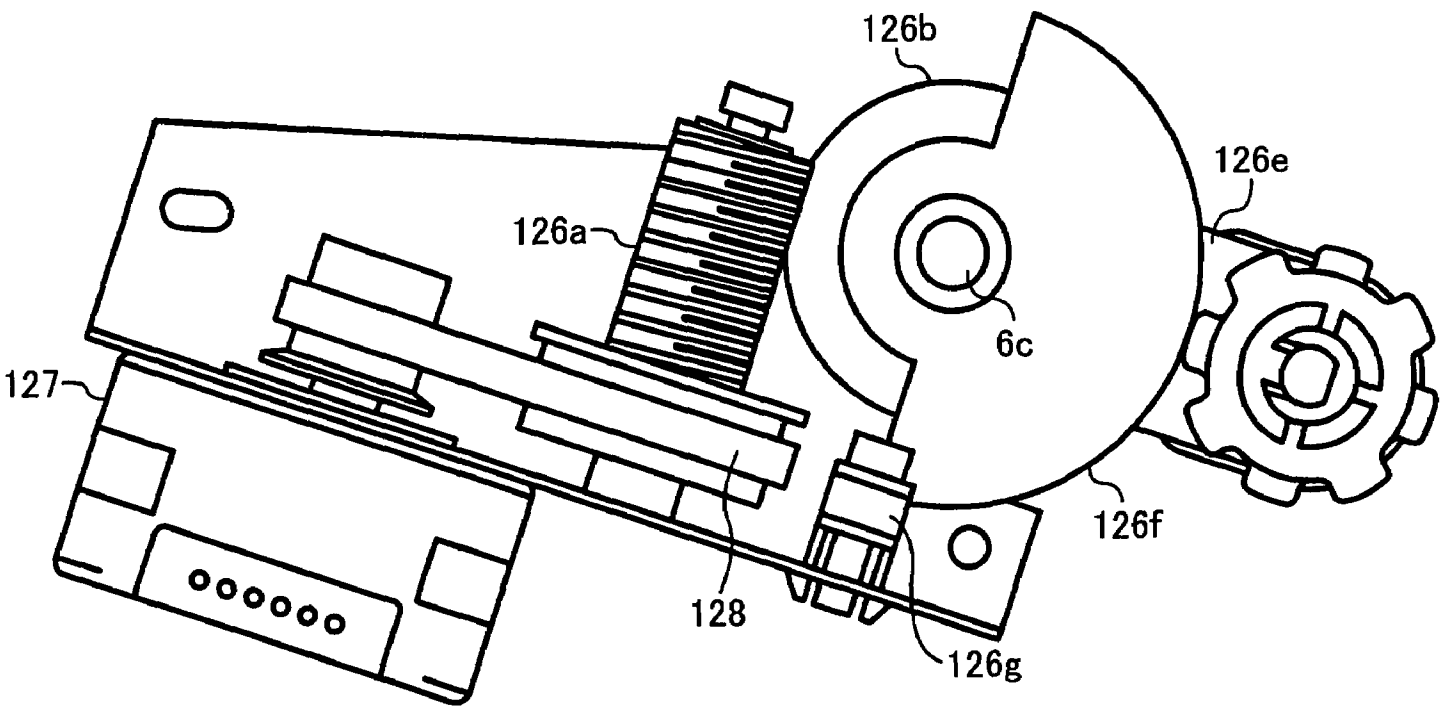
FIG. 14 is a side elevation view of the drive mechanism of FIG. 12 according to an example embodiment of the present invention and the pressure release mechanism according to an example embodiment of the present invention.

Referring to FIGS. 12, 13, and 14, another example embodiment of the drive mechanism of the second and third pairs of conveying rollers 6 and 7 and the pressure release mechanism of the second pair of conveying rollers 6 is described.

FIG. 12 shows a different drive mechanism of the second and third pairs of conveying rollers 6 and 7. A drive force exerted by a motor 122 is transmitted via first and second timing belts 123*a* and 123*b* to the shafts of the second and third pairs of conveying rollers 6 and 7, respectively.

The pressure release mechanism of the second pair of conveying rollers 6 is shown in a perspective view of FIG. 13 and in a front view of FIG. 14. In FIGS. 13 and 14, the pressure release mechanism includes a motor 127, a worm gear 126*a*, a worm wheel 126*b*, a rotation shaft 126*c*, eccentric cams 126*d*, a cam follower 126*e*, a detection piece 126*f*, an optical sensor 126*g*, and a timing belt 128. The rotation shaft 26*c* is driven to rotate by the worm wheel 126*b*. The eccentric cams 126*d* are mounted on both sides of the rotation shaft 126*c*. The cam followers 126*e* are integrally and concentrically mounted on both sides of a shaft 6*c* of the second pair of conveying rollers 6. The detection piece 126*f* is formed in a semicircular shape and is disposed concentrically with the rotation shaft 126*c*. The detection piece 126*f* is used to detect a rotation position of the rotation shaft 126*c*. The optical sensor 126*g* is used to optically detect the position of the detection piece 126*f*.

With the above-described structure, the worm gear 126*a* is driven to rotate by the motor 127 via the timing belt 128 so as to drive the worm wheel 126*b*. The worm wheel 126*b* rotates the shaft 6*c* and the eccentric cams 126*d* together. The eccentric cams 126*d* are decentered and formed in an oval shape having a major axis and a minor axis.

As shown in FIG. 13, when the rotation shaft 126*c* is rotated such that the portion having the major axis of the eccentric cams 126*d* mounted thereon contacts the cam follower 126*d*, the shaft 6*c* of the second pair of conveying rollers 6 is separated from the rotation shaft 126*c*, thereby separating the drive and driven rollers 6*a* and 6*b* of the second pair of conveying rollers 6. Conversely, when the rotation shaft 126*c* is rotated such that the portion having the minor axis of the eccentric cams 126*d* mounted thereon contacts the cam follower 126*d*, the shaft 6*c* of the second pair of conveying rollers 6 is held in contact with the rotation shaft 126*c*, thereby contacting the drive and driven rollers 6*a* and 6*b* of the second pair of conveying rollers 6.

With the above-described operation, a distance between the drive and driven rollers 6*a* and 6*b* of the second pair of conveying rollers 6 is controlled, thereby reducing or preventing interference of the second pair of conveying rollers 6 with respect to a paper sheet having a length equal to or greater than a B5 portrait paper size in the sheet conveying direction.

The respective rotation positions of the eccentric cams 126*d* are determined by a detection result of the detection piece 126*f*. For example, when an optical path emitted by the optical sensor 126*g* is blocked by the detection piece 126*f*, it is determined that the drive and driven rollers 6*a* and 6*b* of the second pair of conveying rollers 6 are separated. On the other hand, when an optical path passes through the drive mechanism and the pressure release mechanism of the sheet conveying device 50, it is determined that the drive and driven rollers 6*a* and 6*b* of the second pair of conveying rollers 6 are held in contact with each other.

According to the above-described settings, the position of the second pair of conveying rollers 6 can be determined based on the detection results of the detection piece 126*f*. As an alternative, if a home position is set to be a timing in which the detection piece 126*f* blocks the optical path of the optical sensor 126*g*, a contact and separation operation of the second pair of conveying rollers 6 can easily be determined, with respect to a drive pulse of a motor. The drive mechanism shown in FIG. 12 operates regardless of operations of a contact and separation mechanism shown in FIGS. 13 and 14.

With the above-described structure, when a paper sheet having a length equal to or greater than a B5 portrait paper size is temporarily stored in the prestack path 2*d*, the second pair of conveying rollers 6 cannot be operated and may be ignored.

EXAMPLE 4

Figure 15A:
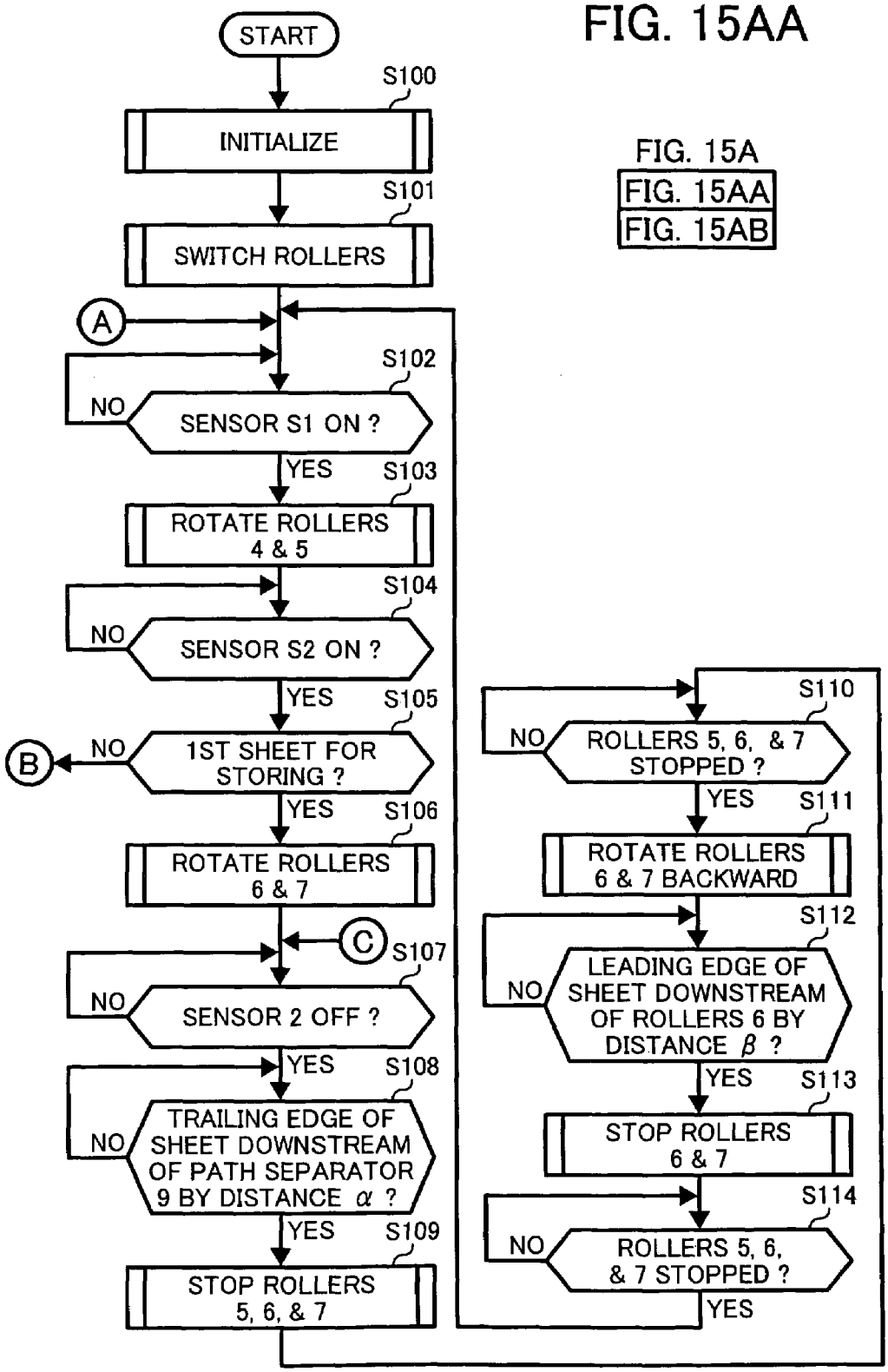
FIGS. 15AA, 15AB, and 15B are flowcharts showing control procedures of the sheet conveying operations according to an example embodiment of the present invention.
Figure 15A:
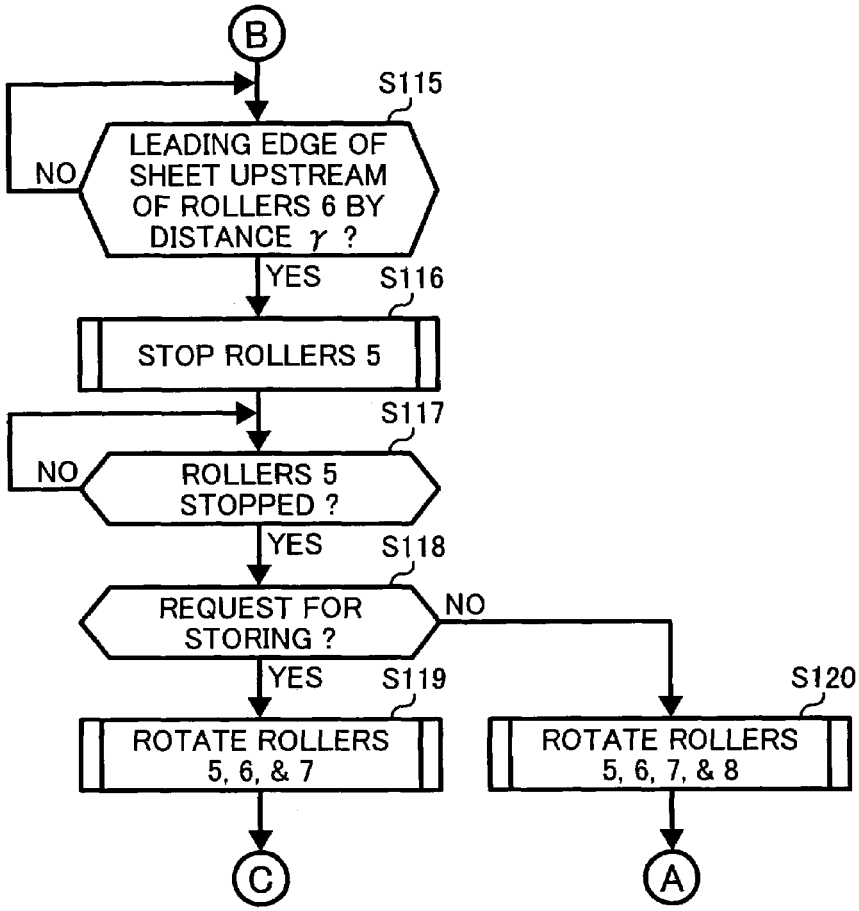
Figure 15B:
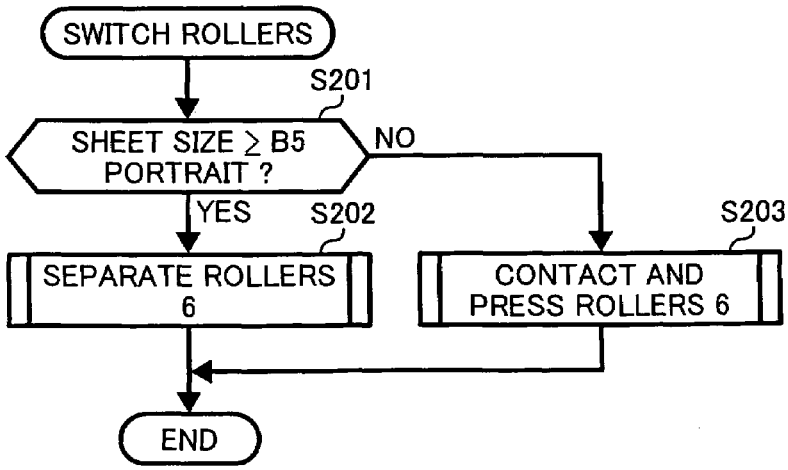

Control Procedure:

Referring to FIGS. 15AA, 15AB, and 15B, flowcharts showing control procedures of the above-described operations are described. FIGS. 15AA and 15AB shows the general control procedure of the above-described operations, and FIG. 15B shows the contact and separation operation of the second pair of conveying rollers 6. The procedure is executed by the CPU 32, following a program stored in the ROM (not shown) while using the RAM (not shown) as a work area.

As shown in the flowchart in FIGS. 15AA and 15AB, when the control procedure is started, the CPU 32 initializes respective controlling components in step S100. After step S100 is performed, the CPU 32 performs the contact and separation operation with respect to the second pair of conveying rollers 6 in step S101.

As previously described, the contact and separation operation is performed in the procedure in steps S201 through S203 shown in FIG. 15B. Specifically, the CPU 32 receives paper size information from the image forming apparatus 1 before starting the conveyance of paper sheets.

In step S201, the CPU 32 then determines, according to the paper size information, whether a paper sheet conveyed from the image forming apparatus 1 has a length equal to or greater than a B5 portrait paper size in the sheet conveying direction. When the result of step S201 is YES, the length of the paper sheet in the sheet conveying direction is equal to or greater than a B5 portrait paper size, and the CPU 32 causes the drive roller 6*a* and the driven roller 6*b* to separate and remain unused as shown in Example 2, in step S202. More specifically, in step S202, the CPU 32 causes the motor 27 to separate the drive and driven rollers 6*a* and 6*b* so that the second pair of conveying rollers 6 may not be used in the sheet conveying operation, and the process goes to step S102.

When the result of S201 is NO, the length of the paper sheet in the sheet conveying direction is less than a B5 portrait paper size, and the CPU 32 causes the second pair of conveying rollers 6 to be used as shown in Example 1, in step S203. More specifically, in step S203, the CPU 32 causes the motor 27 to press contact the drive and driven rollers 6*a* and 6*b* of the second pair of conveying rollers 6 so that the second pair of conveying rollers 6 may be used in the sheet conveying operation, and the process goes to step S102.

In step S102, the CPU 32 determines whether the inlet sensor S1 has turned on. When the inlet sensor S1 has turned on, the result of step S102 is YES, and the process proceeds to step S103. When the inlet sensor S1 has not turned on, the result of step S102 is NO, and the process repeats the procedure until the result of step S102 becomes YES.

In step S103, the CPU 32 causes the pair of inlet rollers 4 and the first pair of conveying rollers 5 to rotate in the forward direction, and the process proceeds to step S104.

In step S104, the CPU 32 determines whether the sheet detection sensor S2 disposed between the path selector 2*e* and the first pair of conveying rollers 5 has turned on. When the sheet detection sensor S2 has turned on, the result of step S104 is YES, and the process proceeds to step S105. When the sheet detection sensor S2 has not turned on, the result of step S104 is NO, and the process repeats the procedure until the result of step S104 becomes YES.

In step S105, the CPU 32 checks if the paper sheet is a first sheet to be temporarily stored in the prestack path 2*d*. When the paper sheet is the first sheet, the result of step S105 is YES, and the process proceeds to step S106. When the paper sheet is not the first sheet, the result of step S105 is NO, and the process goes to step S115.

In step S106, the CPU 32 causes the second and third pairs of conveying rollers 6 and 7 to rotate in the forward direction to convey the paper sheet through the second lower sheet conveying path 2*c*, and the process proceeds to step S107.

In step S107, the CPU 32 determines whether the sheet detection sensor S2 has turned off. When the sheet detection sensor S2 has turned off after a trailing edge of the paper sheet passes the sheet detection sensor S2, the result of step S107 is YES, and the process proceeds to step S108. When the sheet detection sensor S2 has not turned off, the result of step S107 is NO, and the process repeats the procedure until result of step S107 becomes YES.

In step S108, the CPU 32 checks if the trailing edge of the paper sheet has reached a position that is located downstream of the branch point 2*h* that corresponds to the free side of the path selector 9 by the distance "α". When the trailing edge of the paper sheet has reached the branch point 2*h*, the result of step S108 is YES, and the process proceeds to step S109. When the trailing edge of the paper sheet has not reached the branch point 2*h*, the result of step S108 is NO, the process repeats the procedure until the result of step S108 becomes YES.

In step S109, the CPU 32 causes the first, second, and third pairs of conveying rollers 5, 6, and 7 to stop the respective rotations, and the process goes to step S110.

In step S10, the CPU 32 determines whether the first, second, and third pairs of conveying rollers 5, 6, and 7 have stopped rotating. When the first, second, and third pairs of conveying rollers 5, 6, and 7 have stopped, the result of step S110 is YES, and the process goes to step S1. When the first, second, and third pairs of conveying rollers 5, 6, and 7 have not stopped yet, the result of step S110 is NO, and the process repeats until the result of step S110 becomes YES.

In step S111, the CPU 32 causes the second and third pairs of conveying rollers 6 and 7 to rotate in the backward direction to convey the paper sheet to temporarily store in the prestack path 2*d*, and the process proceeds to step S112.

In step S112, the CPU 32 checks if a leading edge of the paper sheet has reached a position that is located at a downstream side of the nip of the second pair of conveying rollers 6 by the distance "β" When the leading edge of the paper sheet has reached the position, the result of step S112 is YES, and the process goes to step S113. When the leading edge of the paper sheet has not reached the position, the result of step S112 is NO, and the process repeats until the result of step S112 becomes YES.

In step S113, the CPU 32 causes the second and third pairs of conveying rollers 6 and 7 to stop the respective rotations, and the process proceeds to step S114.

In step S114, the CPU 32 determines whether the second and third pairs of conveying rollers 6 and 7 have stopped rotating. When the second and third pairs of conveying rollers 6 and 7 have not stopped, the result of step S114 is NO, the process repeats until the result of step S114 becomes YES. When the second and third pairs of conveying rollers 6 and 7 have stopped, the result of step S114 is YES, and the process goes back to step S102 to wait for the following paper sheet to be conveyed.

As previously described, when the result of step S105 is NO, the paper sheet is not the first sheet to be conveyed, and the process goes to step S115.

In step S115, the CPU 32 determines whether the leading edge of the paper sheet that is not the first sheet has reached a position that is located upstream of the nip of the second pair of conveying rollers 6 by the distance "γ" (for example, 20 mm). When the leading edge of the paper sheet has reached the position, the result of step S115 is YES, and the process proceeds to step S116. When the leading edge of the paper sheet has not reached the position, the result of step S115 is NO, and the process repeats until the result of step S115 becomes YES.

In step S116, the CPU 32 causes the first pair of conveying rollers 5 to stop its rotation, and the process proceeds to step S117.

In step S117, the CPU 32 checks if the first pair of conveying rollers 5 has stopped rotating. When the first pair of conveying rollers 5 has stopped, the result of step S117 is YES, and the process proceeds to step S118. When the first pair of conveying rollers 5 has not stopped, the result of step S117 is NO, and the process repeats until the result of step S117 becomes YES.

In step S118, the CPU 32 determines whether a request of temporarily storing the paper sheet in the prestack path 2*d* has sent. When the request of temporarily storing the paper sheet has sent, the result of step S118 is YES, and the process proceeds to step S119. When the request of temporarily storing the paper sheet has not sent, the result of step S118 is NO, and the process goes to step S120.

In step S119, the CPU 32 causes the first, second, and third pairs of conveying rollers 5, 6, and 7 to rotate in the forward direction, and the process goes back to step S107.

In step S120, the CPU 32 causes the first, second, and third pairs of conveying rollers 5, 6, and 7, and the pair of tray outlet rollers 8 to rotate in the forward direction, and the process goes back to step S102.

As previously described, when the length of the paper sheet is equal to or greater than a B5 portrait paper size in step S201 of FIG. 15B, the second pair of conveying rollers 6 will not be used in the following steps of the control procedure. More specifically, the third pair of conveying rollers 7 is used as an alternative to the second pair of conveying rollers 6 to take the functions of the second pair of conveying rollers 6 in the control procedure after step S102.

In the above-described operations, the reference size of a paper sheet is represented by the B5 portrait paper size. That is, the stop positions of the second and third pairs of conveying rollers 6 and 7 are controlled to switch when a paper sheet has a length less than the B5 portrait paper size in the sheet conveying direction as shown in Example 1 and when a paper sheet has a length equal to or greater than the B5 portrait size in the sheet conveying direction as shown in Example 2. However, the reference size of a paper sheet is not limited to the B5 portrait paper size. The present invention can be applied to a reference size of a paper sheet represented by a LG (legal) portrait size, which has a length of 355.6 mm in the sheet conveying direction. That is, the stop positions of the second and third pairs of conveying rollers 6 and 7 can be controlled to switch based on the length of a LG paper size as a reference size.

According to the length of the reference size, it is determined whether the CPU 32 performs Example 1 or Example 2.

When the length of the paper size in the sheet conveying direction is less than the LG portrait size, the CPU 32 causes the drive roller 6*a* and the driven roller 6*b* of the second pair of conveying rollers 6 to contact with each other so that the leading edge of the paper sheet can be stopped at the nip of the second pair of conveying rollers 6.

On the other hand, when the length of the paper size in the sheet conveying direction is equal to or greater than the LG portrait size, the CPU 32 causes the drive roller 6*a* and the driven roller 6*b* of the second pair of conveying rollers 6 to be separated from each other and the pressure exerted to the nip of the second pair of conveying rollers 6 to be released, so that the leading edge of the paper sheet can be stopped at the nip of the third pair of conveying rollers 7.

Detailed descriptions of the other control operations are omitted since the other control operations are same as the operations described in an example embodiment discussed above.

In the above-described operations, the conveying rollers to be rotated in the backward direction are selected according to the size of a paper sheet to be conveyed into the sheet conveying device 50. More specifically, a distance from the branch point 2*h* to the selected conveying rollers according to the length of the paper size in the sheet conveying direction can be changed or a position at which the paper sheet is stopped can be changed according to the length of the paper sheet in the sheet conveying direction when the paper sheet is conveyed in the backward direction. For example, the position in which the leading edge of a long paper sheet is stopped can be more downstream of a regular paper sheet. Therefore, a period of time can be reduced when the paper sheet is conveyed in the backward direction and thereafter in the forward direction to the staple tray 14. Further, when paper sheets having a long length in the sheet conveying direction are conveyed, the intervals between the paper sheets can be reduced, and can contribute to an increase of the speed in image forming.

In an example embodiment discussed above, when the prestacking operation is performed, the second paper sheet P2 is stopped at the nip of the second pair of conveying rollers 6 or a position located upstream of the nip of the second pair of conveying rollers 6 by a given distance. The first paper sheet P1 temporarily stored in the prestack path 2*d* is piggybacked with the second paper sheet P2 in the second lower sheet conveying path 2*c*. The first and second paper sheets P1 and P2 then are conveyed together to the staple tray 14. The CPU 32 controls the sheet conveying operation such that a first sheet of a second job is not conveyed toward the staple tray 14 while a stack of paper sheets of a first job are processed in the staple tray 14.

When a motor is stopped and then started again, a recovery to a given constant speed may take a specific time. That is, if a second paper sheet is completely stopped, it may take time to recover to a constant speed when the motor is resumed to drive. Therefore, when the interval between paper sheets sequentially conveyed becomes shorter, the motor cannot drive at the constant speed until a second paper sheet is conveyed.

In the present example embodiment, the sheet conveying device 50 can decrease a sheet conveying speed to a lower speed at a given timing so that the paper sheets can be conveyed as a stack of sheets without stopping the operation for conveying the second paper sheet.

Operations performed in the present example embodiment are basically similar to the operations performed in an example embodiment discussed above, except that the second paper sheet does not stop and that the conveyance timing is changed due to non-stop operation of the second paper sheet. In the present example embodiment, a description is provided of operations that are different from the operations of an example embodiment described above.

Referring to FIGS. 16A, 16B, 16C, and 17, schematic structures of the sheet conveying device 50 according to an example embodiment of the present invention are described.

Figure 16C:
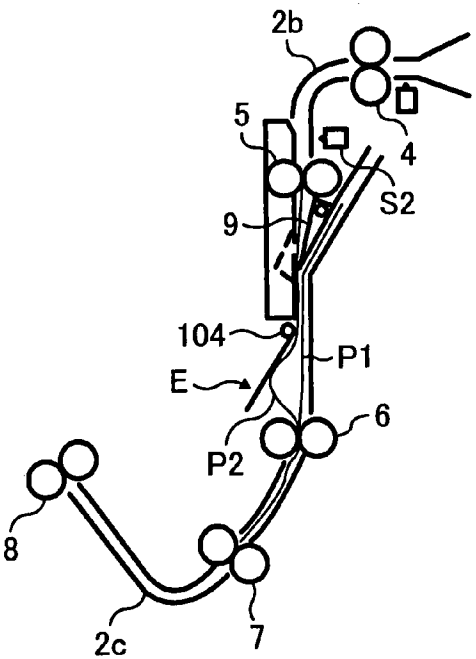
FIGS. 16A through 16C are cross sectional views of a schematic structure and sheet conveying operations according to an example embodiment of the present invention of the sheet conveying device according to an example embodiment of the present invention.
Figure 16B:
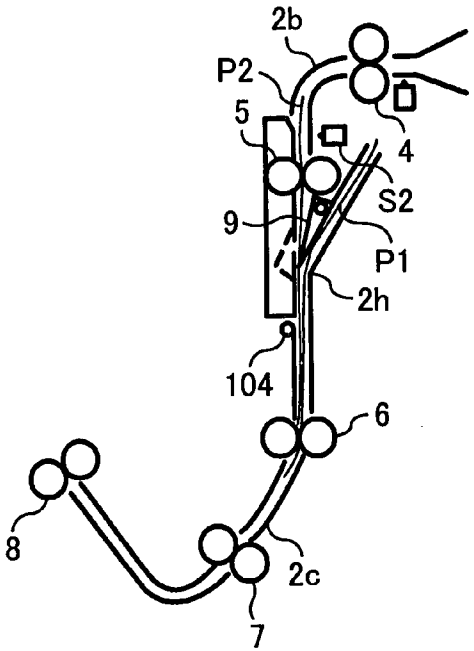
Figure 16A:
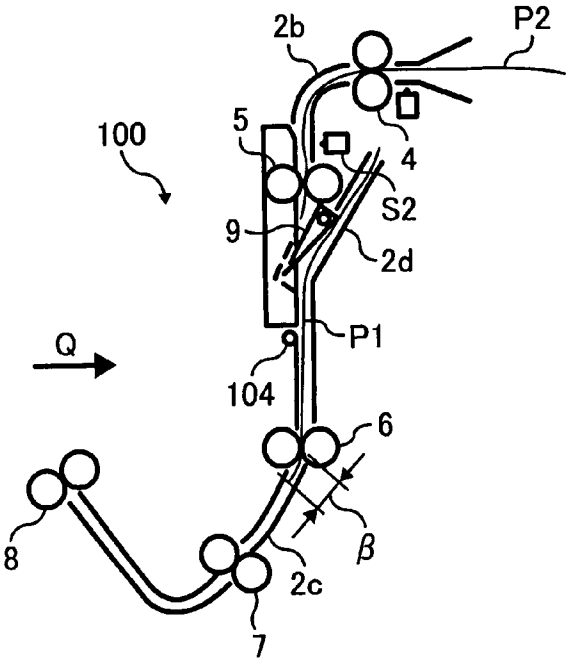
Figure 17:
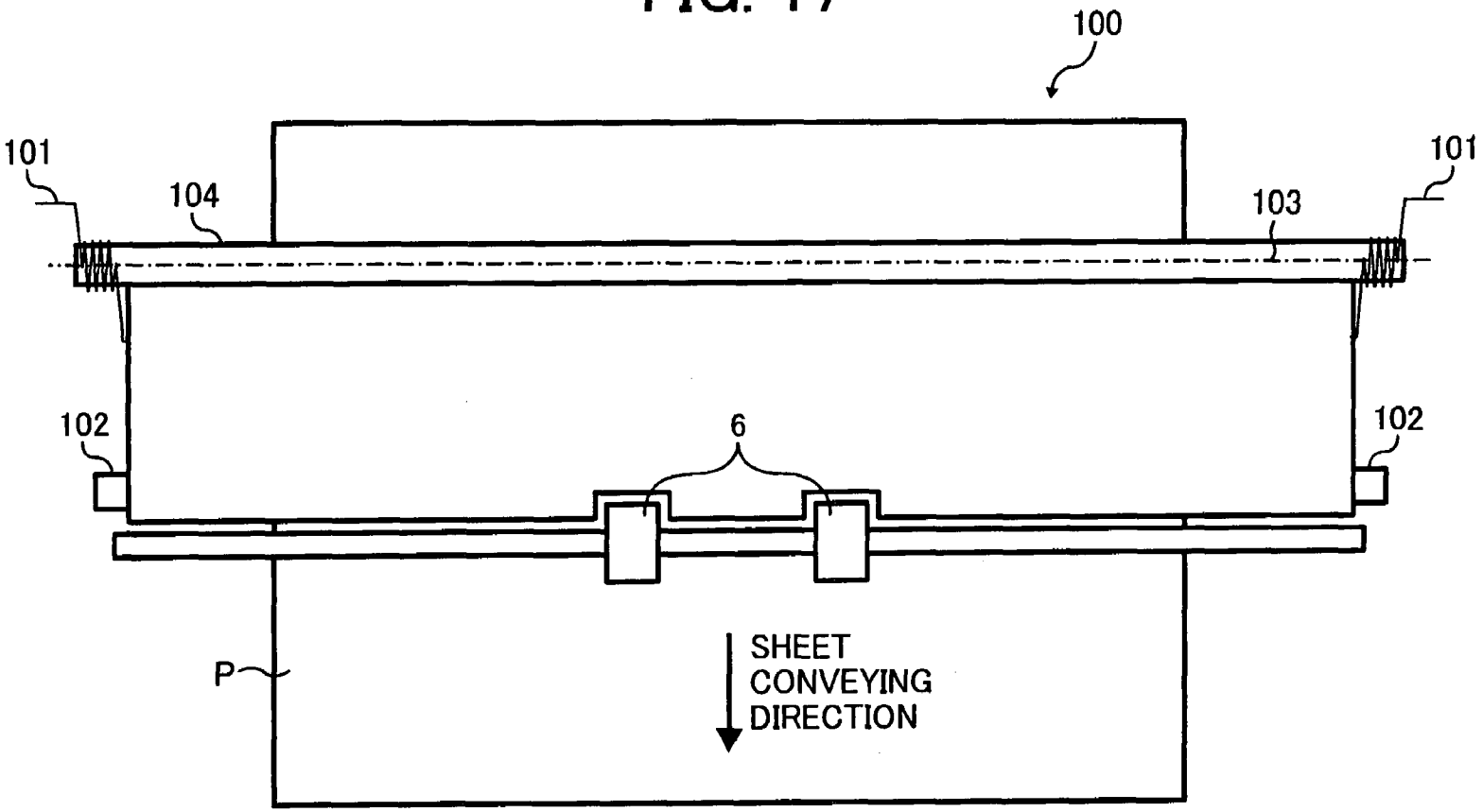
FIG. 17 is a schematic structure of the sheet conveying device according to an example embodiment of the present invention.

FIGS. 16A, 16B, and 16C show operations of the sheet conveying device 50. FIG. 17 shows a schematic structure of a portion of the sheet conveying device 50 to control or absorb a flexure of a paper sheet.

In FIG. 16A, the trailing edge of the first paper sheet P1 that comes in advance with the second paper sheet P2 enters into the prestack path 2*d* and the leading edge of the first paper sheet P1 is stopped at a position that is located downstream of the nip of the second pair of conveying rollers 6 by approximately 5 mm, which is a distance "β".

When the second paper sheet P2 does not stop upstream of or at the nip of the second pair of conveying rollers 6, the second pair of conveying rollers 6 resumes its rotation immediately before or when the second paper sheet P2 reaches the nip of the second pair of conveying rollers 6, as shown in FIG. 16B.

After starting the rotation again, the second pair of conveying rollers 6 accelerates the speed of rotation to achieve the same linear velocity as the rollers for conveying the second paper sheet P2, for example, the pair of inlet rollers 4 and/or the first pair of conveying rollers 5. Until the linear velocity of the second pair of conveying rollers 6 becomes same as the pair of inlet rollers 4 and/or the first pair of conveying rollers 5, the leading edge of the second paper sheet P2 is held at the nip of the second pair of conveying rollers 6. That is, the difference in linear velocity of the rollers may cause the second paper sheet P2 to become bowed or sagged at a portion upstream of the nip of the second pair of conveying rollers 6.

The first and second sheet conveying paths 2*b* and 2*c* are provided with a distance between walls thereof sufficient for one paper sheet or a few paper sheets to pass through. Therefore, while being conveyed in the first and second sheet conveying paths 2*b* and 2*c*, the second paper sheet P2 may become gradually and increasingly bowed or sagged. As the trailing edge of the second paper sheet P2 is further conveyed in the forward direction, the second paper sheet P2 can be jammed in the second lower sheet conveying path and 2*c*.

As shown in FIGS. 16A through 16C, the sheet conveying device 50 of an example embodiment includes a flexure absorbing mechanism 100 for controlling or absorbing the flexure of the second paper sheet P2, thereby the second paper sheet P2 can be bowed or sagged in the second lower sheet conveying path 2*c*.

FIG. 17 is a schematic structure of the flexure absorbing mechanism 100, viewed from arrow Q in FIG. 16A. As shown in FIG. 17, the flexure absorbing mechanism 100 for controlling or absorbing the flexure of a paper sheet includes a guide plate 104, torsional springs 101, stoppers 102, and a spindle 103. The guide plate 104 is disposed facing a surface of a paper sheet passing through the first lower sheet conveying path 2*b*. The spindle 103 angularly supports the guide plate 104 at a position located at upstream in the sheet conveying direction. The torsional springs 101 are an elastic member mounted on both sides of an upstream portion of the guide plate 104, centering about the spindle 103. The torsional springs 101 are used to constantly bias the guide plate 104 toward the second lower sheet conveying path 2*c*, which is a direction to regulate the movement of a paper sheet. The stoppers 102 are mounted on both sides of a downstream portion of the guide plate 104. The flexure absorbing mechanism 100 is disposed in the second lower sheet conveying path 2*c*, at a portion immediately upstream of the second pair of conveying rollers 6 in the sheet conveying direction. The stoppers 102 regulate the position of free ends of the guide plate 104 to form a gap having approximately 2 mm in width of the second lower sheet conveying path 2*c* for conveying a paper sheet.

As shown in FIG. 16C of an example embodiment, the second paper sheet P2 is held at the nip of the second pair of conveying rollers 6 when the second pair of conveying rollers 6 is started again. While the rotation speed of the second pair of conveying rollers 6 is accelerated to achieve a reference sheet conveyance speed, a bowed portion "E" of the second paper sheet P2 pushes the guide plate 104 outwardly or in a direction opposite to the direction indicated by arrow Q in FIG. 16A.

By pushing the guide plate 104, the width of the second lower sheet conveying path 2*c* is temporarily increased to accept the second paper sheet P2 in the second lower sheet conveying path 2*c*. Thereby, a possible paper jam can be avoided and the second paper sheet P2 can smoothly be conveyed by the second pair of conveying rollers 6. The second paper sheet P2 is further conveyed by the third pair of conveying rollers 7 and the pair of outlet rollers 8, and is then discharged to the staple tray 14.

Figure 18:
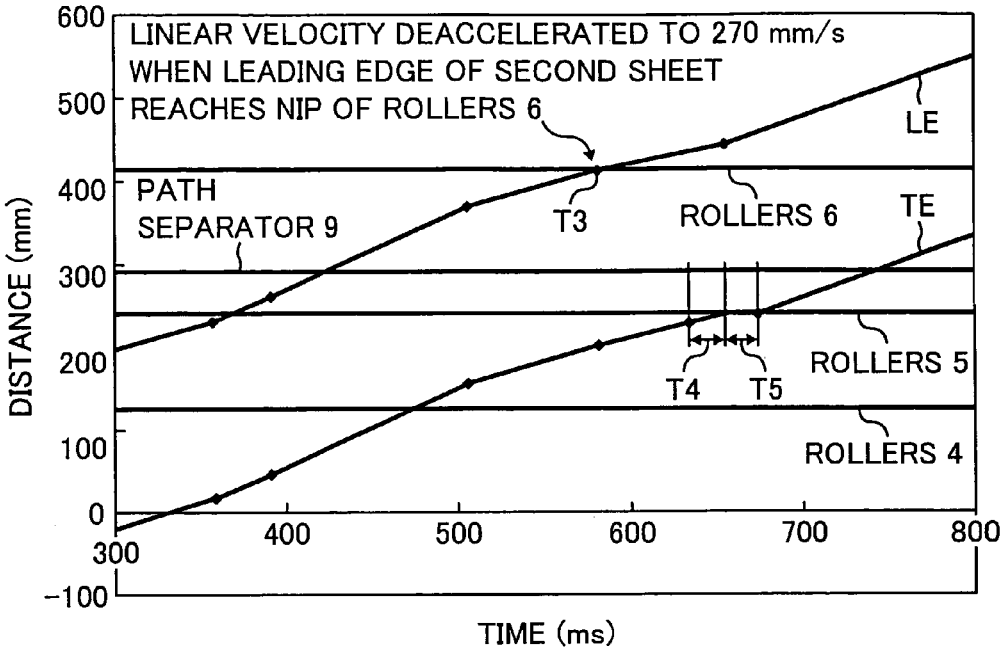
FIG. 18 is a timing chart showing operation timings corresponding to the sheet conveying operations of FIGS. 16A through 16C of the sheet conveying device according to an example embodiment of the present invention.
Figure 19:
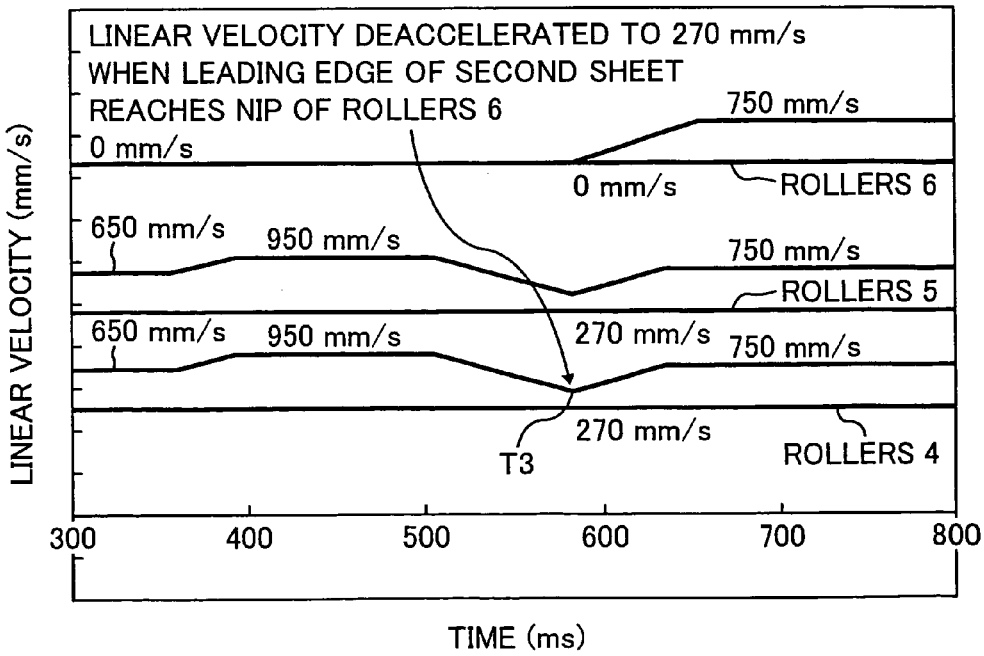
FIG. 19 is a timing chart showing operation timings corresponding to the sheet conveying operations of FIGS. 16A through 16C and the timing chart of FIG. 18 according to an example embodiment of the present invention.

Referring to FIGS. 18 and 19, timing charts of respective operation timings for performing the above-described sheet conveying operations are described.

These timing charts show respective timings in a condition in which the pair of inlet rollers 4 and the first pair of conveying rollers 5 are decelerated to rotate in synchronization with the second pair of conveying rollers 6 that is resumed its rotation.

FIG. 18 is a timing chart showing operation timings of the leading and trailing edges of the second paper sheet P2 in FIGS. 16A through 16C. FIG. 19 is a timing chart showing operation timings of the pair of inlet rollers 4 and the first and second pairs of conveying rollers 5 and 6, corresponding to the timing chart of FIG. 18.

In FIG. 18, "LE" represents leading edge of the second paper sheet P2, and "TE" represents the trailing edge of the second paper sheet P2. The vertical axis in FIG. 18 indicates a position in a unit of "mm", which is a distance from the inlet 2*a* of the sheet conveying device 50, and the horizontal axis in FIG. 18 indicates a time in a unit of "ms", which is a length of time that has elapsed since the leading edge of the second paper sheet P2 passed the inlet sensor S1.

In the sheet conveying operations shown in FIGS. 16A through 16C, the rotation of the second pair of conveying rollers 6 is resumed when the leading edge of the second paper sheet P2 reaches a timing position T3 that is located approximately 20 mm upstream of the nip of the second pair of conveying rollers 6 in the sheet conveying direction, which is a position approximately 600 mm to approximately 20 mm away from the inlet 2*a*.

As shown in FIG. 19, the pair of inlet rollers 4 and the first pair of conveying rollers 5 accelerate the respective speeds of rotations, from approximately 650 mm/s to approximately 950 mm/s, immediately before the timing position T3 so as to reduce a time loss when the pair of inlet rollers 4 and the first pair of conveying rollers 5 are decelerated.

The respective rotation speeds of the pair of inlet rollers 4 and the first pair of conveying rollers 5 are decelerated from approximately 950 mm/s to reach the linear velocity of approximately 270 mm/s at the timing position T3, and are synchronized with the rotation of the second pair of conveying rollers 6. Then, the respective rotation speeds of the pair of inlet rollers 4 and the first and second pairs of conveying rollers 5 and 6 are accelerated from approximately 270 mm/s to approximately 750 mm/s in synchronization in a short period after the timing position T3.

Before the linear velocity of the second pair of conveying rollers 6 reaches approximately 750 mm/s, the bowed portion E of the second paper sheet P2 is gradually unbent during a timing position T4, and the trailing edge of the second paper sheet P2 passes through the nip of the first pair of conveying rollers 5 to be brought back to its original shape in a timing position T5.

After the timing position T5, the first and second paper sheets P1 and P2 are piggybacked, and are conveyed via the first and second lower sheet conveying paths 2*b* and 2*c*, which are located at a downstream side of the first pair of conveying rollers 5.

Accordingly, even through the second paper sheet P2 is bowed during a period from when the second paper sheet P2 reaches or contacts the nip of the second pair of conveying rollers 6, which is a position approximately 600 mm downstream of the inlet 2*a*, to when the second paper sheet P2 passes the timing position T5, the second paper sheet P2 can be piggybacked with the first paper sheet P1 and conveyed together to the staple tray 14 without causing a paper jam.

These timing charts show the respective timings of the pair of inlet rollers 4 and the first pair of conveying rollers 5 when the rollers 4 and 5 are decelerated. However, the timing charts in FIGS. 18 and 19 can be applied to the operations without decelerating the pair of inlet rollers 4 and the first pair of conveying rollers 5 with the mechanism 100 shown in FIG. 17.

In that case, a timing to resume the sheet conveying operation by the second pair of conveying rollers 6 can be set to a timing faster than the timing shown in FIG. 19. Further, the control procedure of an example embodiment is performed along a similar flowchart to the control procedure of an example embodiment shown in FIGS. 15AA, 15AB, and 15B. More specifically, the operations of FIGS. 18 and 19 are similar to the operations in the flowcharts of FIGS. 15AA, 15AB, and 15B, except that the CPU 32 decelerates the first pair of conveying rollers 5 in step S116', and that the CPU 32 checks if the first pair of conveying rollers 5 has decelerated to 270 mm/s in step S117' so that the first pair of conveying rollers 5 are then accelerated and the second and third pairs of conveying rollers 6 and 7 are resumed.

The components omitted to be described here have the same structures and functions as in an described in an example embodiment described above.

In an example embodiment, the second paper sheet P2 is not stopped but is decelerated to be piggybacked with the first paper sheet P1. Therefore, a time gap between the first and second paper sheet P1 and P2 can be reduced, and can contribute to an increase of the speed in image forming, with respect to an example embodiment.

As shown in an example embodiment, when the prestacking operation is performed, a paper sheet having a long length in the sheet conveying direction may also be temporarily stored in the prestack path 2*d* as well as a paper sheet having a short length. For conveying the paper sheet having a long length in the sheet conveying direction, the sheet conveying device 50 can have different conveying rollers. To avoid an increase of costs, one motor may be used to drive two pairs of different conveying rollers for conveying the paper sheet having a long length for storing.

However, a problem may be caused when an identical motor is used to drive different conveying rollers for conveying paper sheets of different sizes. For example, when a paper sheet having a long length in the sheet conveying direction is conveyed to the prestack path 2*d* by the third pair of conveying rollers 7 driven by the motor 22 at a regular linear velocity, a paper sheet having a short length can reach the second pair of conveying rollers 6 driven by the above-described motor 22 before a trailing edge of the paper sheet having a long length temporarily stored in the prestack path 2*d* passes through the second and third pairs of conveying rollers 6 and 7. The above-described problem may incur because the second and third pairs of conveying rollers 6 and 7 driven by the same motor 22 at the same linear velocity that is slower than the linear velocity of the pair of inlet rollers 4 and the first pair of conveying rollers 5 that are driven by a common motor.

Since the second paper sheet is conveyed to the first lower sheet conveying path 2*b* by the pair of inlet rollers 4 and the first pair of conveying rollers 5 at the linear velocity faster than that of the second and third pairs of conveying rollers 6 and 7, the paper sheet having a short length is moved faster than the paper sheet having a long length, which may result in production of problems. When the linear velocities of the pair of inlet rollers 4 and the first, second, and third pairs of conveying rollers 5, 6, and 7 are synchronized, the trailing edge of the paper sheet having a long length cannot be successfully conveyed to the prestack path 2*d*. More specifically, the paper sheet having a long length may take a long period from passing through the second and third pairs of conveying rollers 6 and 7 to entering the prestack path 2*d*. Therefore, when the linear velocity of the pair of inlet rollers 4 and the first pair of conveying rollers 5 is same as that of the second and third pairs of conveying rollers 6 and 7, the paper sheet having a long length cannot be completely conveyed to the prestack path 2*d* before the paper sheet having a short length is conveyed to the second pair of conveying rollers 6.

The present example embodiment can eliminate the above-described problem. Since the sheet conveying device 50 of the present example embodiment basically has the same structure as that of an example embodiment discussed above, the detailed descriptions of the structures and functions are omitted.

Referring to FIGS. 20A through 20H and FIG. 21, the sheet conveying operations performed by the sheet conveying device 50 according to an example embodiment of the present invention are described.

In the present example embodiment, a first paper sheet of a first job is referred to as a "first paper sheet P1-1", a second paper sheet of the first job is referred to as a "second paper sheet P1-2", a third paper sheet of the first job is referred to as a "third paper sheet P1-3", and a first paper sheet of a second job is referred to as a "new paper sheet P2-1".

Figure 20A:
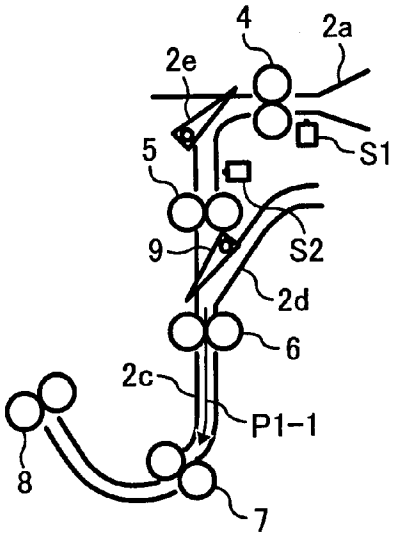
FIGS. 20A through 20H are cross sectional views and sheet conveying operations performed by the sheet conveying device according to an example embodiment of the present invention.
Figure 20B:
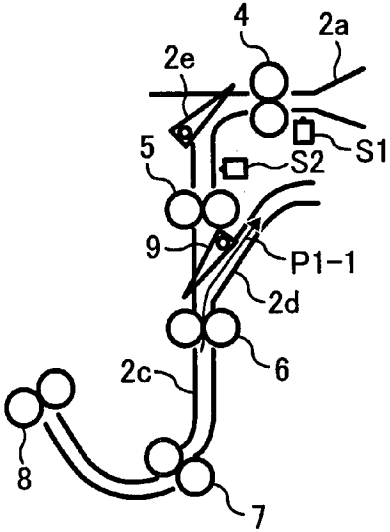

After the trailing edge of the first paper sheet of the first job P1-1 passes the path selector 9 as shown in FIG. 20A, the second and third pairs of conveying rollers 6 and 7, which are driven by a common drive source, are rotated in the backward direction to convey the first paper sheet P1-1 to the prestack path 2*d* as shown in FIG. 20B.

Figure 20C:
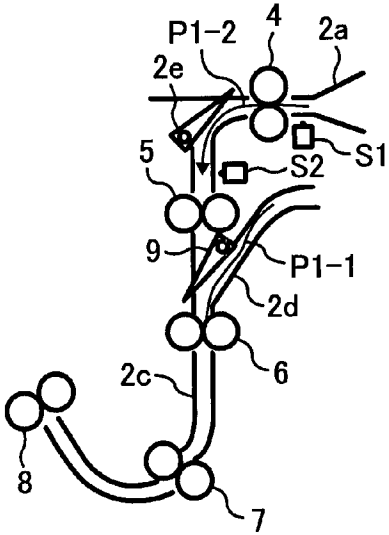

As shown in FIG. 20C, when the leading edge of the first paper P1-1 passes through the second pair of conveying rollers 6 or comes back at the nip of the second pair of conveying rollers 6, the second pair of conveying rollers 6 is stopped and the trailing edge of the first paper sheet P1-1 is temporarily stored in the prestack path 2*d*. At this time, the second paper sheet of the first job P1-2 is conveyed through the pair of inlet rollers 4.

Figure 20D:
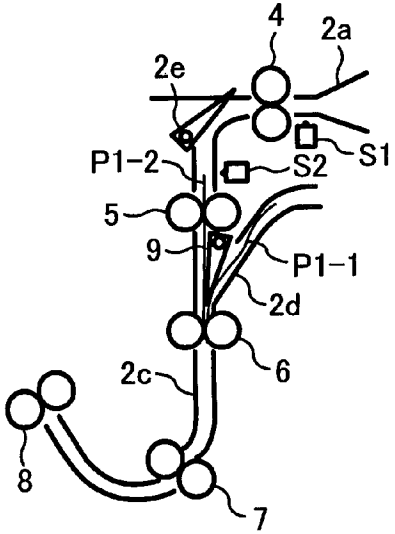
Figure 20E:
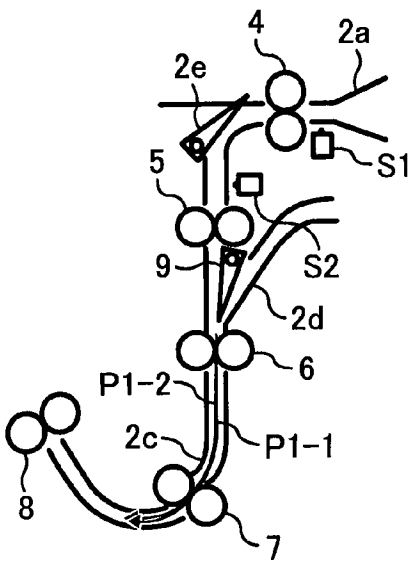

In FIG. 20D, the second paper sheet P1-2 passes the path selector 9 to be conveyed toward the nip of the second pair of conveying rollers 6 that is being stopped. When the second paper sheet P1-2 contacts the nip of the second pair of conveying rollers 6, the second pair of conveying rollers 6 resumes its rotation in the forward direction so that the first and second paper sheets P1-1 and P1-2 are piggybacked to be conveyed together to the staple tray 14, as shown in FIG. 20E.

A period from when the sheet detection sensor S2 that is disposed upstream of the prestack path 2*d* in the sheet conveying direction detected the leading edge of the second paper sheet P1-2 to when the leading edge of the first paper sheet P1-1 comes back to the nip of the second pair of conveying rollers 6 is previously calculated based on the type of conveying paths and the linear velocity of conveying paper sheets. The second pair of conveying rollers 6 resumes the forward rotation at a timing previously determined according to the above-described period.

When the number of paper sheets to be temporarily stored is smaller than a specified number, the paper sheets piggybacked together in the second lower sheet conveying path 2*c* are conveyed in the backward direction to the prestack path 2*d* in the same procedure for conveying the first paper sheet P1-1. When the number of paper sheets to be temporarily stored reaches the specified number, the piggybacked paper sheets are conveyed in the forward direction to the pair of tray outlet rollers 8.

When a third paper sheet of the first job P1-3 is conveyed to the sheet conveying device 50, the sheet conveying operations of FIGS. 20A through 20E are repeated, which are not shown.

Figure 20F:
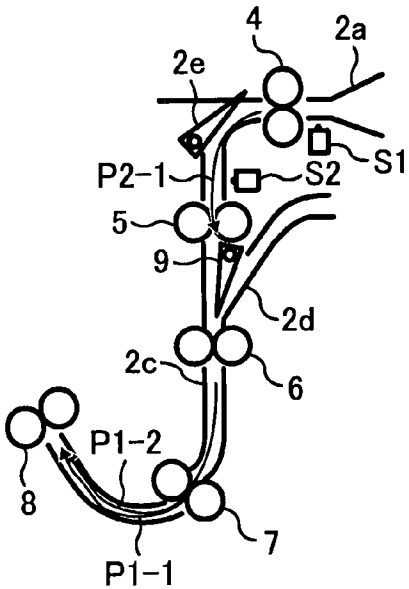
Figure 20G:
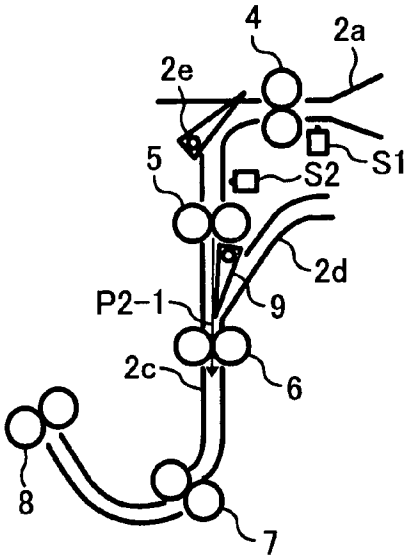
Figure 20H:
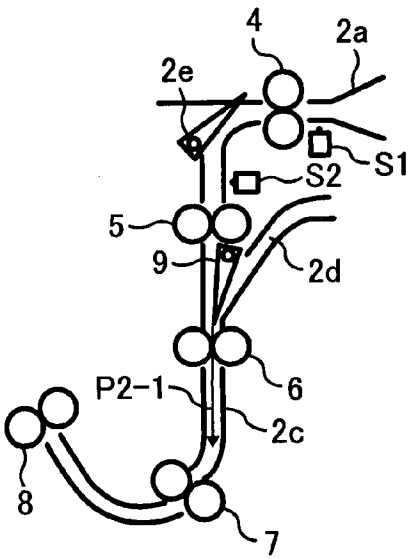

When a new paper sheet of a second job P2-1 passes through the first pair of conveying rollers 5 and is conveyed to the first and second lower sheet conveying paths 2*b* and 2*c*, the first, second, and third paper sheets P1-1, P1-2, and P1-3 have passed through the third pair of conveying rollers 7, as shown in FIG. 20F. The new paper sheet of the second job P2-1 passes the path selector 9 and the second pair of conveying rollers 6 as shown in FIGS. 20G and 20H. When the second job has more paper sheet following the new paper sheet P2-1, the sheet conveying operations corresponding to FIGS. 20A through 20E are repeated. When the second job has no more paper sheet to be conveyed, the new paper sheet P2-1 is conveyed toward the staple tray 14.

Figure 21:
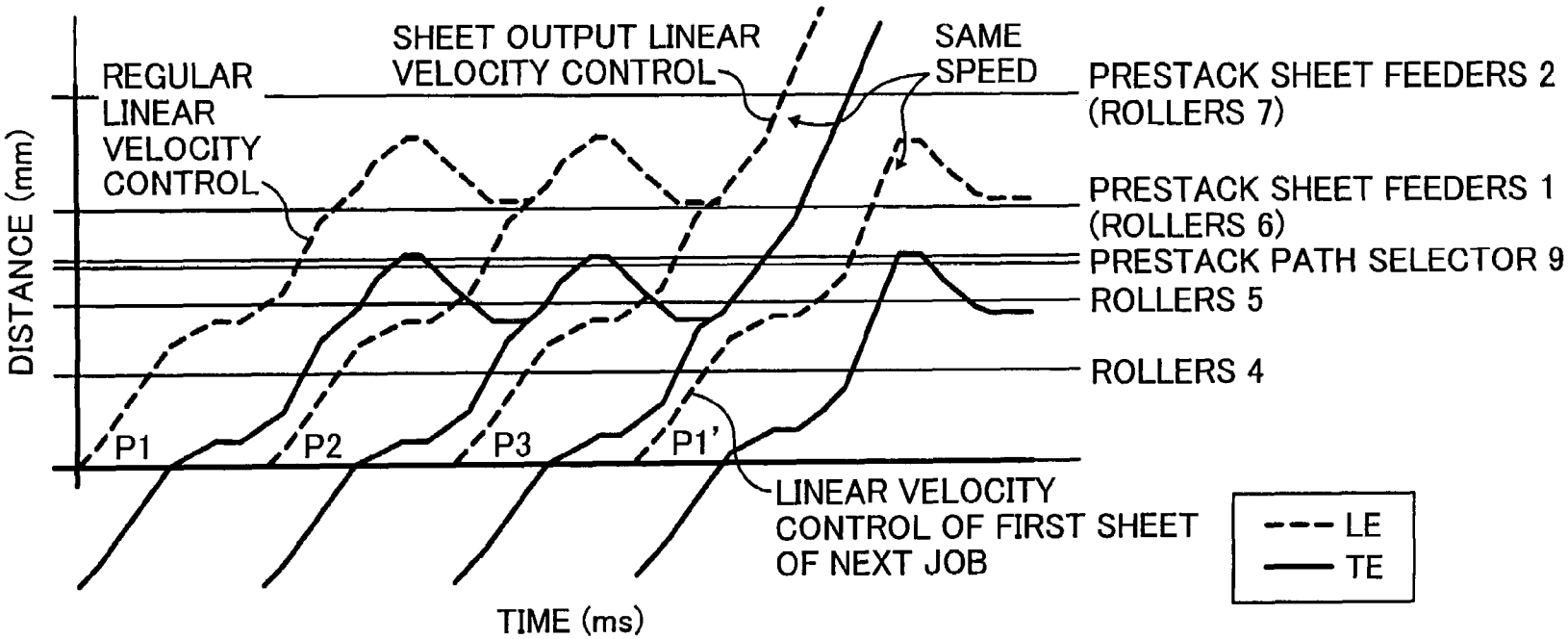
FIG. 21 is a velocity diagram showing respective sheet conveying timings of paper sheets in the sheet conveying device according to an example embodiment of the present invention.

FIG. 21 shows a velocity diagram showing respective sheet conveying timings of the paper sheets P1-1, P1-2, P1-3, and P2-1 in the sheet conveying device 50.

The paper sheets P1-1, P1-2, P1-3, and P2-1 are conveyed at a constant linear velocity in the sheet conveying device 50 until a given number of paper sheets of one job is conveyed.

The velocity diagram of FIG. 21 is an example diagram showing respective linear velocities of the paper sheets P1-1, P1-2, P1-3, and P2-1, indicating respective positions of the paper sheets P1-1, P1-2, P1-3, and P2-1 at the pair of inlet rollers 4, the first, second, and third pairs of conveying rollers 5, 6, and 7, and the path selector 9.

More specifically, the velocity diagram of FIG. 21 shows the linear velocities of the paper sheets P1-1, P1-2, P1-3, and P2-1 when the first and second paper sheets of the first job P1-1 and P1-2 that are temporarily stored in the prestack path 2*d* are piggybacked with the third paper sheet of the first job P1-3 as a stack of sheets before the new paper sheet of the second job P2-1 is conveyed. When the number of paper sheets reaches the specified value, the first and second paper sheets P1-1 and P1-2 are output from the prestack path 2*d* at the timing in which the third paper sheet P1-3 is piggybacked with the first and second paper sheets P1-1 and P1-2. Then, the stack of sheets is conveyed to the staple tray 14. Sequentially, the new paper sheet of the second job P2-1 is conveyed to the second lower sheet conveying path 2*c*.

If the new paper sheet P2-1 is conveyed at a regular linear velocity immediately after the above-described stack of sheets, the new paper sheet P2-1 can reach the second pair of conveying rollers 6 before the trailing edge of the above-described stack of sheets passes the third pair of conveying rollers 7. Since the linear velocity of the second and third pairs of conveying rollers 6 and 7 is different from the linear velocity of the pair of inlet rollers 4 and the first pair of conveying rollers 5, the above-described operation may cause a failure.

Further, when the linear velocities of the pair of inlet rollers 4 and the first, second, and third pairs of conveying rollers 5, 6, and 7 are synchronized, the trailing edge of the paper sheet having a long length cannot be successfully conveyed to the prestack path 2*d*, as previously described.

To eliminate the above-described problems, the new paper sheet P2-1 can be conveyed at a different linear velocity.

When the first, second, and third paper sheets P1-1, P1-2, and P1-3 are piggybacked as a stack of sheets, the new paper sheet P2-1 stops, for example, at a punching unit (see FIGS. 23A through 23E) for punching. When the stack of sheets are output from the prestack path 2*d*, the new paper sheet P2-1 passes the first pair of conveying rollers 5 to be conveyed to the second pair of conveying rollers 6. Since the second and third pairs of conveying rollers 6 and 7 are driven by a common drive source as previously described, the linear velocity of the new paper sheet P2-1 is increased to the same liner velocity of the stack of sheets until the new paper sheet P2-1 reaches the second pair of conveying rollers 6. The third pair of conveying rollers 7 conveys the stack of sheets and the second pair of conveying rollers 6 conveys the new paper sheet P2-1 at the same linear velocity. When the trailing edge of the stack of sheets passes through the third pair of conveying rollers 7 and the trailing edge of the new paper sheet P2-1 passes the path selector 9, the second pair of conveying rollers 6 is stopped and then rotated in the backward direction to convey the new paper sheet P2-1 to the prestack path 2*d*.

The relationship of the paper sheets P1-1, P1-2, P1-3, and P2-1 is shown in the velocity diagram of FIG. 21 with the changes of the linear velocities with respect to the pair of inlet rollers 4, the first, second, and third pairs of conveying rollers 5, 6, and 7, and the path selector 9. Meanwhile, respective controls for different linear velocities can be performed to maintain the productivity of the image forming apparatus 1 and the sheet finishing apparatus 2.

The components omitted to be described here have the same structures and functions as shown and described in an example embodiment discussed above.

As described above, the sheet conveying device 50 of the present example embodiment can smoothly perform the sheet conveying operations when the second and third pairs of conveying rollers 6 and 7 are driven by a common drive source. Further, since the sheet conveying device 50 of the present example embodiment can control the linear velocities of paper sheets for respective sizes of paper sheets, the productivity of paper sheets having different sizes can be maintained.

Referring to FIGS. 22A-22E and FIGS. 23A through 23E, a structure of the prestack path 2*d* of the sheet conveying device 50 according to an example embodiment of the present invention is described.

The general description of the sheet conveying device 50 of the present example embodiment of the present invention has a similar structure and functions to those of an example embodiment discussed above, except that two pairs of inlet rollers 4*a* and 4*b* are mounted instead of the pair of inlet rollers 4 and a punching unit 200 can be mounted between the two pairs of inlet rollers 4*a* and 4*b*. The general description of the sheet conveying device 50 of the present example embodiment will be omitted.

When a plurality of paper sheets are temporarily stored in the prestack path 2*d*, each paper sheet is conveyed in the backward direction to be stored in the prestack path 2*d* that is branched from the first and second lower sheet conveying paths 2*b* and 2*c*. The length of the prestack path 2*d* is determined according to the maximum size of a paper sheet stored therein. However, if a paper sheet having the maximum size is not so frequently used, the space for the paper sheet of maximum size may be wasted in view of downsizing and simplicity of the sheet conveying device 50 and the sheet finishing apparatus 2. The present example embodiment of the present invention can be used to reduce if not eliminate the above-described problem.

Figure 22A:
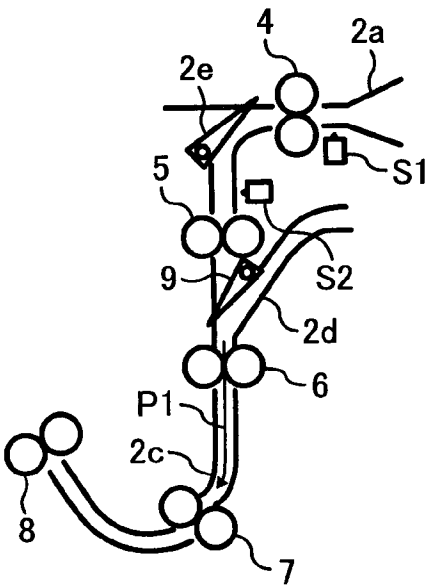
FIGS. 22A through 22E are cross sectional views and sheet conveying operations performed by the sheet conveying device according to an example embodiment of the present invention.
Figure 22B:
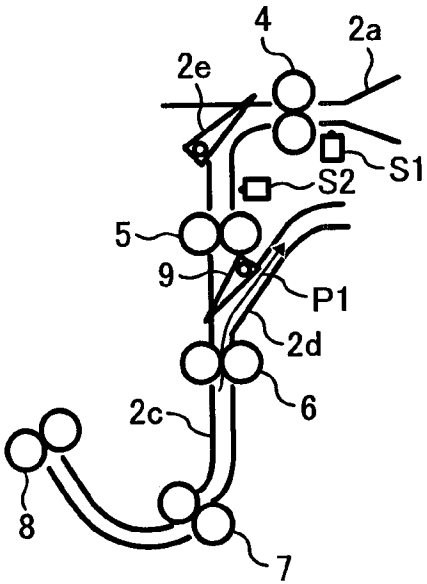

In the present example embodiment, when the first paper sheet P1 is conveying to the second lower sheet conveying path 2*c*, the second pair of conveying rollers 6 is stopped at the timing in which the trailing edge of the first paper sheet P1 is held by the nip of the second pair of conveying rollers 6 as shown in FIG. 22A, the second pair of conveying rollers 6 stops its rotation. The second pair of conveying rollers 6 is then rotated in the backward direction to convey the first paper sheet P1 to the prestack path 2*d*, as shown in FIG. 22B.

Figure 22C:
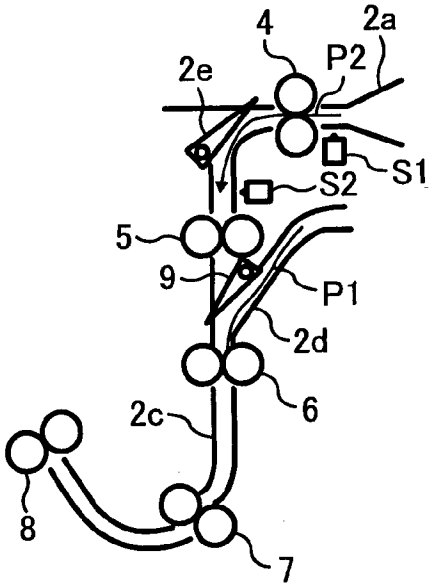
Figure 22E:
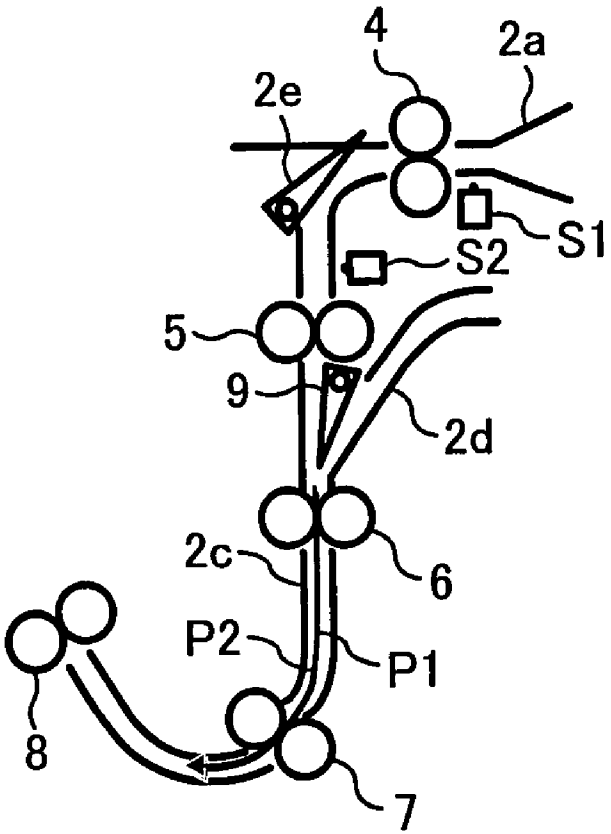
Figure 22D:
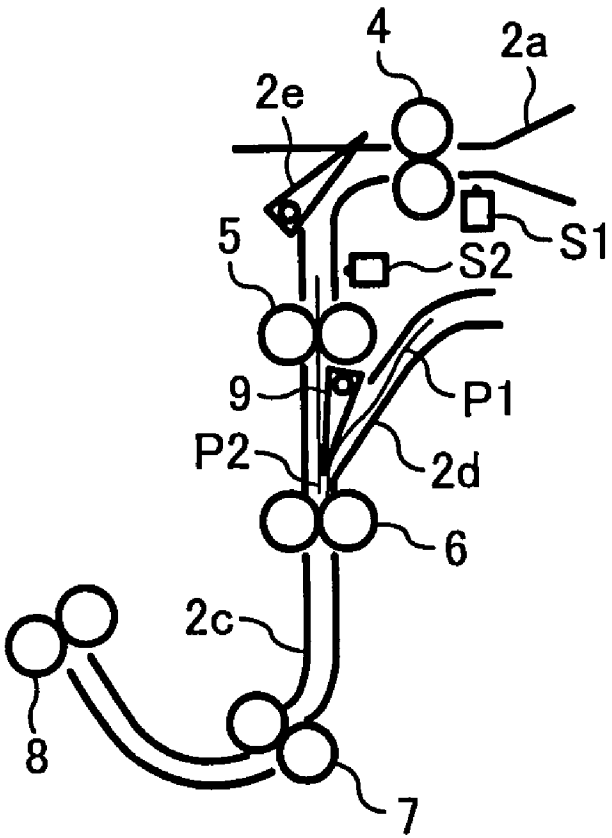

When the second paper sheet P2 is conveyed to the first lower sheet conveying path 2*b* as shown in FIG. 22C, the first paper sheet P1 stays in the prestack path 2*d*. After the second paper sheet P2 passes the path selector 9, the first paper sheet P1 is conveyed from the prestack path 2*d* to be piggybacked with the second paper sheet P2 as shown in FIG. 22D, and the first and second paper sheets P1 and P2 are conveyed together toward the staple tray 14.

To accommodate various sizes of paper sheets in the prestack path 2*d*, the sheet conveying device 50 has a structure of the prestack path 2*d* as shown in FIGS. 23A through 23E.

The prestack path 2*d* of the present example embodiment includes a guide plate 201 that is flexibly detachable depending on the size of a paper to be temporarily stored in the prestack path 2*d*. When an image forming apparatus has the entire size of its system downsized and has little room is left in the image forming apparatus, a prestack path cannot be sufficiently large in size. For example, when the sheet conveying device 50 includes the punching unit 200 mounted on shortly downstream of the pair of inlet rollers 4 as shown in FIG. 23B, the prestack path 2*d* having a large size can interfere the punching unit 200.

Figure 23A:
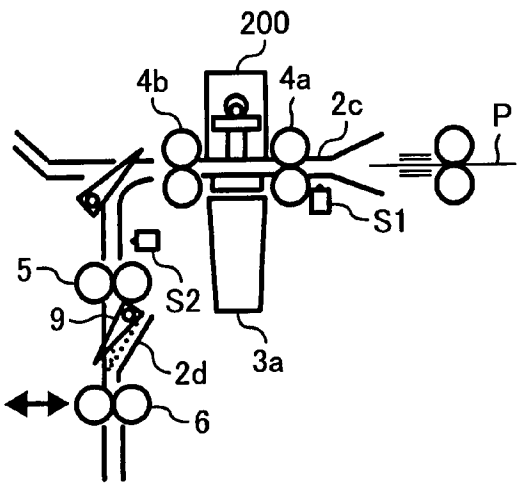
FIGS. 23A through 23E are different cross sectional views and sheet conveying operations performed by the sheet conveying device according to an example embodiment of the present invention.
Figure 23B:
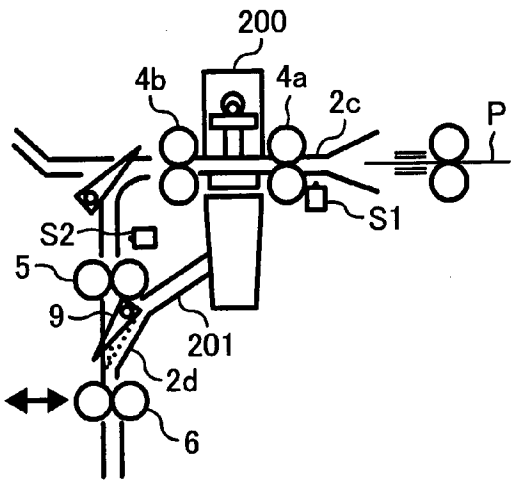

To avoid the above-described circumstance, when the prestack path 2*d* is used to handle paper sheets of up to letter size of landscape, as shown in FIG. 23A, and the guide plate 201 is additionally provided to the prestack path 2*d* so that the prestack path 2*d* can handle paper sheets having a paper size larger than letter size of landscape, as shown in FIG. 23B. This can provide enough space for a large paper sheet.

Figure 23C:
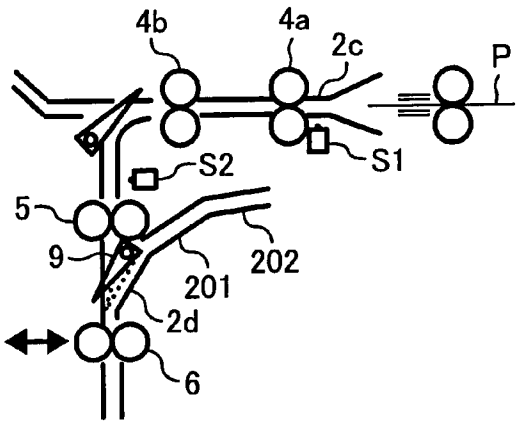

To handle paper sheets having an extra large size by using an external punching unit instead of the punching unit 200, the punching unit 200 can be detached from the sheet conveying device 50 and an optional prestack path 202 may be additionally mounted for handling paper sheets having an extra large size, as shown in FIG. 23C. By mounting the optional prestack path 202, the prestack path 2*d* can increase its length enough to handle paper sheets having a large size or an extra large size.

Figure 23D:
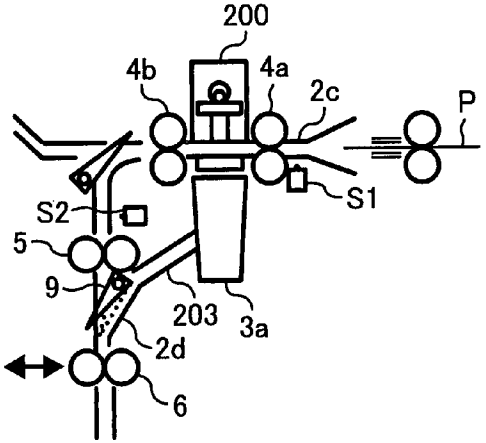
Figure 23E:
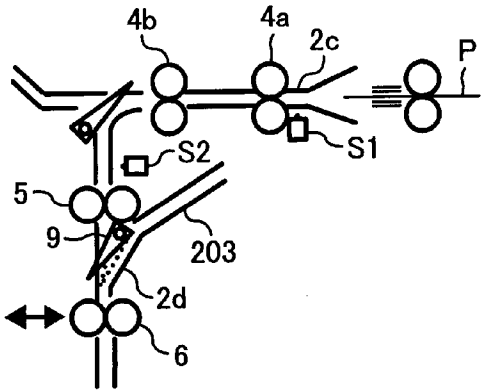

Further, another optional prestack path can be mounted. An optional prestack path 203 is slidably attached to the prestack path 2*d* to control its length depending on the size of a paper sheet to be stacked therein. By slidably extending the optional prestack path 203, the prestack path 2*d* can increase its length enough to handle paper sheets having a large size or an extra large size, as shown in FIGS. 23D and 23E.

The components omitted to describe here can have the same structures and functions as in an example embodiment described above.

Thus, the above-described structure of the sheet conveying device 50 according to the present example embodiment of the present invention can include a detachable sheet stacking portion, for example, the guide plate 201, the optional prestack paths 202 and 203, so that the image forming apparatus can be downsized and a user can easily customize the downsized image forming apparatus.

Figure 24A:
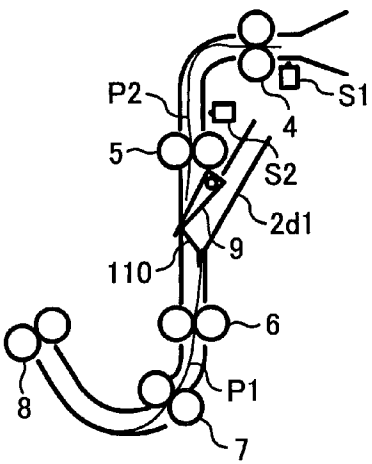
FIGS. 24A and 24B are cross sectional views and sheet conveying operations performed by the sheet conveying device according to an example embodiment of the present invention.
Figure 24B:
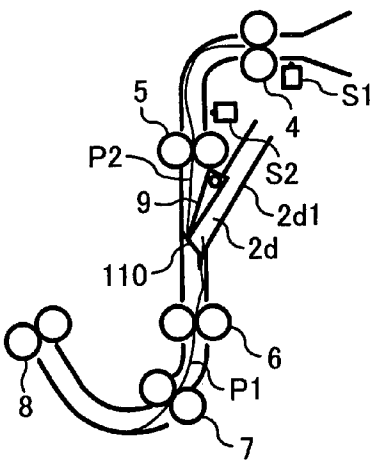
Figure 25:
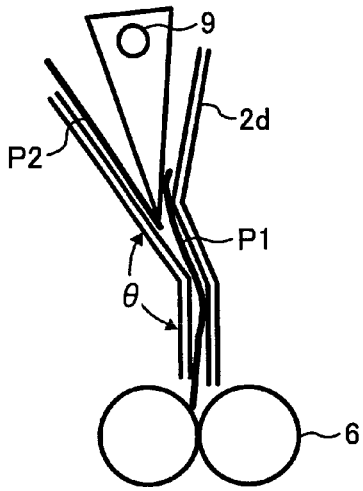
FIG. 25 is a cross sectional view of another example of the sheet conveying device according to an example embodiment of the present invention.

Referring to FIGS. 24A, 24B, and 25, another structure of the sheet conveying device 50 according to an example embodiment of the present invention is described.

The second pair of conveying rollers 6 is stopped immediately after the trailing edge of the first paper sheet P1 passed the path selector 9. The second pair of conveying rollers 6 is then rotated in the backward direction to convey the first paper sheet P1 to the prestack path 2*d*. Since the image forming apparatus 1 provides a high speed copy per minute (CPM), time intervals between paper sheets may be reduced or become short. Thereby, immediately after the first paper P1 is conveyed in the backward direction to the prestack path 2*d*, the second paper sheet P2 comes to the path selector 9 and switches or angularly rotates the path selector 9 to pass the second paper sheet P2.

If the time interval betweens paper sheets may further be reduced or become shorter, or if the CPM of the image forming apparatus 1 is increased, the first paper sheet P1 that is conveyed in the backward direction may enter the first lower sheet conveying path 2*b* through the opening that is formed when the path selector 9 is moved by the second paper sheet P2.

If the first paper sheet P1 goes back into the first lower sheet conveying path 2*b*, the first paper sheet P1 may contact the second paper sheet P2, which can cause a paper jam. If the trailing edge of the first paper sheet P1 is curled toward the leading edge of the path selector 9, the paper jam is more likely to occur. When the speed of the sheet conveying operation in the sheet conveying device 50 is increased, the time intervals between paper sheets can be controlled to some degree, but this cannot be sufficient.

The general description of the sheet conveying device 50 according to the present example embodiment of the present invention has a similar structure and functions to those of an example embodiment discussed above, except that the sheet conveying device 50 in an example embodiment of the present invention is designed to substantially if not completely avoid the paper jam.

In FIGS. 24A and 24B, the sheet conveying device 50 includes an elastic member 110 at a downstream side of the path selector 9. The elastic member 110 serves as a sheet pressing member to correspond with the performance of the image forming apparatus 1 having a high speed CPM.

FIG. 24A shows a condition that the first paper sheet P1 is stopped after passing the path selector 9. While the first paper sheet P1 is stopped, the elastic member 110 presses the trailing edge of the first paper sheet P1 toward a guide plate 2*d*1 serving as the prestack path 2*d* as shown in FIG. 24B. If the second pair of conveying rollers 6 are rotated in the backward direction while the sheet pressing member 110 is pressing the first paper sheet P1, the first paper sheet P1 can be conveyed to the prestack path 2*d* along the guide plate 2*d*1 even when the path selector 9 is switched to open for the first paper sheet P1. As an alternative to the elastic member 110, a craw-shaped or pawl-shaped member or a member that can press the trailing edge of the first paper sheet P1 toward the guide plate 2*d*1 can be applied to reduce possibility of the paper jam.

When the first paper sheet P1 is stopped, the trailing edge of the first paper sheet P1 should not pass the elastic member 110. If the trailing edge of the first paper sheet P1 passes the elastic member 110 to the downstream side of the second lower sheet conveying path 2*c*, the trailing edge of the first paper sheet P1 may be conveyed under the elastic member 110, which can cause a paper jam. Therefore, the elastic member 110 is suitable to be disposed at a position where the trailing edge of the first paper sheet P1 can be pressed by the elastic member 110 even when the first paper sheet P1 is stopped. An example of the material of the elastic member 110 is a mylar sheet that is flexible.

Further, the sheet conveying device 50 can have a structure of the conveying path formed as a dogleg-shaped or crooked conveying path as shown in FIG. 25.

The conveying path shown in FIG. 25 lies between the leading edge of the path selector 9 and the second pair of conveying rollers 6. By forming the dogleg-shaped or crooked conveying path having an angle of degree "θ", even when the first paper sheet P1 passed the path selector 9, the first paper sheet P1 can return to its original shape with its elasticity, which can make it easy for the trailing edge of the first paper sheet P1 to be conveyed in the backward direction to be conveyed to the prestack path 2*d*. Therefore, when the trailing edge of the first paper sheet P1 is conveyed in the backward direction after passing the path selector 9, even if the leading edge of the second paper sheet P2 presses and angularly rotates the path selector 9, the trailing edge of the first paper sheet P1 may not be easily conflicted with the leading edge of the second paper sheet P2 or the leading edge of the path selector 9.

Thus, when the image forming apparatus 1 performs with the high speed CPM, a flexible pressing member such as the sheet pressing member 110 can be disposed in the sheet conveying device 50 so that the trailing edge of the first paper sheet P1 can be smoothly conveyed to the prestack path 2*d* while being pressed by the sheet pressing member 110.

Further, the shape of the conveying path is not limited to the shape as described above. The sheet conveying device 50 can have a conveying path between the path selector 9 and the second pair of conveying rollers 6 to be bent in a direction opposite to the prestack path 2*d*. Even with the above-described structure of the prestack path 2*d*, the trailing edge of the first paper sheet P1 can be easily conveyed to the prestack path 2*d*.

Referring to FIGS. 26A through 36, a structure of the sheet conveying device 50 according to an example embodiment of the present invention is described.

The general description of the sheet conveying device 50 of the present example embodiment of the present invention has a similar structure and functions to those of an example embodiment, except that the sheet conveying device 50 in an example embodiment of the present invention is designed to handle a stack of sheets with different sizes.

As previously described for each of the example embodiments, the sheet conveying device 50 may include additional components or conveying members for the prestack path 2*d* for temporarily storing paper sheets by conveying the paper sheets in the backward direction. Such structure is effectively equipped with various conveying members for conveying paper sheets to each conveying path. These conveying members, however, may cause an increase of driving mechanisms and a complexity of controls.

On the other hand, the sheet conveying device 50 may perform the sheet finishing processes including stapling and punching with different sizes of paper sheets. When paper sheets of different sizes are processed as a stack of sheets, respective trailing edges of the paper sheets are to be aligned. The present example embodiment of the present invention is applicable for aligning the trailing edges of paper sheets of different sizes.

FIGS. 26A, 26B, 27A, and 27B show an example of holding members to hold the trailing edge of the first paper sheet P1 in the present example embodiment.

The second pair of conveying rollers 6 disposed in the vicinity of the path selector 9 can be rotated in both directions, which are the forward and backward directions. The second pair of conveying rollers 6 may be rotated in the forward direction when conveying the first paper sheet P1 to the second lower conveying path 2*c*, and may be rotated in the backward direction when conveying the first paper sheet P1 from the second lower sheet conveying path 2*c* to the prestack path 2*d*.

Figure 26A:
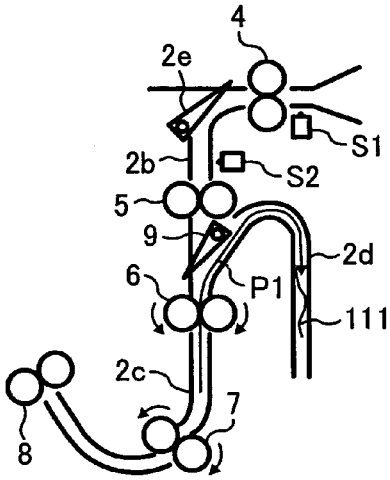
FIGS. 26A and 26B are cross sectional views and sheet conveying operations performed by the sheet conveying device according to an example embodiment of the present invention.
Figure 26B:
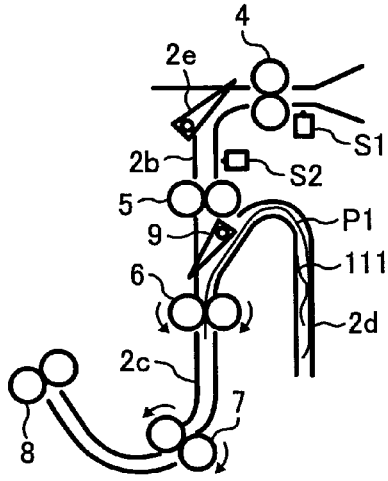

In FIGS. 26A and 26B, the sheet conveying device 50 includes an elastic member 111 in the prestack path 2*d*. The elastic member 111 is used as a holding member to hold the trailing edge of the first paper sheet P1. One end of the elastic member 111 is fixedly mounted on a portion of the inner surface of the prestack path 2*d*. The other end of the elastic member 111 is a free end and can be frictionally held in contact with the inner surface of the prestack path 2*d*.

Operations of the present example embodiment of the present invention are described below. In the following descriptions, it should be noted that the "trailing edge of the first paper sheet P1" is an end that is located at the last portion of the first paper sheet P1 in the forward direction, and at the same time, the "trailing edge of the first paper sheet P1" can be the leading edge of the first paper sheet P1 when conveyed in the backward direction.

When the first paper sheet P1 is conveyed into the prestack path 2*d* to be temporarily stored therein, the trailing edge of the first paper sheet P1 comes to the elastic member 111 as shown in FIG. 26A. As the trailing edge of the first paper sheet P passes the elastic member 111, the elastic member 111 is bent as shown in FIG. 27B so that the elastic member 111 can hold the trailing edge of the first paper sheet P1 by frictionally holding the first paper sheet P1 against the inner surface of the prestack path 2*d*.

Figure 27A:
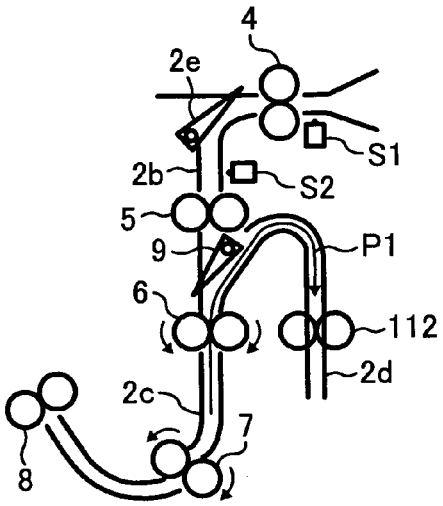
FIGS. 27A and 27B are different cross sectional views and sheet conveying operations performed by the sheet conveying device according to an example embodiment of the present invention.
Figure 27B:
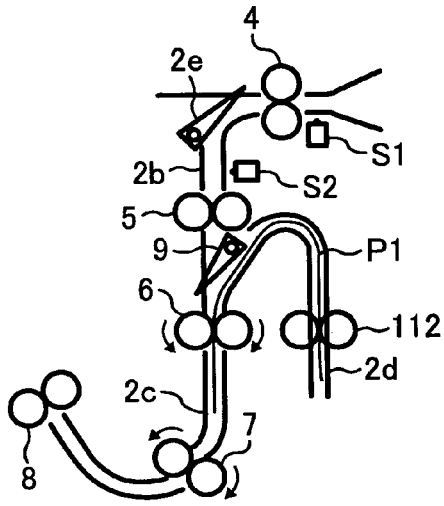

In FIGS. 27A and 27B, the sheet conveying device 50 includes a pair of rollers 112 in the prestack path 2*d*. The pair of rollers 112 is also used as a holding member to hold the trailing edge of the first paper sheet P1 at a nip formed between the pair of rollers 112. When the trailing edge of the first paper sheet P1 reaches the pair of rollers 112, as shown in FIG. 27A, the pair of rollers 112 sandwich the trailing edge of the first paper sheet P1 at the nip thereof, as shown in FIG. 27B.

The elastic member 111 and the pair of rollers 112 are designed to hold the trailing edge of the first paper sheet P1 so as to prevent the first paper sheet P1 from falling out of the prestack path 2*d*. When the first paper sheet P1 is temporarily stored in the prestack path 2*d* that is formed in a U-shaped detour-like path, if the center portion of the first paper sheet P1 in the longitudinal direction or in the sheet conveying direction is not positioned at the top of the U-shaped prestack path 2*d* and is located in an imbalanced manner, one end of the first paper sheet P1 in the longitudinal direction may become heavier than the other end and may lean to the heavier end, which can cause the first paper sheet P1 to fall from the prestack path 2*d*.

To reduce if not eliminate the above-described circumstance, the elastic member 111 can be used so that the simple structure can easily hold the bent trailing edge of the first paper sheet P1. The pair of rollers 112 can also be used so that misregistration of the trailing edge of the first paper sheet P1 can be absorbed in low-load conditions. Thereby, deformation of the first paper sheet P1 can be reduced if not prevented.

Reference signal "L/2" is shown later in FIG. 29 to represent a half length of a length "L" of a paper sheet (the first paper sheet P1 in FIG. 29) in the longitudinal direction. More specifically, the reference signal "L/2" is a length of the first paper sheet P1 from the top of the U-shaped prestack path 2*d* to the trailing edge of the first paper sheet P1 in the longitudinal direction or the sheet conveying direction. When the first paper sheet P1 is conveyed to the U-shaped prestack path 2*d*, the first paper sheet P1 is controlled to be balanced with the length "L/2".

Figure 28:
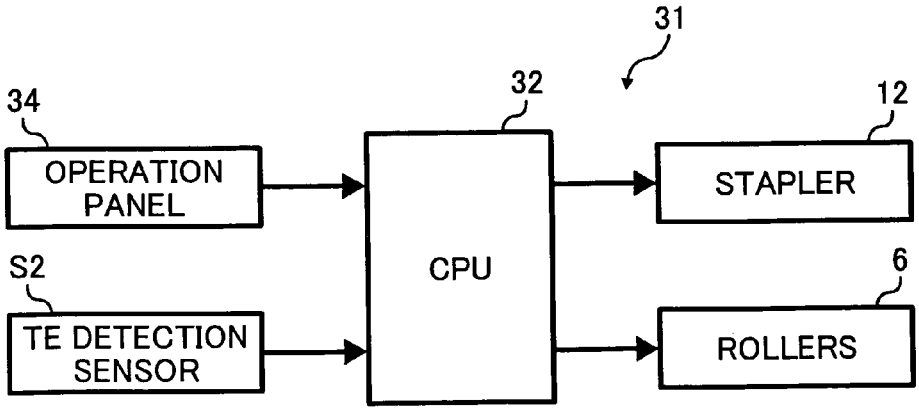
FIG. 28 is a schematic structure of a control unit controlling the sheet conveying device according to an example embodiment of the present invention.

Now, FIG. 28 shows an enlarged structure of the control unit 31 of FIG. 2. The control unit 31 of FIG. 28 shows the details of the CPU 32 connected to an operation panel 34, the sheet detection sensor S2, the stapler 12, and the second pair of conveying rollers 6. For example, operation modes of the second pair of conveying rollers 6 are controlled by the CPU 32 of the control unit 31.

The CPU 32 in FIG. 28 executes sequential controls for image forming with respect to the image forming apparatus 1. The CPU 32 is connected with the operation panel 34, the inlet sensor S1 (not shown in FIG. 28), and the sheet detection sensor S2 detecting the trailing edge of a paper sheet passes a reference position in the first lower sheet conveying path 2*b* so that the operation panel 34, the inlet sensor S1, and the sheet detection sensor S2 can inform input data to the CPU 32. Further, the CPU 32 is connected with a drive unit of the stapler 12 and a drive unit of the second pair of conveying rollers 6 so that the CPU 32 can send output data to these drive units.

The CPU 32 controls the sheet conveying operations to be performed such that a plurality of paper sheets are temporarily stored in the prestack path 2*d* at a timing in which the respective trailing edges of the first and second paper sheets P1 and P2 to be conveyed to the second lower sheet conveying path 2*c* are aligned, and are conveyed to the stapler 12 serving as a sheet finishing processing unit, according to the cases described below.

Case 1: A plurality of paper sheets are conveyed into the second lower sheet conveying path 2*c* in the order of a small size sheet (P1) and a large size sheet (P2);

Case 2: A plurality of paper sheets are conveyed into the second lower sheet conveying path 2*c* in the order of a small size sheet (P1), a large size sheet (P2), and a large size sheet (P3) that is a same size as the second paper sheet P2;

Case 3: A plurality of paper sheets are conveyed into the second lower sheet conveying path 2*c* in the order of a small size sheet (P1), a large size sheet (P2), and a small size sheet (P3); and Case 4: A plurality of paper sheets are conveyed into the second lower sheet conveying path 2*c* in the order of a large size sheet (P1), a small size sheet (P2), and a large size sheet (P3).

When performing each of Cases 1 through 4, the CPU 32 receives information from the operation panel 201 about the size of a paper sheet to be conveying in the second lower sheet conveying path 2*c* and information from the sheet detection sensor S2 according to a detection signal of the trailing edge of the paper sheet. Based on the input data from the operation panel 201 and the sheet detection sensor S2, the CPU 32 determines various settings of the second pair of conveying rollers 6, such as the rotation direction, the number of rotations, and switching the statuses between a contact mode and a separation mode of the second pair of conveying rollers 6.

The sheet conveying operations according to respective cases are described below.

FIGS. 29A through 29D show sheet conveying operations of the sheet conveying device 50 according to Case 1.

Figure 29A:
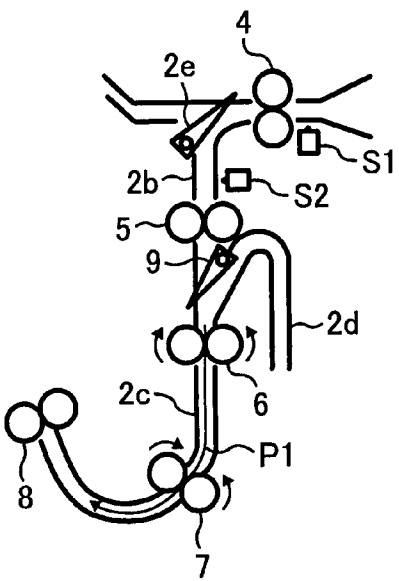
FIGS. 29A through 29D are cross sectional views and sheet conveying operations performed by the sheet conveying device according to an example embodiment of the present invention.

As shown in FIG. 29A, the trailing edge of the first paper sheet P1 passes the path selector 9, the status of the second pair of conveying rollers 6 is set to the contact mode. Then, the second and third pairs of conveying rollers 6 and 7 are rotated in the backward direction to convey the first paper sheet P1 into the prestack path 2*d*, as shown in FIG. 29B.

The first paper sheet P1 to be temporarily stored in the prestack path 2*d* is controlled, based on the number of rotations of the second and third pairs of conveying rollers 6 and 7, so as to be balanced in the prestack path 2*d* with the center of the length of the first paper sheet P1 being positioned at the top of the U-shaped prestack path 2*d*.

Figure 29B:
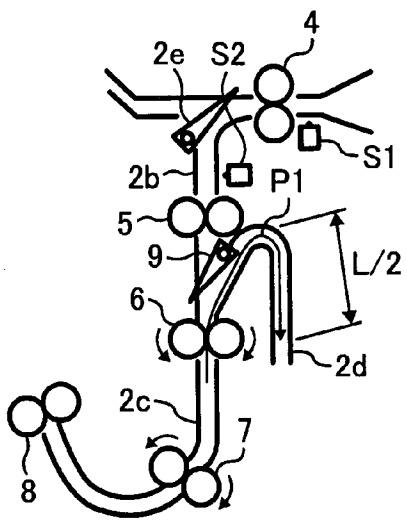
Figure 29C:
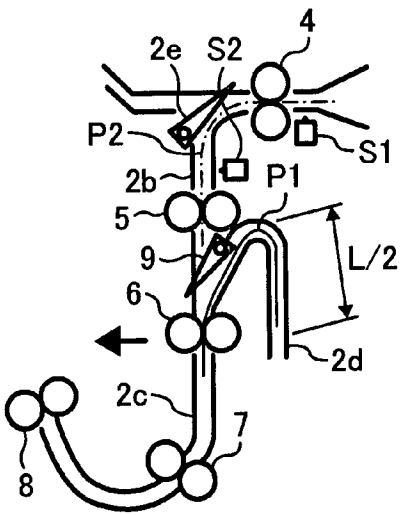

More specifically, when the length of the first paper sheet P1 in the sheet conveying direction is same as the length "L" of an A4-size paper in the landscape direction that is approximately 210 mm, the length "L/2" in FIGS. 29B and 29C, from the center of the first paper sheet P1 in the sheet conveying direction to the trailing edge of the first paper sheet P1, is a half length of the length "L". The length "L/2" is also equal to the length from the center of the first paper sheet P1 in the sheet conveying direction the leading edge of the first paper sheet P1. Therefore, when the center of the first paper sheet P1 is held at the top of the U-shaped prestack path 2*d*, the first paper sheet P1 is balanced in weight in the U-shaped prestack path 2*d*, thereby prevented from being fell from the prestack path 2*d*. Even if the first paper sheet P1 is moved to be imbalanced, the holding member 111 shown in FIGS. 26A and 26B or the holding members 112 shown in FIGS. 27A and 27B can hold the trailing edge of the first paper sheet P1, thereby reducing if not preventing the first paper sheet from falling from the prestack path 2*d*.

On the other hand, when the second paper sheet P2 having a size larger than the first paper sheet P1 is conveyed to the second lower sheet conveying path 2*c* while the first paper P1 is temporarily stored in the prestack path 2*d*, the status of the second pair of conveying rollers 6 is switched to the separation mode to convey the second paper sheet P2, as shown in FIG. 29C.

When the second paper sheet P2 is conveyed into the second lower sheet conveying path 2*c*, the CPU 32 controls to convey the trailing edge of the first paper sheet P1 conveyed from the prestack path 2*d* to be aligned with the trailing edge of the second paper sheet P2 moving in the second lower sheet conveying path 2*c*. More specifically, as indicated by a reference signal "L1" in FIG. 29D, when the distance on the first paper sheet P1 from the portion thereof held at the nip of the second pair of conveying rollers 6 to the trailing edge thereof becomes equal to the distance on the second paper sheet P2 from the portion thereof held at the nip of the second pair of conveying rollers 6 to the trailing edge thereof, the status of the second pair of conveying rollers 6 is switched from the separation mode to the contact mode so that the first and second paper sheets P1 and P2 can be conveyed while being held by the second pair of conveying rollers 6.

According to the above-described procedures, even when the paper size of the first and second paper sheets P1 and P2 are different from each other, the first and second paper sheets P1 and P2 can be conveyed to the staple tray 14 with the trailing edges of the first and second paper sheets P1 and P2 being aligned. Thereby, the staple tray 14 can perform the sheet finishing process with the trailing edges aligned even when a large size sheet to be knocked by the knock roller 14*a* is placed over a small size sheet.

Further, the first paper sheet P1 temporarily stored in the prestack path 2*d* is conveyed according to the rotations of the second pair of conveying rollers 6. Thereby, the sheet conveying device 50 can reduce if not eliminate the need for the conveying members conventionally used in the prestack path 2*d*.

Figure 29D:
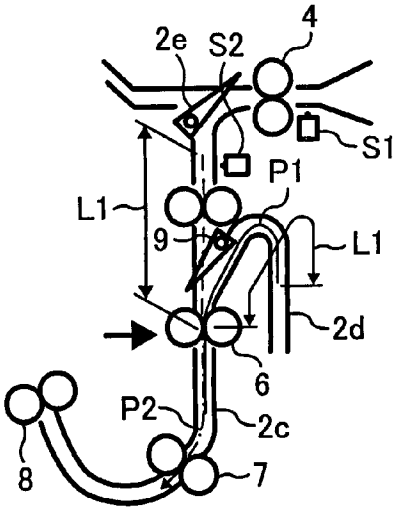
Figure 30A:
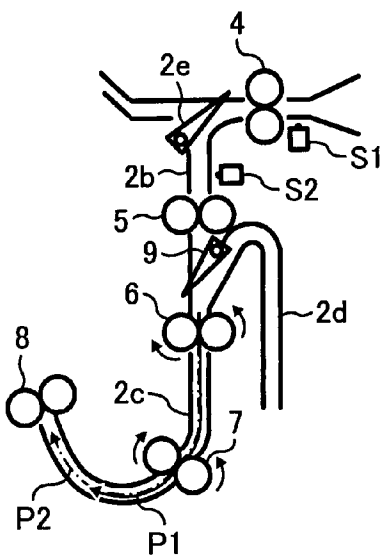
FIGS. 30A through 30D are cross sectional views and different sheet conveying operations performed by the sheet conveying device according to an example embodiment of the present invention.

FIGS. 30A through 30D show sheet conveying operations of the sheet conveying device 50 according to Case 2. The sheet conveying operations described referring to FIG. 30A is continued from the sheet conveying operation shown in FIG. 29D.

Figure 30B:
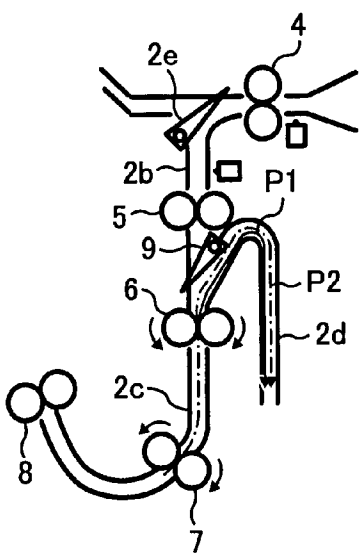

The first and second paper sheets P1 and P2 with the trailing edges being aligned are sandwiched together by the second and third pairs of conveying rollers 6 and 7 and conveyed in the forward direction in the second lower sheet conveying path 2*c* as shown in FIG. 30A. The second and third pairs of conveying rollers 6 and 7 are then stopped and rotated in the backward direction so that the first and second paper sheets P1 and P2 are temporarily stored into the prestack path 2*d* as shown in FIG. 30B.

Figure 30C:
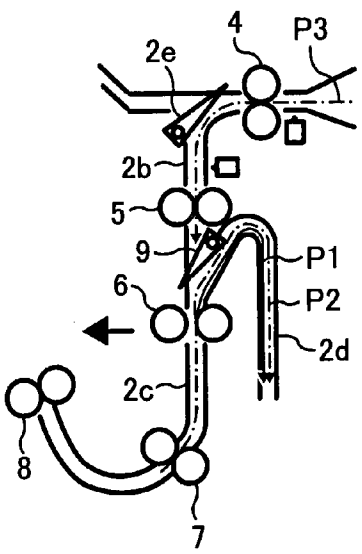

While the first and second paper sheets P1 and P2 are being stored in the prestack path 2*d*, a third paper sheet P3 that has a same size as the second paper sheet P2 is conveyed into the second lower sheet conveying path 2*c*. At this time, the status of the second pair of conveying rollers 6 is switched to the separation mode, and the third paper sheet P3 is conveyed, as shown in FIG. 30C.

Figure 30D:
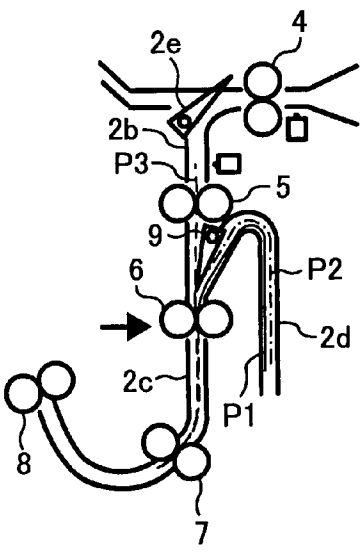

When the sheet detection sensor S2 detects the trailing edge of the third paper sheet P3, the timing to align the leading edge of the third paper sheet P3 with the leading edge of the second paper sheet P2 is calculated based on the detection timing in which the sheet detection sensor S2 detected the trailing edge of the third paper sheet P3. In synchronization with the aligning timing, the status of the second pair of conveying rollers 6 is switched to the contact mode. Thus, the first, second, and third paper sheets P1, P2, and P3 are conveyed together to the staple tray 14 with the trailing edges thereof being aligned, as shown in FIG. 30D.

Figure 31:
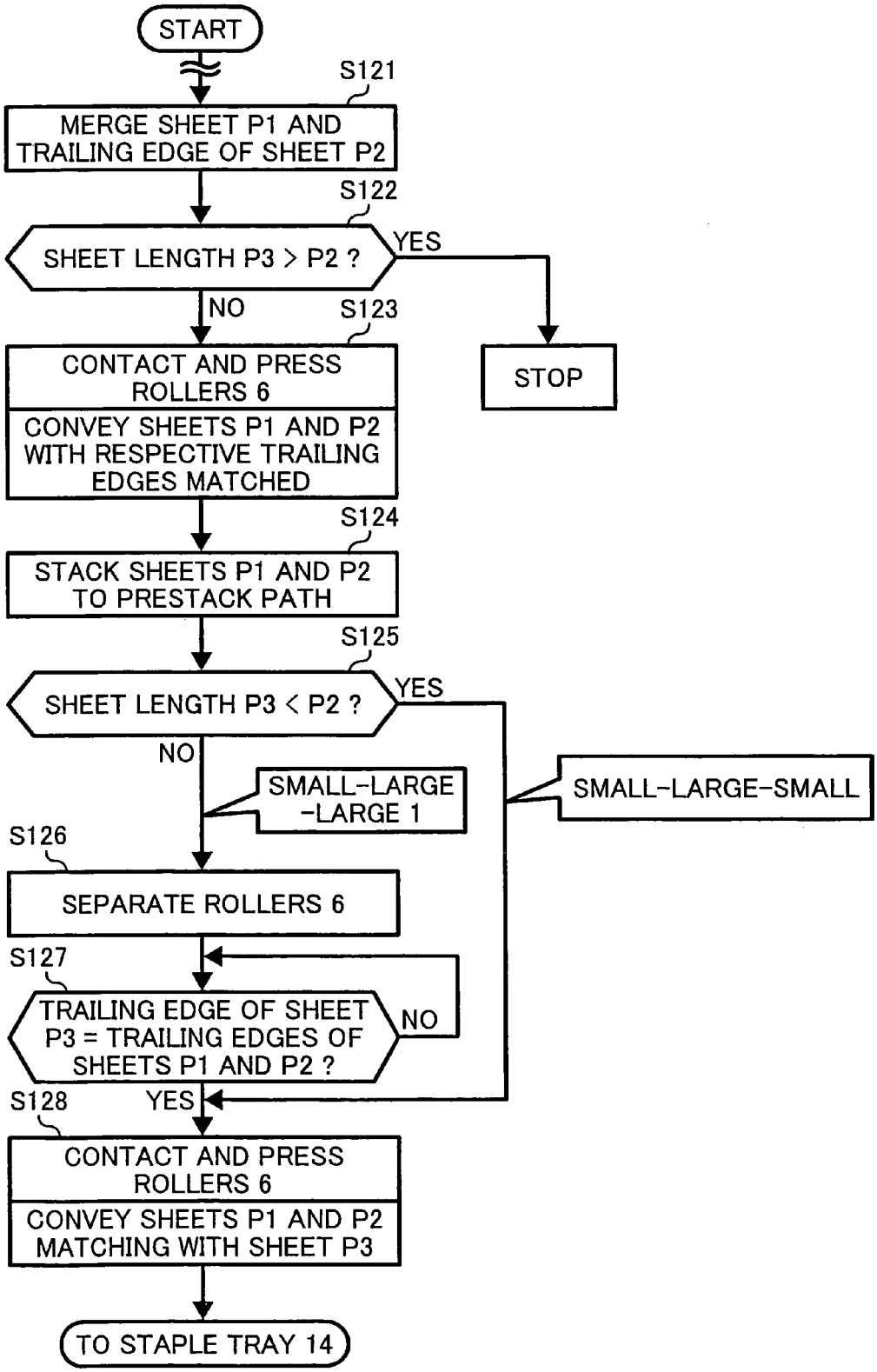
FIG. 31 is a flowchart showing a procedure of the sheet conveying operations corresponding to FIGS. 30A through 30D, according to an example embodiment of the present invention.

Steps performed according to the above-described Case 2 are indicated as "Small-Large-Large 1" in the flowchart of FIG. 31.

FIG. 31 is a flowchart showing a procedure of the sheet conveying operations, corresponding to FIGS. 30A through 30D.

The processes of steps S121 through S124 in the flowchart of FIG. 31 are performed for the first and second paper sheets P1 and P2, corresponding to the operation shown in FIG. 30A.

In step S121, the respective trailing edges of the first and second paper sheets P1 and P2 are aligned, and the process proceeds to step S122.

In step S122, the CPU 32 determines whether the length of the third paper sheet P3 in the sheet conveying direction is greater than the second paper sheet P2 based on the information from the image forming apparatus 1. When the length of the third paper sheet P3 is greater than the second paper sheet P2, the result of step S122 is YES, and the CPU 32 temporarily holds the sheet conveying operation. When the length of the third paper sheet P3 is equal to or shorter than the second paper sheet P2, the result of the step S122 is NO, and the process goes to step S123.

In step S123, the status of the second pair of conveying rollers 6 is switched to the contact mode. The second pair of conveying rollers 6 conveys the first and second paper sheets P1 and P2 with the trailing edges thereof being aligned in the forward direction in step S123, then in the backward direction to be temporarily stored in the prestack path 2*d* in step S124, and the process proceeds to step S125.

In step S125, the CPU 32 determines whether the length of the third paper sheet P3 in the sheet conveying direction is smaller than the second paper sheet P2 when the third paper sheet P3 is conveyed into the second lower sheet conveying path 2*c*. When the length of the third paper sheet P3 is smaller than the second paper sheet P2, the result of step S125 is YES, and the process goes to step S128. This process corresponds to the sheet conveying operations according to Case 3. When the length of the third paper sheet P3 is equal to or greater than the second paper sheet P2, the result of step S125 is NO, and the process proceeds to step S126. This process corresponds to the sheet conveying operations according to Case 2.

In step S126, the status of the second pair of conveying rollers 6 is switched to the separation mode, and the process proceeds to step S127. This process corresponds to the sheet conveying operation shown in FIG. 30C.

In step S127, the CPU 32 determines a timing to align the trailing edges of the first, second, and third paper sheets P1, P2, and P3. That is, the CPU 32 determines whether the position of the trailing edge of the third paper sheet P3 has reached the position of the trailing edges of the first and second paper sheets P1 and P2. When the position of the trailing edge of the third paper sheet P3 has become equal to the position of the trailing edges of the first and second paper sheets P1 and P2, the result of step S127 is YES, and the process proceeds to step S128. When the position of the trailing edge of the third paper sheet P3 has not reached the position of the trailing edges of the first and second paper sheets P1 and P2, the result of step S127 is NO, and the process repeats the procedure until the result of step S127 becomes YES.

In step S128, the status of the second pair of conveying rollers 6 is switched to the contact mode to convey the first, second, and third papers P1, P2, and P3 together with the trailing edges thereof being aligned. The process corresponds to the sheet conveying operation shown in FIG. 30D.

Figure 32A:
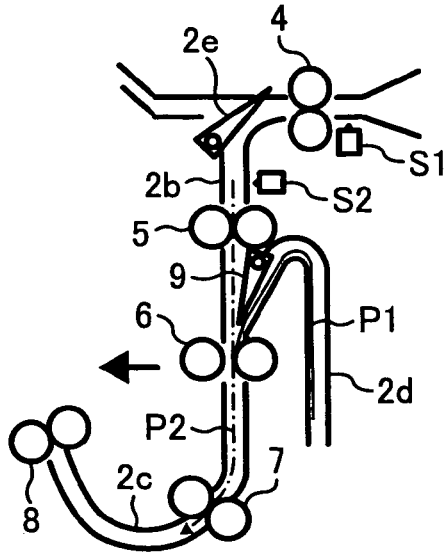
FIGS. 32A and 32B are cross sectional views and different sheet conveying operations performed by the sheet conveying device according to an example embodiment of the present invention.
Figure 32B:
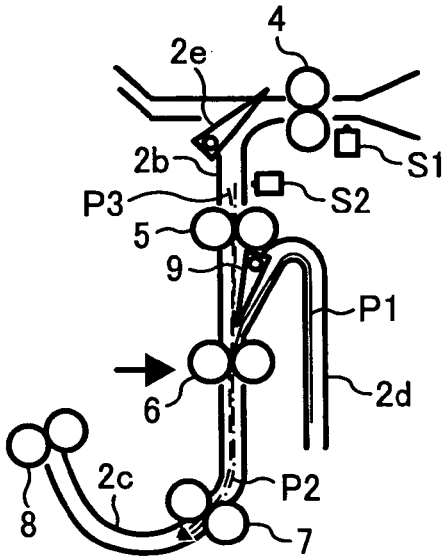

As an alternative to the above-described procedure of the sheet conveying operations shown in FIGS. 30A through 30D, a different procedure of the sheet conveying operations can be applied to one or more example embodiments of the present invention, as shown in FIGS. 32A and 32B.

As previously described in FIGS. 30A through 30D, the first paper sheet P1 of a small size and the second paper sheet P2 of a large size are temporarily stored together in the prestack path 2*d*. In FIGS. 32A and 32B, the second paper sheet P2 remains in the second lower sheet conveying path 2*c* instead of being conveyed to the prestack path 2*d*, which is the same status as shown in FIG. 29D.

More specifically, the status of the second pair of conveying rollers 6 is not switched to the contact mode when the distance on the first paper sheet P1 of a small size from the portion thereof held at the nip of the second pair of conveying rollers 6 to the trailing edge thereof becomes equal to the distance on the second paper sheet P2 of a large size from the portion thereof held at the nip of the second pair of conveying rollers 6 to the trailing edge thereof, as shown in FIG. 32A. With the above-described condition, the third paper sheet P3 of a large size that is same as the second paper sheet P2 is conveyed to the second lower sheet conveying path 2*c*. When the position of the leading edge of the third paper sheet P3 meets the position of the leading edge of the second paper sheet P2, the status of the second pair of conveying rollers 6 is switched to the contact mode to convey the first, second, and third papers P1, P2, and P3 together to the staple tray 14 with the trailing edges thereof being aligned, as shown in FIG. 32B.

Figure 33:
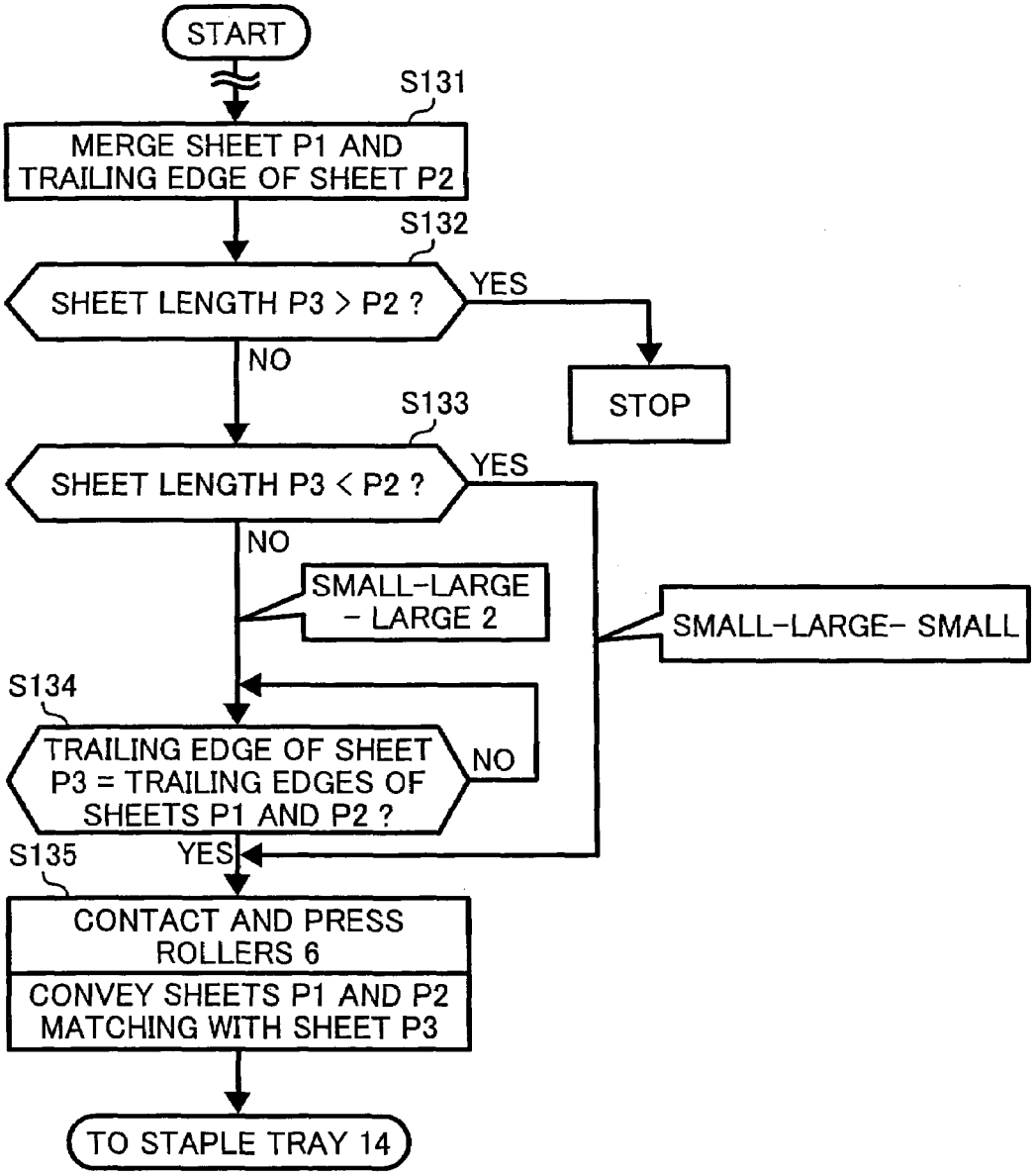
FIG. 33 is a flowchart showing a procedure of the sheet conveying operations corresponding to FIGS. 32A through 32B, according to an example embodiment of the present invention.

Steps performed according to the above-described Case 2 are indicated as "Small-Large-Large 2" in the flowchart of FIG. 33.

FIG. 33 is a flowchart showing a procedure of the sheet conveying operations, corresponding to FIGS. 32A and 32B.

In step S131, the respective trailing edges of the first and second paper sheets P1 and P2 are aligned and the status of the second pair of conveying rollers 6 remains in the separation mode, and the process proceeds to step S132.

In step S132, the CPU 32 determines whether the length of the third paper sheet P3 in the sheet conveying direction is greater than the second paper sheet P2 based on the information from the image forming apparatus 1. When the length of the third paper sheet P3 is greater than the second paper sheet P2, the result of step S132 is YES, and the CPU 32 temporarily holds the sheet conveying operation. When the length of the third paper sheet P3 is equal to or shorter than the second paper sheet P2, the result of the step S132 is NO, and the process goes to step S133.

In step S133, the CPU 32 determines whether the length of the third paper sheet P3 in the sheet conveying direction is smaller than the second paper sheet P2 when the third paper sheet P3 is conveyed into the second lower sheet conveying path 2*c*. When the length of the third paper sheet P3 is shorter than the second paper sheet P2, the result of step S133 is YES, and the process goes to step S135. This process corresponds to the sheet conveying operations according to Case 3. When the length of the third paper sheet P3 is equal to or greater than the second paper sheet P2, the result of step S133 is NO, and the process proceeds to step S134. This process corresponds to the sheet conveying operations according to Case 2.

In step S134, the CPU 32 determines a timing to align the trailing edges of the first, second, and third paper sheets P1, P2, and P3. That is, the CPU 32 determines whether the position of the trailing edge of the third paper sheet P3 has reached the position of the trailing edges of the first and second paper sheets P1 and P2. When the position of the trailing edge of the third paper sheet P3 has become equal to the position of the trailing edges of the first and second paper sheets P1 and P2, the result of step S134 is YES, and the process proceeds to step S135. When the position of the trailing edge of the third paper sheet P3 has not reached the position of the trailing edges of the first and second paper sheets P1 and P2, the result of step S134 is NO, and the process repeats the procedure until the result of step S134 becomes YES.

In step S135, the status of the second pair of conveying rollers 6 is switched to the contact mode to convey the first, second, and third papers P1, P2, and P3 together with the trailing edges thereof being aligned. The process corresponds to the sheet conveying operation shown in FIG. 32B.

Figure 34A:
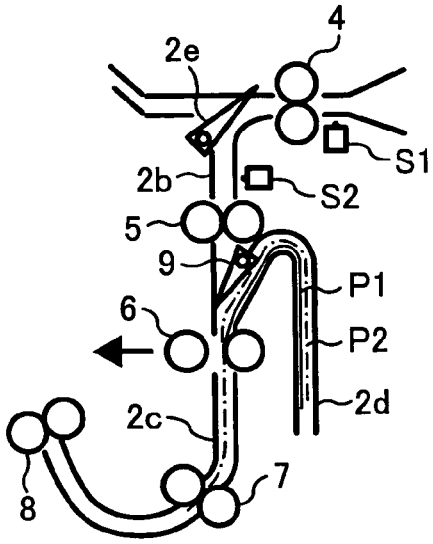
FIGS. 34A and 34B are cross sectional views and different sheet conveying operations performed by the sheet conveying device according to an example embodiment of the present invention.
Figure 34B:
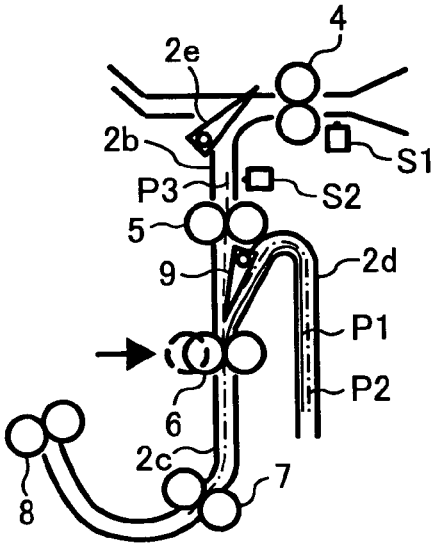

FIGS. 34A and 34B show sheet conveying operations of the sheet conveying device 50 according to Case 3.

The first paper sheet P1 of a small size and the second paper sheet P2 of a large size are temporarily stored in the prestack path 2*d* with the trailing edges thereof being aligned, as shown in FIG. 34A.

When the third paper sheet P3 of a small size that is same as the first paper sheet P1 is conveyed to the second lower sheet conveying path 2*c*, the status of the second pair of conveying rollers 6 is switched to the contact mode at the timing in which the leading edge of the first paper sheet P1 stored in the prestack path 2*d* is aligned with the leading edge of the third paper sheet P3. Thereby, the first, second, and third paper sheets P1, P2, and P3 are conveyed together to the staple tray 14 with the trailing edges thereof being aligned, as shown in FIG. 34B.

Steps performed in the above-described Case 3 are indicated as "Small-Large-Small" in the flowchart of FIGS. 31 and 33.

FIGS. 35A through 35H show sheet conveying operations of the sheet conveying device 50 according to Case 4.

Figure 35A:
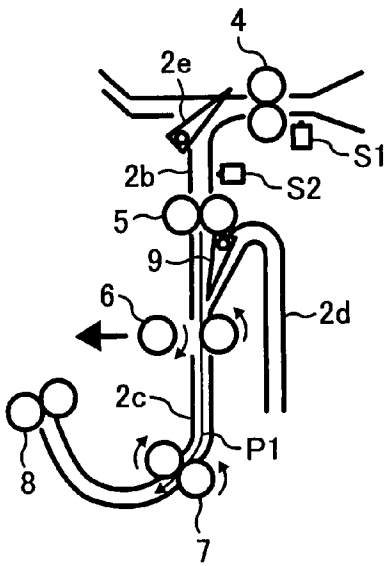
FIGS. 35A through 35H are cross sectional views and different sheet conveying operations performed by the sheet conveying device according to an example embodiment of the present invention.
Figure 35B:
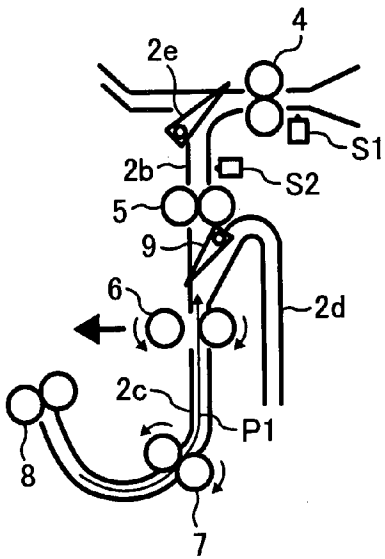
Figure 35C:
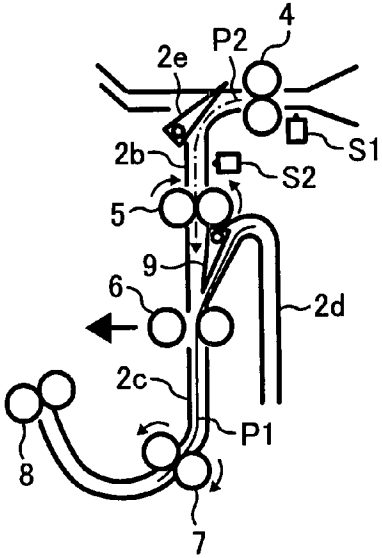

When the first paper sheet P1 of a large size is conveyed to the second lower sheet conveying path 2*c*, the status of the second pair of conveying rollers 6 stays in the contact mode until the trailing edge of the first paper P1 comes close to the second pair of conveying rollers 6. When the leading edge of the first paper sheet P1 is sandwiched or held at the nip of the third pairs of conveying rollers 7 and the trailing edge of the first paper sheet P1 passes the path selector 9, the status of the second pair of conveying rollers 6 is switched to the separation mode, as shown in FIG. 35A. The third pairs of conveying rollers 7 is then rotated in the backward direction to convey the first paper sheet P1 to the prestack path 2*d*, as shown in FIG. 35B, while the second paper sheet P2 is conveyed into the second lower sheet conveying path 2*c*, as shown in FIG. 35C.

The specific amount of distance of the trailing edge of the first paper sheet P1 to be temporarily stored in the prestack path 2*d* is determined such that the distance on the first paper sheet P1 from the portion thereof held at the nip of the second pair of conveying rollers 6 to the trailing edge thereof becomes equal to the distance on the second paper sheet P2 from the portion thereof held at the nip of the second pair of conveying rollers 6 to the trailing edge thereof.

The specified amount of the trailing edge of the first paper sheet P1 to be temporarily store in the prestack path 2*d* in an example embodiment is determined as follows. It is assumed that the length of the present paper sheet P1 of a large size in the sheet conveying direction is defined to be approximately 420 mm that is the length of an A3-size paper in the portrait direction and the length of the second paper sheet P2 of a small size in the sheet conveying direction is defined to be approximately 210 mm that is the length of an A4-size paper in the landscape direction. Under the above-described condition in the present example embodiment, the specified amount of distance of the trailing edge of the first paper sheet P1 to be temporarily stored is equal to the distance from the nip of the second pair of conveying rollers 6 to the trailing edge of the first paper sheet P1, which is approximately 210 mm, and the leading edge of the first paper sheet P1 remains to be sandwiched by the third pairs of conveying rollers 7 in the contact mode.

Figure 35D:
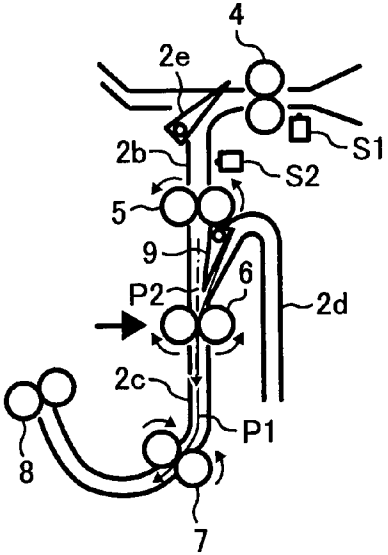
Figure 35E:
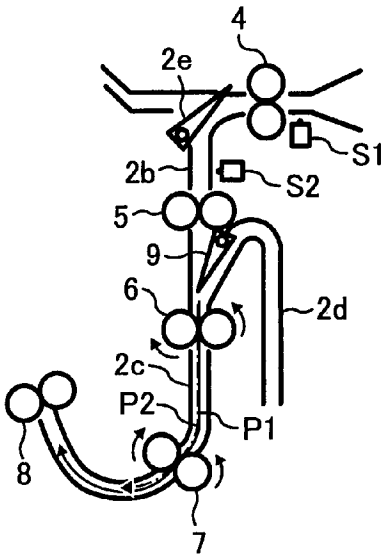

The status of the second pair of conveying rollers 6 is switched to the contact mode when the trailing edge of the first paper sheet P1 of a large size and the trailing edge of the second paper sheet P2 of a small size are aligned, as shown in FIG. 35D. Then, the second and third pairs of conveying rollers 6 and 7 may convey the first and second paper sheet P1 and P2 together to the second lower sheet conveying path 2*c*, as shown in FIG. 35E.

Figure 35F:
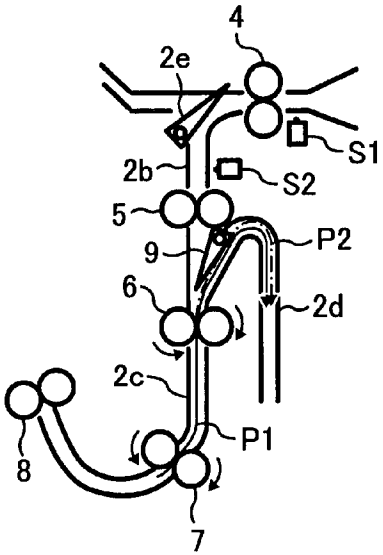

When the trailing edges of the first and second paper sheets P1 and P2 come to the nip of the second pair of conveying rollers 6, the rotation direction of the second and third pairs of conveying rollers 6 and 7 is switched to rotate in the backward direction to convey the first and second paper sheets P1 and P2 to the prestack path 2*d*, as shown in FIG. 35F.

Figure 35G:
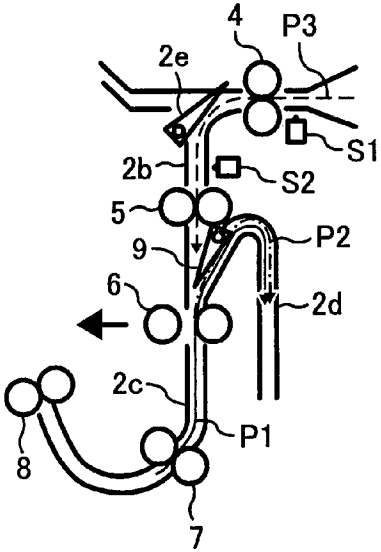

The first and second paper sheets P1 and P2 are conveyed to the prestack path 2*d* by a distance corresponding to the amount of the leading edge of the first paper sheet P1 of a large size to be sandwiched by the nip of the third pair of conveying rollers 7. When the third paper sheet P3 of a large size that is same as the first paper sheet P1 is conveyed to the second lower sheet conveying path 2*c*, the status of the second pair of conveying rollers 6 is switched to the separation mode, as shown in FIG. 35G.

Figure 35H:
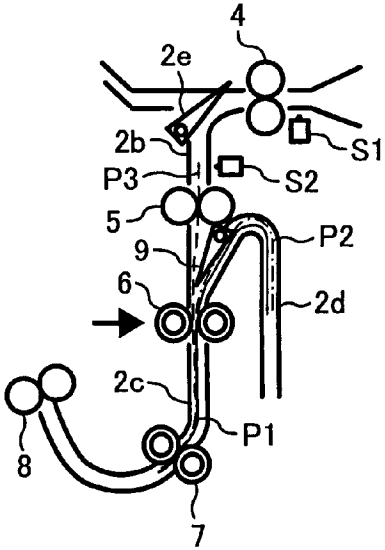

The status of the second pair of conveying rollers 6 is then switched to the contact mode in synchronization with the movement that the leading edge of the third paper sheet P3 reaches the nip of the third pair of conveying rollers 7. Thus, the first, second, and third paper sheets P1, P2, and P3 are conveyed together to the staple tray 14, as shown in FIG. 35H.

Figure 36A:
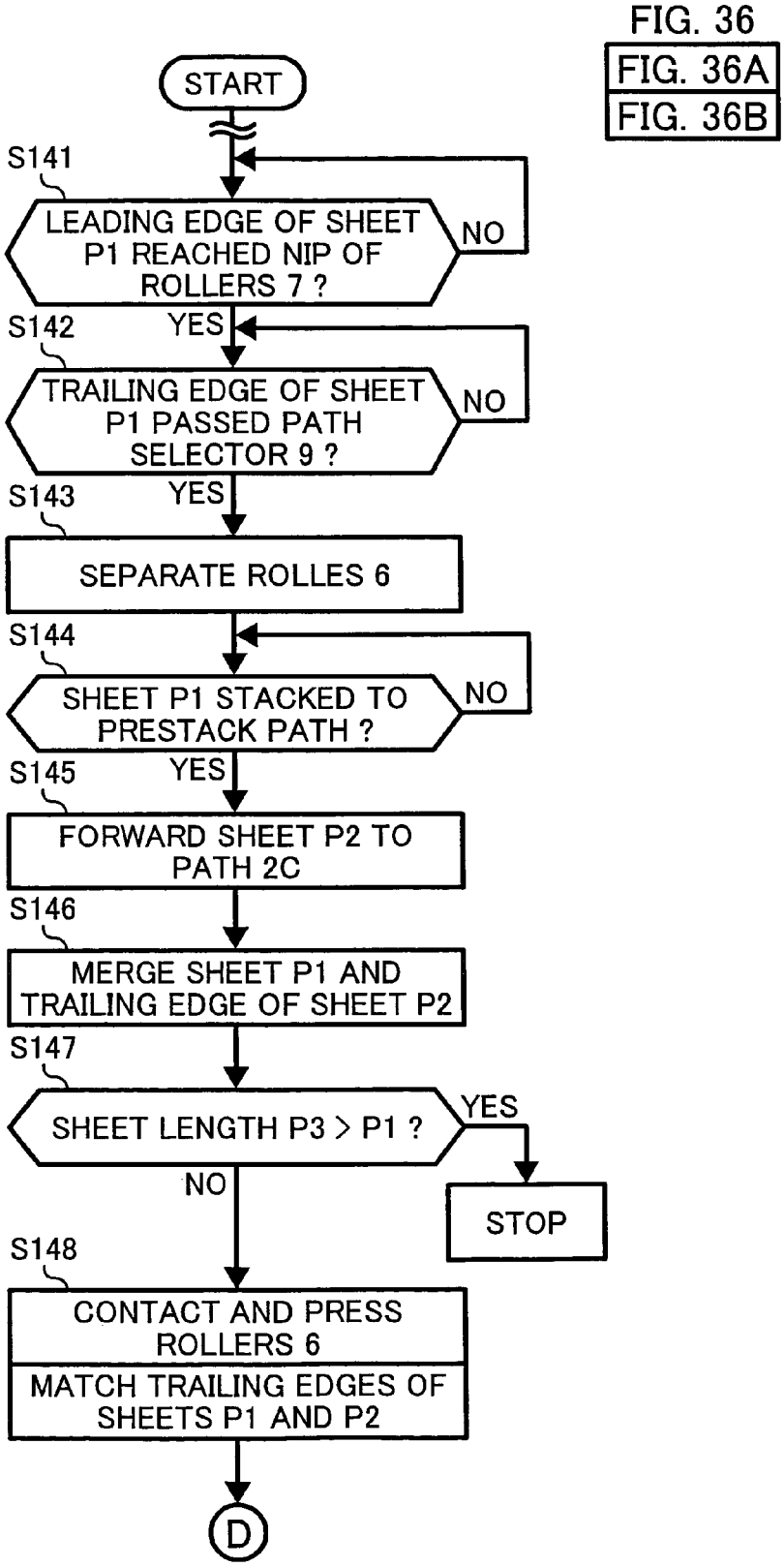
FIGS. 36A and 36B are flowcharts showing a procedure of the sheet conveying operations corresponding to FIGS. 35A through 35H, according to an example embodiment of the present invention.
Figure 36B:
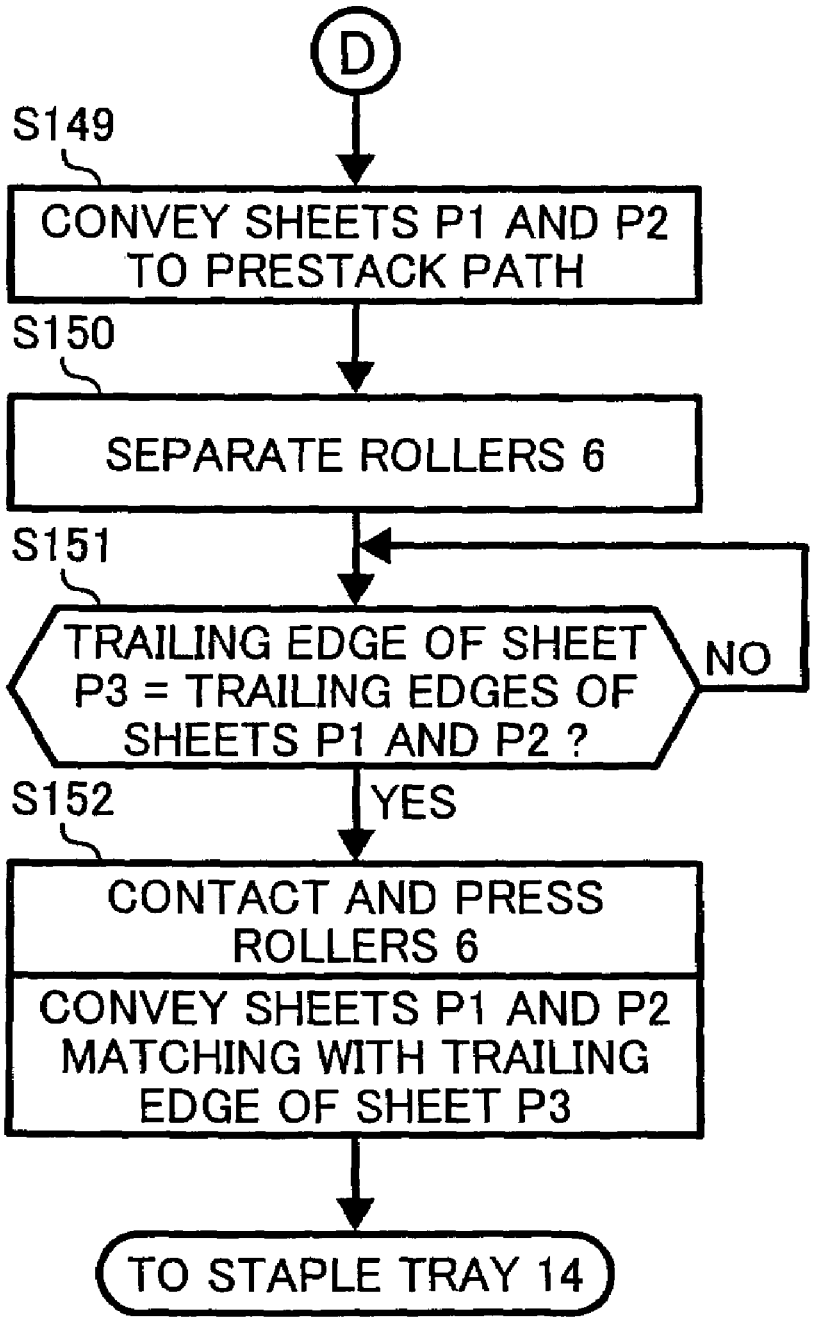

FIGS. 36A and 36B are flowcharts showing a procedure of the sheet conveying operations, corresponding to FIGS. 35A through 35H.

In step S141, the CPU 32 determines whether the leading edge of the first paper sheet P1 of a large size has reached the nip of the third pair of conveying rollers 7. When the leading edge of the first paper sheet P1 has not reached the nip of the third pair of conveying rollers 7, the result of step S141 is NO, and the process repeats the procedure until the result of step S141 becomes YES. When the leading edge of the first paper sheet P1 has reached the nip of the third pair of conveying rollers 7, the result of step S141 is YES, and the process proceeds to step S142.

In step S142, the CPU 32 determines whether the trailing edge of the first paper sheet P1 of a large size has passed the path selector 9. When the trailing edge of the first paper sheet P1 has not passed the path selector 9, the result of step S142 is NO, and the process repeats the procedure until the result of step S142 becomes YES. When the trailing edge of the first paper sheet P1 has not passed the path selector 9, the result of step S142 is YES, and the process proceeds to step S143.

In step S143, the status of the second pair of conveying rollers 6 is switched to the separation mode, and the process goes to step S144.

In step S144, the CPU 32 determines whether the first paper sheet P1 has temporarily been stored to the prestack path 2*d*. The determination is confirmed when the specified amount of distance of the first paper sheet P1 in the sheet conveying direction is stored in the prestack path 2*d*. More specifically, when the trailing edge of the first paper sheet P1 of a large size passed the path selector 9, the third pair of conveying rollers 7 started to rotate in the backward direction to convey the first paper sheet P1 to the prestack path 2*d*. In this case, when the trailing edge of the first paper sheet P1 stored in the prestack path 2*d* reached the specific amount of distance to be stored, the CPU 32 confirms that the first paper sheet P1 has stored in the prestack path 2*d*.

When the first paper sheet P1 has temporarily been stored in the prestack path 2*d*, the result of step S144 is YES, and the process proceeds to step S145. When the first paper sheet P1 has not temporarily been stored to the prestack path 2*d* yet, the result of step S144 is NO, the process repeats the procedure until the result of step S144 becomes YES.

After the second paper sheet P2 of a small size is conveyed to the second lower sheet conveying path 2*c* in step S145, the status of the second pair of conveying rollers 6 is switched to the contact mode in synchronization with the movement that the length on the second paper sheet P2 from the trailing edge thereof to the nip of the second pair of conveying rollers 6 is aligned with the length on the first paper sheet P1 from the trailing edge thereof of to the nip of the second pair of conveying rollers 6 in step S146, and the process proceeds to step S147. The processes correspond to the sheet conveying operation shown in FIG. 35D.

In step S147, the CPU 32 determines whether the length of the third paper sheet P3 in the sheet conveying direction is greater than the first paper sheet P1 based on the signal sent from the operation panel 201. When the length of the third paper sheet P3 is greater than the first paper sheet P1, the third paper sheet P3 has the same size as the second paper sheet P2, the result of step S147 is YES, and the process goes to step S148. When the length of the third paper sheet P3 is equal to or shorter than the first paper sheet P1, the result of the step S147 is NO, and the CPU 32 temporarily holds the sheet conveying operation.

In step S148, the status of the second pair of conveying rollers 6 is switched to the contact mode, and the second pair of conveying rollers 6 conveys the first and second paper sheets P1 and P2 with the trailing edges thereof being aligned in the forward direction. Then, in step S149, the second and third pairs of conveying rollers 6 and 7 are rotated in the backward direction to temporarily store the first and second paper sheets P1 and P2 into the prestack path 2*d*, and the process proceeds to step S150. The process corresponds to the sheet conveying operations shown in FIGS. 35E and 35F.

In step S150, the status of the second pair of conveying rollers 6 is switched to the separation mode while the first and second paper sheets P1 and P2 are temporarily stored in the prestack path 2*d* so that the third paper sheet P3 of a large size can be conveyed to the second lower sheet conveying path 2*c*. Then, the process proceeds to step S151.

In step S151, the CPU 32 determines a timing to align the trailing edges of the first, second, and third paper sheets P1, P2, and P3. That is, the CPU 32 determines whether the position of the trailing edge of the third paper sheet P3 has reached the position of the trailing edges of the first and second paper sheets P1 and P2. When the position of the trailing edge of the third paper sheet P3 has become equal to the position of the trailing edges of the first and second paper sheets P1 and P2, the result of step S151 is YES, and the process proceeds to step S152. When the position of the trailing edge of the third paper sheet P3 has not reached the position of the trailing edges of the first and second paper sheets P1 and P2, the result of step S151 is NO, and the process repeats the procedure until the result of step S151 becomes YES.

In step S152, the status of the second pair of conveying rollers 6 is switched to the contact mode to convey the first, second, and third paper sheets P1, P2, and P3 together with the trailing edges thereof being aligned. The process corresponds to the sheet conveying operations shown in FIG. 35H.

When the first paper sheet P1 is conveyed to the second lower sheet conveying path 2*c*, the status of the second pair of conveying rollers 6 is set to the separation mode in FIGS. 35A through 35C. As an alternative, the trailing edges of the first, second, and third papers P1, P2, and P3 can be aligned when the status of the second pair of conveying rollers 6 is set to the contact mode. However, since the second pair of conveying rollers 6 is rotated in the backward direction as soon as the second paper sheet P2 reaches the nip of the second pair of conveying rollers 6, a misregistration in positioning the trailing edges of the first and second paper sheets P1 and P2 and an increase of the controls due to accuracy of the contact and separation operation can incur. Therefore, the status of the second pair of conveying rollers 6 is better to stay in the separation mode.

Further, in the present example embodiment of the present invention, the sheet conveying device 50 can handle two different types of paper sheets, which are the first paper sheet P1 of a large size and the second paper sheet P2 of a small size, and one additional paper sheet having a size same as one of the two different types of paper sheets, which is the third paper sheet P3. However, the sheet conveying device 50 of the present invention can repeat operations for two different types of paper sheets or can handle four or more different types of paper sheets.

Further, in the present example embodiment of the present invention, the sheet conveying device 50 can perform the above-described cases in combination so that three or more paper sheets can be temporarily stored in the prestack path 2*d*.

For example, it is assumed that a fourth paper sheet P4 of a large size (not shown) is conveyed according to the procedure of Case 3.

When the third paper sheet P3 of a small size is conveyed to the second lower sheet conveying path 2*c*, the first and second paper sheets P1 and P2 that are temporarily stored in the prestack path 2*d* are conveyed to the second lower sheet conveying path 2*c* so that the first, second, and third paper sheets P1, P2, and P3 are piggybacked together. Then, the first, second, and third paper sheets P1, P2, and P3 are switched-back together to the prestack path 2*d*. At this time, the trailing edges of the first, second, and third paper sheets P1, P2, and P3 are aligned. Shortly, when the fourth paper sheet P4 of a large size is conveyed to the second lower sheet conveying path 2*c*, the fourth paper sheet P4 is piggybacked with the first, second, and third paper sheets P1, P2, and P3 at the timing in which the trailing edge of the fourth paper sheet P4 is aligned with the trailing edges of the first, second, and third paper sheets P1, P2, and P3. Thus, the first, second, third, and fourth paper sheets P1, P2, P3, and P4 can be conveyed together to the staple tray 14 with the trailing edges thereof being aligned.

According to the above-described operations, the sheet conveying device 50 of the present example embodiment can effectively align the trailing edges of sheets having different sizes, especially in the order of repeat of a small size and a large size, which is a difficult combination to align.

The components omitted to be described here have the same structures and functions in an example embodiment described above.

As described above, the sheet conveying device 50 according to the present example embodiment can switch the status of the second pair of conveying rollers 6 between the contact mode and the separation mode according to the size of a paper sheet to be conveyed. Thereby, the paper sheets of different sizes conveyed to the sheet conveying device 50 can be smoothly handled and the trailing edges of the paper sheets can be properly aligned.

Referring to FIGS. 37A through 41, a structure of the sheet conveying device 50 according to an example embodiment of the present invention is described.

When the sheet conveying device 50 has a structure in which a paper sheet can be conveyed to a backward conveying path such as the prestack path 2*d* as described in each of the above-described example embodiments, while a preceding paper sheet is being conveyed to the prestack path 2*d*, a following paper sheet cannot be conveyed to avoid a conflict with the preceding paper sheet. Therefore, the sheet conveying device 50 may take a substantially long time to temporarily store the preceding paper sheet in the prestack path 2*d*, which cannot reduce the period for the sheet conveying operation. When a plurality of paper sheets having different lengths in the sheet conveying direction are conveyed, the period of the sheet conveying operation may vary depending on the order of the plurality of paper sheet of different size. For example, the sheet conveying device 50 may take a longer time for conveying and storing a preceding paper sheet having a long length in the prestack path 2*d* than a preceding paper sheet having a short length. As a result, the above-described sheet conveying operation can increase the entire period of the sheet conveying operation.

To reduce if not eliminate the above-described inconvenience, the sheet conveying device 50 of the present example embodiment can reduce the standby time to increase efficiency of the sheet conveying operation even when a preceding paper sheet has a longer length than a following paper sheet in the sheet conveying direction.

The general description of the sheet conveying device 50 of an example embodiment of the present invention has a similar structure and functions to those of the present example embodiment described above, and has the same control structure as shown in FIG. 28, except that the sheet conveying device 50 in the present example embodiment of the present invention is designed to reduce a period of time for the sheet finishing processes by effectively handling a stack of sheets with different sizes.

FIGS. 37A through 37D show sheet conveying operations of the sheet conveying device 50 according to an example embodiment of the present invention.

Figure 37A:
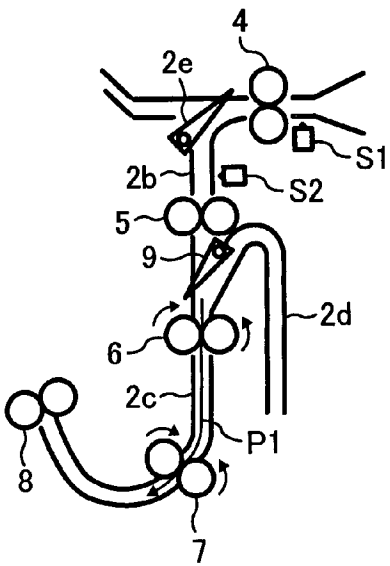
FIGS. 37A through 37D are cross sectional views and sheet conveying operations performed by the sheet conveying device according to an example embodiment of the present invention.
Figure 37B:
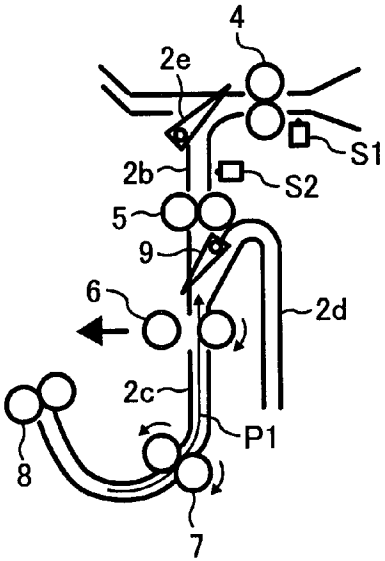

To convey the first paper sheet P1 of a large size to the second lower sheet conveying path 2*c*, the status of the second pair of conveying rollers 6 is set to the contact mode. When the first paper sheet P1 is conveyed and the leading edge thereof reaches the nip of the third pair of conveying rollers 7 as shown in FIG. 37A, the status of the second pair of conveying rollers 6 is then switched to the separation mode. The third pair of conveying rollers 7 is then rotated in the backward direction and the first paper sheet P1 in the second lower sheet conveying path 2*c* is conveyed toward the prestack path 2*d* so that a specific amount of the trailing edge of the first paper sheet P1 can be temporarily stored in the prestack path 2*d* as shown in FIG. 37B.

Figure 37C:
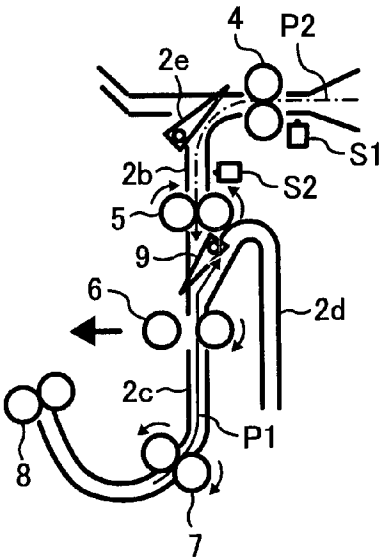

The sheet conveying device 50 starts to convey the second paper sheet P2 of a small size to the second lower sheet conveying path 2*c* in the process that the trailing edge of the first paper sheet P1 of a large size is conveyed to the prestack path 2*d* as shown in FIG. 37C. The second paper sheet P2 of a small size is conveyed to the second lower sheet conveying path 2*c* during a period from when the trailing edge of the first paper sheet P1 of a large size is conveying to the prestack path 2*d* to when the leading edge of the first paper sheet P1 can be held by the third pair of conveying rollers 7.

Figure 37D:
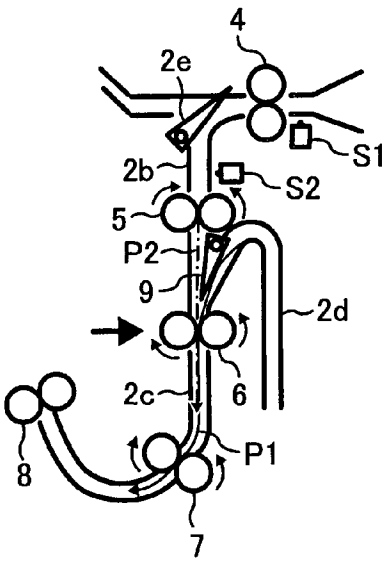

While the first paper sheet P1 is being conveyed to the prestack path 2*d*, the second paper sheet P2 is conveyed in the second lower sheet conveying path 2*c*. The first paper sheet P1 temporarily stored in the prestack path 2*d* is conveyed to the second lower sheet conveying path 2*c* when the trailing edges of the first and second paper sheets P1 and P2 are aligned. Thus, the first and second paper sheets P1 and P2 are conveyed to the second lower sheet conveying path 2*c* with the trailing edges thereof being aligned, as shown in FIG. 37D.

Figure 38:
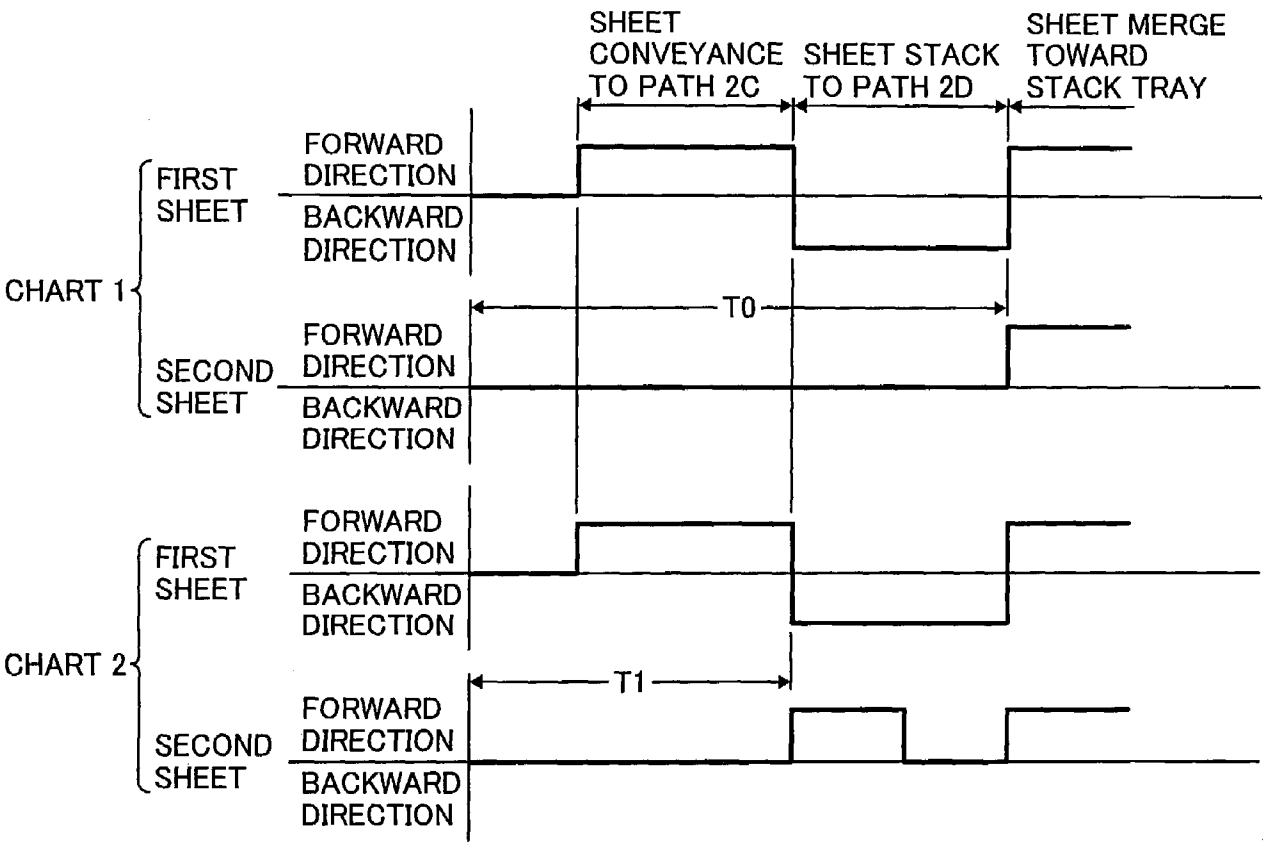
FIG. 38 is a timing chart showing operation timings of the sheet conveying operations corresponding to FIGS. 37A through 37D of the sheet conveying device according to an example embodiment of the present invention.

FIG. 38 shows a timing chart showing operation timings of the sheet conveying device 50 in FIGS. 37A through 37D. The "FORWARD ROTATION" and "BACKWARD ROTATION" in FIG. 38 indicate respective rotation directions of the second and third pairs of conveying rollers 6 and 7.

In FIG. 38, the first paper sheet P1 is conveyed into the second lower sheet conveying path 2*c*, then switched back to the prestack path 2*d*. In Chart 1 representing a conventional timing, a period in which the sheet conveying device 50 starts conveying the second paper sheet P2 to the second lower sheet conveying path 2*c* after the completion of the switchback of the first paper sheet P1 is set to a standby period "T0". On the other hand, in Chart 2 representing a time according to the present example embodiment, a period in which the sheet conveying device 50 starts conveying the second paper sheet 2 to the second lower sheet conveying path 2*c* when starting to convey the first paper sheet P1 to the prestack path 2*d* is set to a standby period "T1". As a result, the standby period "T1" of Chart 2 is shorter than the standby period "T0" of Chart 1 by a period "T0-T1". Thereby, the sheet conveying device 50 can reduce the standby period before the start of the second paper sheet P2.

Figure 39:
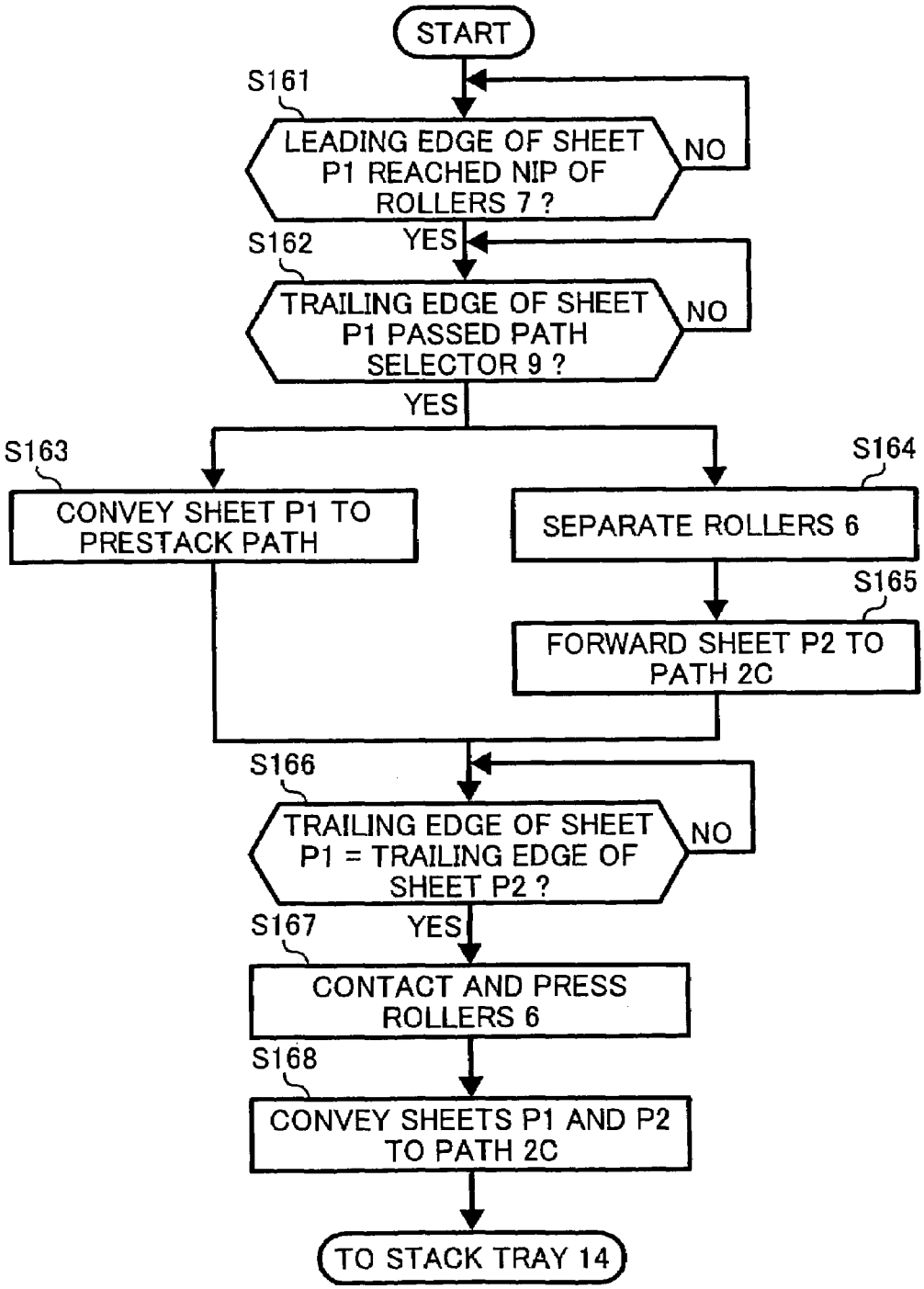
FIG. 39 is a flowchart showing a procedure of the sheet conveying operations corresponding to FIGS. 37A through 37D, according to an example embodiment of the present invention.

FIG. 39 is a flowchart showing a procedure of the sheet conveying operations, corresponding to FIGS. 37A through 37D.

In step S161, the CPU 32 determines whether the leading edge of the first paper sheet P1 of a large size has reached the nip of the third pair of conveying rollers 7. When the leading edge of the first paper sheet P1 has not reached the nip of the third pair of conveying rollers 7, the result of step S161 is NO, and the process repeats the procedure until the result of step S161 becomes YES. When the leading edge of the first paper sheet P1 has reached the nip of the third pair of conveying rollers 7, the result of step S161 is YES, and the process proceeds to step S162.

In step S162, the CPU 32 determines whether the trailing edge of the first paper sheet P1 of a large size has passed the path selector 9. When the trailing edge of the first paper sheet P1 has not passed the path selector 9, the result of step S162 is NO, and the process repeats the procedure until the result of step S162 becomes YES. When the trailing edge of the first paper sheet P1 has not passed the path selector 9, the result of step S162 is YES, and the process proceeds to step S163.

In step S163, the first paper sheet P1 is switched back to the prestack path 2*d*. In synchronization with the process of step S163, the status of the second pair of conveying rollers 6 is switched to the separation mode in step S164, the second paper sheet P2 of a small size is conveyed to the second lower sheet conveying path 2*c* in step S165, and the process goes to step S166.

In step S166, the CPU 32 determines a timing to align the trailing edges of the first and second paper sheets P1 and P2. That is, the CPU 32 determines whether the position of the trailing edge of the first paper sheet P1 has reached the position of the trailing edge of the second paper sheet P2. The determination is confirmed based on the paper size and the sheet conveyance speed. When the position of the trailing edge of the first paper sheet P1 has become equal to the position of the trailing edge of the second paper sheet P2, the result of step S166 is YES, and the process proceeds to step S167. When the position of the trailing edge of the first paper sheet P3 has not reached the position of the trailing edge of the second paper sheet P2, the result of step S166 is NO, and the process repeats the procedure until the result of step S166 becomes YES.

In step S167, the status of the second pair of conveying rollers 6 is switched to the contact mode when the trailing edges of the first and second paper sheets P1 and P2 are aligned, and the process proceeds to step S168.

In step S168, the first and second paper sheets P1 and P2 are sandwiched by the second pair of conveying rollers 6 and conveyed to the second lower sheet conveying path 2*c* toward the staple tray 14.

By overlapping the processing periods of the first and second paper sheets P1 and P2 as shown in the above-described operations (steps S163 through S165), the period of time before the start of the conveyance of the second paper sheet P2 can be reduced. Since the direction of the first paper sheet P1 to be switched back to the prestack path 2*d* is opposite to the direction of conveying the second paper sheet P2, the timing to align the trailing edges of the first and second paper sheets P1 and P2 can be obtained earlier. Thus, the distance of the trailing edge of the first paper sheet P1 to be temporarily stored in the prestack path 2*d* can be reduced.

Now, FIGS. 40A through 40G show sheet conveying operations of the sheet conveying device 50 for conveying three paper sheets of different sizes according to the present example embodiment of the present invention. In FIGS. 40A through 40G, the sizes or lengths of the first and second paper sheets P1 and P2 are same and the size of the third paper sheet P3 is smaller than the size or length of the first and second paper sheets P1 and P2.

Figure 40A:
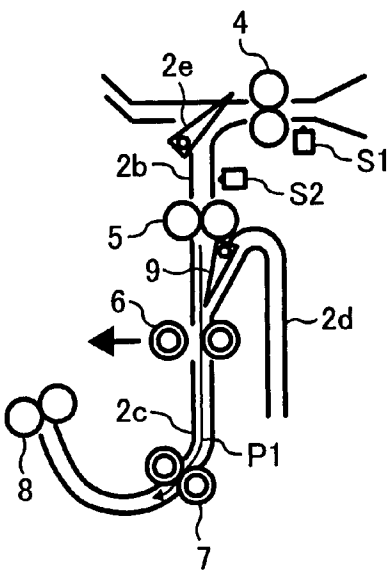
FIG. 40A through 40G are cross sectional views and different sheet conveying operations performed by the sheet conveying device according to an example embodiment of the present invention.
Figure 40B:
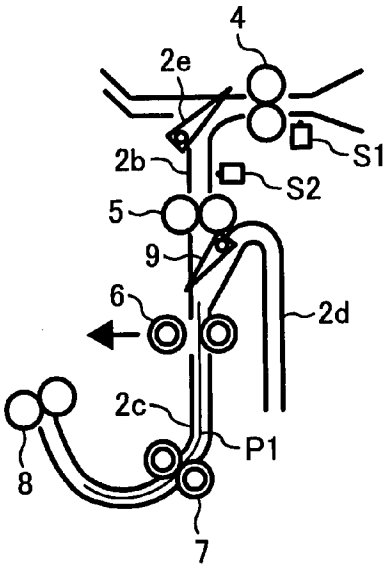

When the first paper sheet P1 of a large size is conveyed to the second lower sheet conveying path 2*c*, the status of the second pair of conveying rollers 6 stays in the contact mode until the trailing edge of the first paper P1 comes close to the second pair of conveying rollers 6. When the leading edge of the first paper sheet P1 is sandwiched or held at the nip of the third pairs of conveying rollers 7 and the trailing edge of the first paper sheet P1 passes the path selector 9, the status of the second pair of conveying rollers 6 is switched to the separation mode, as shown in FIG. 40A. The third pairs of conveying rollers 7 is then rotated in the backward direction to convey the first paper sheet P1 to the prestack path 2*d*, as shown in FIG. 40B.

Figure 40C:
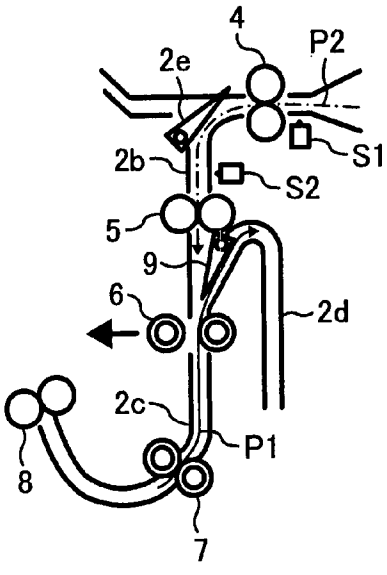

While the first paper sheet P1 is being conveyed to the prestack path 2*d*, the second paper sheet P2 of a large size that is same as the first paper sheet P1 is conveyed into the second lower sheet conveying path 2*c*, as shown in FIG. 40C.

Figure 40D:
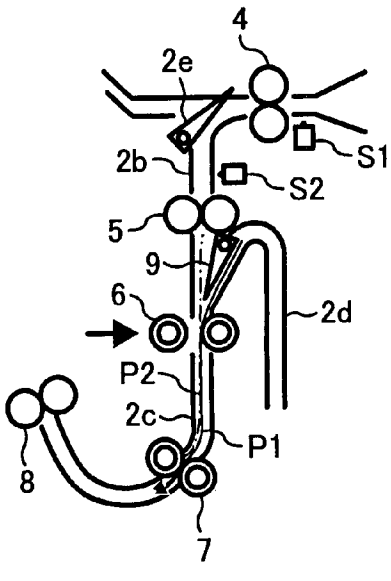

The status of the second pair of conveying rollers 6 is switched to the contact mode at the timing in which the leading edges of the first and second paper sheets P1 and P2 are aligned. With the leading edges of the first and second paper sheets P1 and P2 being aligned, the first and second paper sheets P1 and P2 are conveyed to the second lower sheet conveying path 2*c*, as shown in FIG. 40D.

Figure 40G:
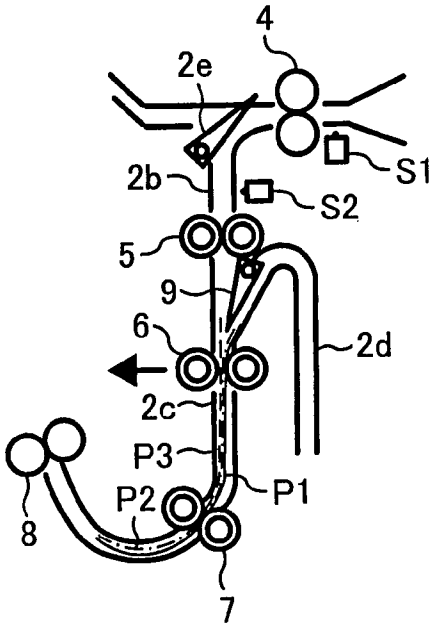
Figure 40F:
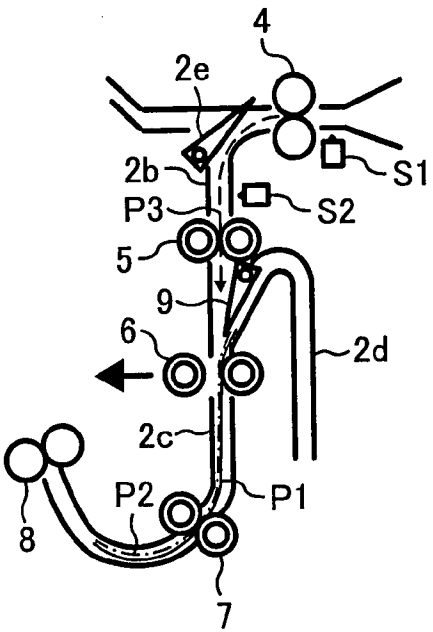
Figure 40E:
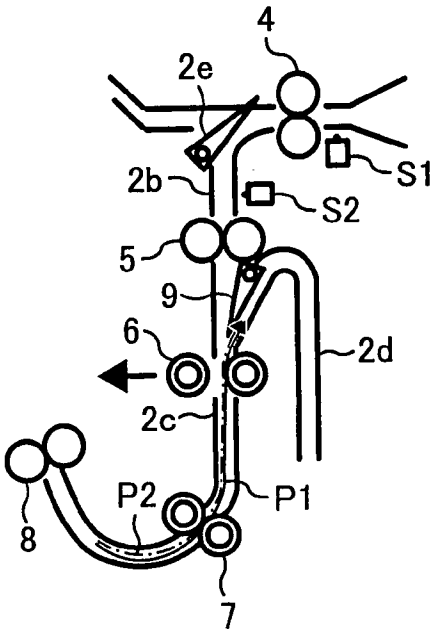

After the trailing edges of the first and second paper sheets P1 and P2 have passed the path selector 9 and reached in the vicinity of the second pair of conveying rollers 6, the status of the second pair of conveying rollers 6 is switched to the separation mode, as shown in FIG. 40E, and the third paper sheet P3 of a small size is conveyed in the second lower sheet conveying path 2*c*. Thereby, when the third paper sheet P3 is conveyed into the second lower sheet conveying path 2*c*, the sheet conveying operation of the third paper sheet P3 can be conveyed to the second lower sheet conveying path 2*c* without being interfered by the second pair of conveying rollers 6.

The third paper sheet P3 of a small size is conveyed in the second lower sheet conveying path 2*c* as shown in FIG. 40F. Then, the status of the second pair of conveying rollers 6 is switched to the contact mode at the timing in which the trailing edge of the third paper sheet P3 is aligned with the trailing edges of the first and second paper sheets P1 and P2, and the first, second, and third paper sheets are conveyed together in the second lower sheet conveying path 2*c* toward the staple tray 14, as shown in FIG. 40G.

Figure 41A:
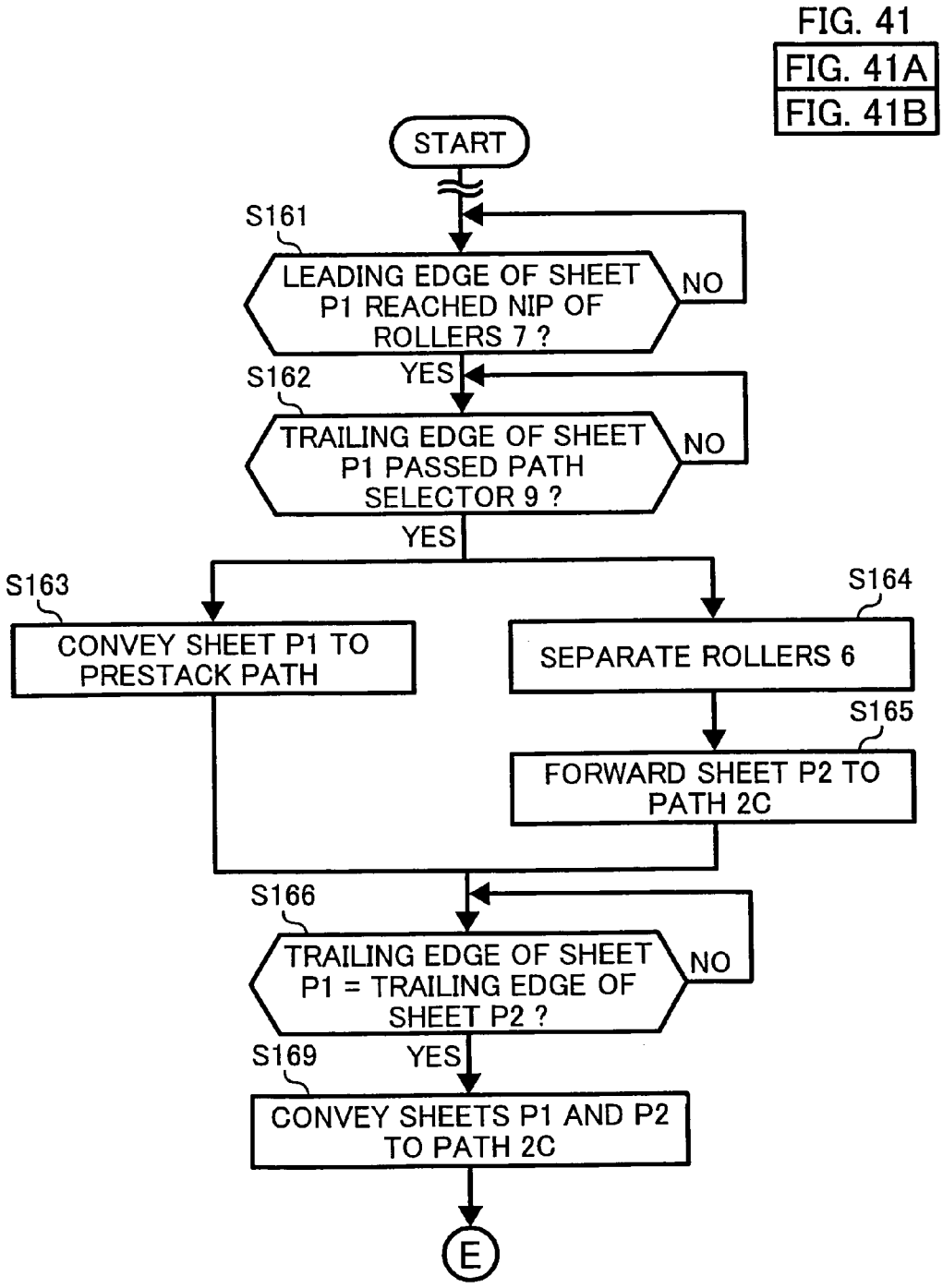
FIGS. 41A and 41B are flowcharts showing a procedure of the sheet conveying operations corresponding to FIGS. 40A through 40G, according to an example embodiment of the present invention.
Figure 41B:
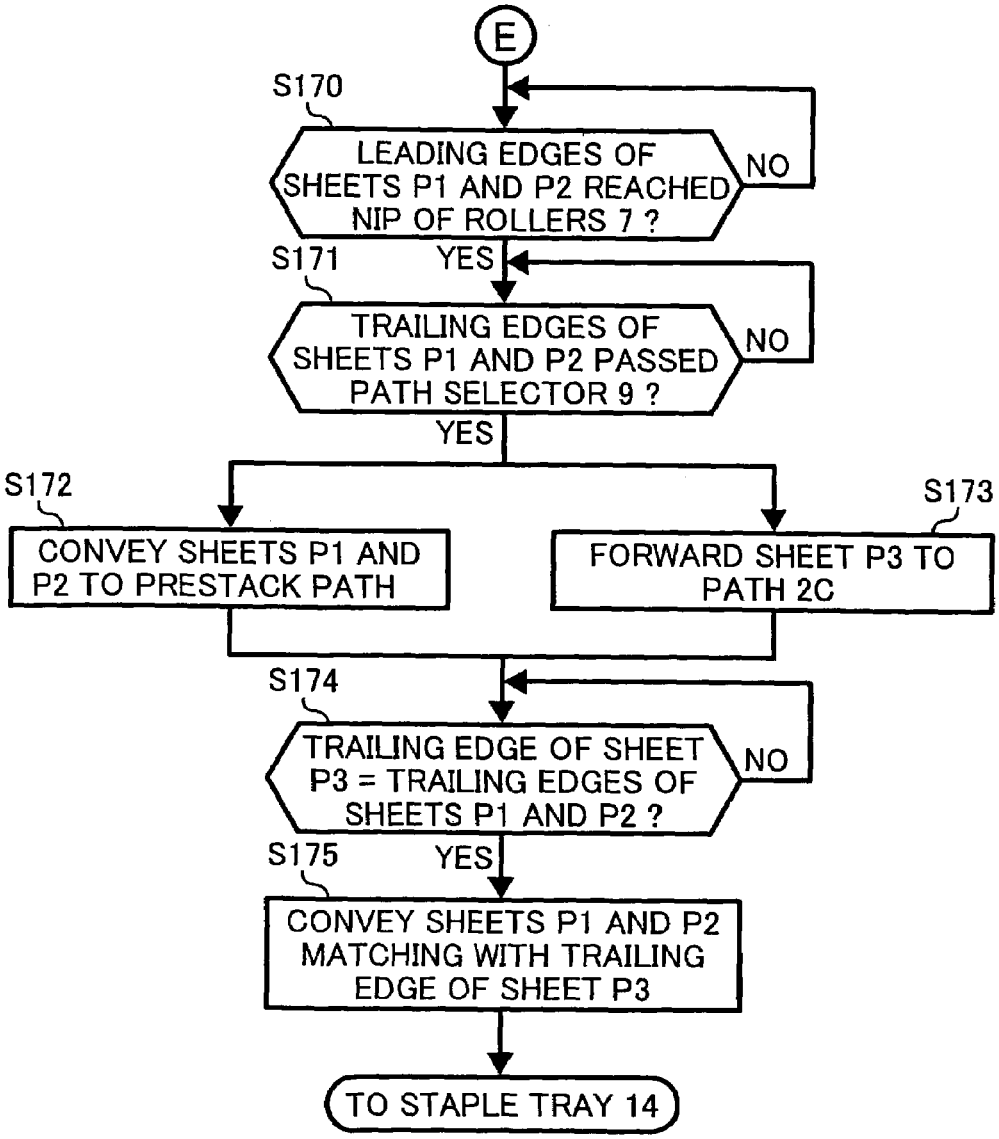

FIGS. 41A and 41B are flowcharts showing a procedure of the sheet conveying operations, corresponding to FIGS. 40A through 40G. The procedures of steps S161 through S166 are same as the procedures of steps S161 through S166 as shown in FIG. 39, therefore, the descriptions of these processes are omitted.

When the trailing edges of the first and second paper sheets P1 and P2 are aligned in step S166, the first and second paper sheets P1 and P2 are conveyed to the second lower sheet conveying path 2*c* in step S169, and the process proceeds to step S170.

In step S170, the CPU 32 determines whether the leading edges of the first and second paper sheets P1 and P2 have reached the nip of the third pair of conveying rollers 7. When the leading edges of the first and second paper sheets P1 and P2 have not reached the nip of the third pair of conveying rollers 7, the result of step S170 is NO, and the process repeats the procedure until the result of step S170 becomes YES. When the leading edges of the first and second paper sheets P1 and P2 have reached the nip of the third pair of conveying rollers 7, the result of step S170 is YES, and the process proceeds to step S171.

In step S171, the CPU 32 determines whether the trailing edges of the first and second paper sheets P1 and P2 have passed the path selector 9. When the trailing edges of the first and second paper sheets P1 and P2 have not passed the path selector 9, the result of step S171 is NO, and the process repeats the procedure until the result of step S171 becomes YES. When the trailing edges of the first and second paper sheets P1 and P2 have not passed the path selector 9, the result of step S171 is YES, and the process proceeds to step S172.

It is not shown in the flowcharts of FIGS. 41A and 41B, but when the first and second papers P1 and P2 are conveyed together into the second lower sheet conveying path 2*c*, the status of the second pair of conveying rollers 6 is switched to the contact mode.

In step S172, the first and second paper sheets P1 and P2 are switched back to the prestack path 2*d*. In synchronization with the process of step S172, the third paper sheet P3 of a small size is conveyed to the second lower sheet conveying path 2*c* in step S173, and the process goes to step S174.

In step S174, the CPU 32 determines a timing to align the trailing edges of the first, second, and third paper sheets P1, P2, and P3. That is, the CPU 32 determines whether the position of the trailing edges of the first and second paper sheets P1 and P2 has reached the position of the trailing edge of the third paper sheet P3. When the position of the trailing edges of the first and second paper sheets P1 and P2 has become equal to the position of the trailing edge of the third paper sheet P3, the result of step S174 is YES, and the process proceeds to step S175. When the position of the trailing edges of the first and second paper sheets P1 and P2 has not reached the position of the trailing edge of the third paper sheet P3, the result of step S174 is NO, and the process repeats the procedure until the result of step S174 becomes YES.

In step S175, the status of the second pair of conveying rollers 6 is switched to the contact mode to convey the first, second, and third papers P1, P2, and P3 together with the trailing edges thereof being aligned, to the second lower sheet conveying path 2*c*.

The components omitted to be described here have the same structures and functions as in an example embodiment described above.

As described above, the sheet conveying device 50 of an example embodiment can effectively perform the sheet conveying operation with paper sheets of different size by reducing the time interval of paper sheets to start the conveyance of a following paper sheet having the size smaller than a preceding paper sheet in the sheet conveying direction. Thus, the sheet conveying operations can be effectively performed.

The above-described example embodiments are illustrative, and numerous additional modifications and variations are possible in light of the above teachings. For example, elements and/or features of different example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed:

1. A sheet conveying device comprising:

a first conveying path configured to pass a recording medium (RM) sheet therethrough to a sheet processing device;

a second conveying path branched and separated from the first conveying path and configured to temporarily store the RM sheet conveyed therein;

a sheet conveying mechanism configured to selectably convey the RM sheet in one of forward and backward directions to the sheet processing device, the sheet conveying mechanism including a first pair of conveying rollers and a second pair of conveying rollers disposed at respective positions along the first conveying path;

a guide member mounted at a branch point of the first and second conveying paths and configured to guide the RM sheet when the RM sheet is conveyed in the backward direction by the sheet conveying mechanism to the second conveying path; and a control unit configured to control the sheet conveying mechanism based on a conveyed distance change between the branch point and the sheet conveying mechanism, which is according to a length of the RM sheet, wherein when the RM sheet is smaller than a predetermined size sheet:

the control unit causes the first pair of conveying rollers and the second pair of conveying rollers to convey a first RM sheet in the forward direction toward the sheet processing device, and after a trailing edge of the first RM sheet passes the guide member, the first RM sheet is conveyed in the backward direction to the second conveying path and is stopped while being held in a nip of the first pair of conveying rollers with a leading edge of the first RM sheet in the forward direction thereof extending towards a downstream side of the first pair of conveying rollers, and when a second RM sheet is sequentially conveyed, the first RM sheet and the second RM sheet are piggybacked and conveyed together toward the sheet processing device; and wherein when the RM sheet is equal to or greater than the predetermined size sheet:

the control unit causes the second pair of conveying rollers to convey the first RM sheet in the forward direction toward the sheet processing device, and after the trailing edge of the first RM sheet passes the guide member, the first RM sheet is conveyed in the backward direction to the second conveying path and is stopped while being held in a nip of the second pair of conveying rollers with the leading edge of the first RM sheet in the forward direction thereof extending towards a downstream side of the second pair of conveying rollers, and when the second RM sheet is sequentially conveyed, the first RM sheet and the second RM sheet are piggybacked and conveyed together toward the sheet processing device.

2. The sheet conveying device according to claim 1, wherein:

plural instances of the RM sheet include the first RM sheet temporarily stored in the second conveying path and the second RM sheet piggybacked and conveyable with the first RM sheet.

3. The sheet conveying device according to claim 2, wherein:

the control unit is further configured to the sheet conveying mechanism to change a position to stop a leading edge of the RM sheet according to the length of the RM sheet in the forward sheet conveying direction when the first RM sheet is conveyed in the backward direction to the second conveying path.

4. The sheet conveying device according to claim 2, wherein:

the second RM sheet is controlled to stop at a given position before reaching the sheet conveying mechanism when the sheet conveying mechanism is configured to piggyback the first RM sheet with the second RM sheet and convey the first and second RM sheets together to the sheet processing device.

5. The sheet conveying device according to claim 4, wherein:

the given position to stop the RM sheet is a position in which the leading edge of the second RM sheet contacts the sheet conveying mechanism.

6. The sheet conveying device according to claim 2, further comprising:

an absorbing mechanism configured to absorb a flexure of the second RM sheet generated after the second RM sheet reaches the sheet conveying mechanism when the sheet conveying mechanism conveys the first and second RM sheets together to the sheet processing device.

7. The sheet conveying device according to claim 6, wherein:

the second RM sheet is controlled to decelerate before the second RM sheet reaches the sheet conveying mechanism when the sheet conveying mechanism conveys the first and second RM sheets together to the sheet processing device.

8. The sheet conveying device according to claim 6, wherein:

the absorbing mechanism comprises:

a guide plate disposed facing a surface of the RM sheet passing through the first conveying path;

a spindle configured to angularly support the guide plate at a position located at upstream of the guide plate;

an elastic member configured to constantly bias the guide plate toward the first conveying path; and at least one stopper configured to regulate a position of at least one free end of the guide plate to form a gap in width of the first conveying path for conveying the RM sheet.

9. The sheet conveying device according to claim 8, wherein:

the absorbing mechanism is disposed at a position upstream of the first pair of conveying rollers in the forward sheet conveying direction.

10. The sheet conveying device according to claim 1, wherein:

the first pair of conveying rollers being arranged at a position located away from the branch point within a length of a B5 landscape RM size (182 mm).

11. The sheet conveying device according to claim 10, wherein:

the second pair of conveying rollers being arranged at a position located away from the branch point within a length of a B5 portrait size (257 mm).

12. The sheet conveying device according to claim 11, wherein:

the first pair of conveying rollers is switched to a first mode when conveying the RM sheet having the length in a forward sheet conveying direction equal to or greater than the length of the B5 landscape RM size (182 mm) and less than the length of the B5 portrait RM size (257 mm).

13. The sheet conveying device according to claim 11, wherein:

the first pair of conveying rollers is switched to a first mode when conveying the RM sheet having a length in the forward sheet conveying direction equal to or greater than the length of the B5 portrait RM size (257 mm).

14. The sheet conveying device according to claim 1, wherein:

a status of the least one of the first and second conveying rollers are switched to a first mode when conveying the RM sheet having the length in the forward sheet conveying direction less than a length of a legal portrait RM size (355.6 mm); and a status of the least one of the first and second conveying rollers are switched to a second mode when conveying the RM sheet having the length in the forward sheet conveying direction equal to or greater than a length of a legal portrait RM size (355.6 mm).

15. The sheet conveying device according to claim 1, further comprising a sheet detection sensor disposed at a position as close as possible to a point at which the RM sheet is conveyed in the forward and backward directions.

16. The sheet conveying device according to claim 15, wherein the sheet detection sensor is disposed at an immediate upstream side of the sheet conveying mechanism in a sheet conveying direction.

17. The sheet conveying device according to claim 1, wherein the first pair of conveying rollers is located between the guide member and the sheet processing device.

18. The sheet conveying device according to claim 1, wherein the second pair of conveying rollers is located between the first pair of conveying rollers and the sheet processing device.

19. A sheet conveying device, comprising:

a passing device for passing a recording medium (RM) sheet therethrough in a sheet conveying direction;

a storing device for temporarily storing the RM sheet conveyed therein, the storing device being branched from the passing device;

a conveying device for conveying the RM sheet selectably in one of forward and backward directions, the conveying device including a first pair of conveying rollers and a second pair of conveying rollers;

a guiding device for guiding the RM sheet at a branch point of the passing device and the storing device when the RM sheet is conveyed in the backward direction by the conveying for conveying to the storing device; and a control device for controlling the conveying device to change a distance between the branch point and the conveying device according to a length of the RM sheet in the sheet conveying direction, wherein when the RM sheet is smaller than a predetermined size sheet:

the control device causes the first pair of conveying rollers and the second pair of conveying rollers to convey a first RM sheet in the forward direction toward a sheet processing device, and after a trailing edge of the first RM sheet passes the guiding device, the first RM sheet is conveyed in the backward direction to the storing device and is stopped while being held in a nip of the first pair of conveying rollers with a leading edge of the first RM sheet in the forward direction thereof extending towards a downstream side of the first pair of conveying rollers, and when a second RM sheet is sequentially conveyed, the first RM sheet and the second RM sheet are piggybacked and conveyed together toward the sheet processing device; and wherein when the RM sheet is equal to or greater than the predetermined size sheet:

the control device causes the second pair of conveying rollers to convey the first RM sheet in the forward direction toward the sheet processing device, and after the trailing edge of the first RM sheet passes the guiding device, the first RM sheet is conveyed in the backward direction to the storing device and is stopped while being held in a nip of the second pair of conveying rollers with the leading edge of the first RM sheet in the forward direction thereof extending towards a downstream side of the second pair of conveying rollers, and when the second RM sheet is sequentially conveyed, the first RM sheet and the second RM sheet are piggybacked and conveyed together toward the sheet processing device.

* * * * *